US006077161A

United States Patent [19]

Wisler

[11] Patent Number: 6,077,161

[45] Date of Patent: Jun. 20, 2000

[54] MULTIPLAYER CARD GAMES HAVING CARD PLAYS TO FOUNDATIONS

[76] Inventor: James M. Wisler, 5557 S. Lansing Way, Englewood, Colo. 80111

[21] Appl. No.: 08/928,212

[22] Filed: Sep. 12, 1997

[51] Int. Cl.[7] ..... A63F 9/24

[52] U.S. Cl. ..... 463/11; 463/40; 463/41; 463/42; 273/292; 273/309

[58] Field of Search ..... 463/11, 12, 13, 463/25, 31, 40, 27, 41, 46, 42, 17, 37; 273/292, 143 R, 309, 303; 707/102, 103, 194

[56] References Cited

U.S. PATENT DOCUMENTS

| | | | |
|---|---|---|---|
| 4,652,998 | 3/1987 | Koza et al. | 364/412 X |
| 4,912,310 | 3/1990 | Uemura et al. | 235/380 X |
| 5,224,706 | 7/1993 | Bridgeman et al. | 273/85 CP X |
| 5,639,088 | 6/1997 | Schneider et al. | 273/138.2 X |
| 5,735,525 | 4/1998 | McCrea, Jr. | 273/309 X |
| 5,746,432 | 5/1998 | Feola | 273/274 X |
| 5,755,621 | 5/1998 | Marks et al. | 463/42 X |
| 5,947,821 | 9/1999 | Stone | 463/13 X |

*Primary Examiner*—Lee Young
*Assistant Examiner*—Binh-An Nguyen
*Attorney, Agent, or Firm*—Sheridan Ross P.C.

[57] ABSTRACT

Multiplayer card games capable of being played online using a communications network are provided. The card games are solitaire-related in that card plays are made to foundations using a number of different card piles. In one embodiment, each player uses a client that includes computer hardware and software for displaying the card layout for that player. The cards of the players of the same multiplayer card game, except for foundation cards, are different. Client and server software are utilized in controlling card plays to the foundations and regulate card movement as displayed using the computer screens of the clients. Certain card plays are disabled for a particular player until validation thereof is received using the server. Indication is provided on a particular player's screen related to the disabled card play. When the same card is played to the same foundation close in time by two or more players, a determination is made as to which player played first using the server software. Depending upon the results of this determination, client software can be utilized in illustrating on the display screen a return of a card that was just played to its origination position. Under such circumstances, the screen displays of the players illustrating these card movements for the particular card play are different.

30 Claims, 80 Drawing Sheets

MULTIPLAYER CARD GAMES HAVING CARD PLAYS TO FOUNDATIONS

FIELD OF THE INVENTION

The present invention relates to multiplayer card games, in particular, solitaire-related card games involving the use of foundations and resolution of conflicts that arise when different players play the same card to the same foundation.

BACKGROUND OF THE INVENTION

A substantial number of card games have proven popular forms of entertainment for the players and, in some cases, for observers of the card games. Widely played card games include various versions of Solitaire. Like many such classic card games, Solitaire card games have been computerized and can be found on commonly available media used by computers. Traditional Solitaire is played by a single player and has well-known card layouts and rules for the player. Certain Solitaire-related card games have been devised that require two or more players, one of these currently played games is identified as "Multiple Klondike." A related version is identified as "Klondike For Two." In the Multiple Klondike game, each player has a unique deck and deals cards to the well-known layout of seven tableau piles. All remaining cards start out in the hand. Start of play is simultaneous, with each player playing to common foundations. In the Klondike For Two game, players share common foundations, but take turns playing. Play moves to the next player when a player turns three cards over from the hand. In both versions of Klondike games, the winner is the player first to play all cards to the foundations. If play is blocked for all players, the player with the most foundation cards played wins. In the Multiple Klondike card games, certain card playing conflicts can arise. For example, two players may attempt to simultaneously play the same card to the same foundation. When this is done manually by the players, the first arriving card remains, while the second arriving card is returned to its originating point by the player attempting to make this play.

Another solitaire-related card game involving multiple players is known as "Spit". In accordance with the rules of this card game, players deal out five tableau piles in similar fashion to the seven tableau piles when playing the Klondike games. All remaining cards go to the hand pile. The cards in the hand pile are the "spit" cards. Each player turns one spit card up in the foundations. Any player may play from the players tableaus to the foundations in either incrementing or decrementing card rank, with alternating color. When further play is blocked for all players, another "spit" card is played to the foundations by each player creating potential play possibilities. Play ends when one player plays all of his cards to the foundations. Like the Multiple Klondike card game, two players may simultaneously attempt to play to the same foundation and the first arriving card succeeds or plays.

Although computerized implementations of single player solitaire are now commonplace in the software entertainment field, solitaire-related card games requiring multiple players are not. These card games offer challenges and present problems in a computer environment that are not found with single-player solitaire. This is especially true in the field of computerized online card playing. The Internet and online services, such as AOL (America Online), allow players to connect through their telephone lines to a common interconnected network. Such network media allow players to play computer games online through the transmission of card playing data and communication of other information related to playing computer games online. When playing online solitaire-related card games, unique problems and challenges arise due to the different locations of the computers that are utilized, including the computers used by the players and the computer used in monitoring or controlling the card plays.

SUMMARY OF THE INVENTION

In accordance with the present invention, a method, together with associated system, are provided for playing card games requiring two or more players and a plurality of foundations that are able to be used by each player during the playing of the card game. The system includes a game server and a plurality of clients that are operatively connected together using a communications network, such as the Internet. The game server comprises computer hardware and software having one or more processors. The game server manages and controls functions related to card playing communications among the clients, as well as data and other information or communication transfers between the game server and one or more of the clients. Each of the clients includes necessary hardware and software for initiating, controlling and displaying card plays that are part of the card games. Each client typically includes a computer having processing and application program execution capability, such as a PC, together with appropriate peripheral devices including a terminal or display screen and an input device, such as a mouse.

Key aspects of the system are implemented through software, which is responsive to inputs by the players, for handling potential conflicts that can arise related to card plays being made to foundations. In particular, the card games of the present invention have a plurality of card piles including, for each client and associated player, a hand pile, a number of tableaus and a number of foundations. Each of such card piles or sets is displayed for each player using the display screen of the particular player's client. The foundations that are displayed are the same for each display screen. The hand pile and the number of tableaus are different for each player. In one embodiment of a solitaire-related card game, in addition to the afore-noted card piles, a middle stack is provided. A waste pile is built from the hand pile by the player when card plays to other card piles are not available. The middle stack includes a number of cards and such cards are played therefrom to the foundations and the tableaus.

Regardless of the identity or number of card piles, card plays to the common foundations of all players playing the multiplayer card game are specially monitored and controlled. More specifically, as part of the operation of the system, when a card play is made to a foundation, software preferably residing with the game server determines whether the card played to the foundation is still valid or acceptable. In conjunction with this determination made by the game server, a confirmation is made to the players of the card game by permitting updating of the displays of the client that the players are using to play the card game. That is, the displays are updated to reflect the successful or valid play to the foundation on the displays that provide the common foundations.

This operation involving the game server is particularly necessary when two players play the same card to the same foundation close in time. In such a case, the same card of both players cannot be validly played to this same foundation. The server determines which of these two card plays is first and allows the first in time card to be played or accepted. The same card that was played second in time is returned to the location or card pile from which it started, when no other foundation play for that card is presently available. If that same card can be played to another foundation at this time, the server will notify clients of this same but second in time card to this other available foundation. This control includes permitting the software residing with the client used by the player, who initiated the card play to the foundation, to be able to animate or move the playing card to this other foundation.

As part of this determination process when a card is played to a foundation, an indication is provided on the computer display screen of the client of the player who initiated the card move. Specifically, the particular card pile from which the card was moved to the foundation is identified by phantom or ghosting of the card (depicted in the drawings as dotted lines) until the server finds that the card play to the foundation was valid. The ghosting of the origination point of a card being played to a foundation informs the card player on the player's display screen that certain plays related to the ghosted card cannot be made until the validity of the card play to the foundation has been resolved. For example, when the top card of the middle sack is played to a foundation, that card image is ghosted in its origination location until the validity of the play to the foundation is determined. When such a card play is determined to be valid, the ghosting is removed. When the card play is invalid, the card that had been selected for play to the foundation is returned to its origination point, the middle stack, and the ghosting is removed. These requirements ensure that a player is not able to make a subsequent card play from a card pile when the previous card play from that stack could be invalid and must be returned. Not all card piles or stacks with a ghosted card are disabled from play. For example, when a tableau includes a non-ghosted card and a ghosted card overlying or on top of the non-ghosted card, and a solitaire card play can be made using the non-ghosted card that would not affect the relative position of the ghosted card, such as a move to another tableau pile, both the ghosted and nonghosted cards can be played or moved. The important aspect related to control over a ghosted card is based on disallowing card plays that would not be permitted if the card play involving the ghosted card were deemed invalid by the server, resulting in the card being returned to its origination position. Based on such card play conflict resolution, the illustrations or displays of card plays seen by the players are different. Under common control of the game server, each of the client screen displays is able to depict the card play of the particular player using that player's client in which card play may be different. By way of example, a first player may play a card to a foundation from a tableau and the next card in the tableau may be ghosted for a fraction of a second, together with animation being seen of the card being played from the tableau to the foundation. A second player playing the same card to the same foundation using a second client as a different display. Since this card play was second in time to the card play of the first player, there is an illustration of the second player's card being returned to the pile from which it came, which is not illustrated on the first player's client display screen. Because the foundations are common to all of the players, the display screen does show all of the same foundations for each of the players and the second player does see the end result of the valid or successful play by the first player to the foundation.

The client, by virtue of input from the player using the client, also includes software for displaying animations of card plays to and from card piles that do not include the foundations, such as involving tableaus, middle stacks and hand and waste piles. These card plays do not require immediate transfer of information to the game server. In such a case, updating of these card plays involving a particular client can occur after a number of such card plays, and game server notification thereof is beneficial in monitoring fair and proper playing of the multiplayer card game at each of the clients.

In conjunction with the game server making its determinations as to the first card played to a foundation, such a determination can be made by the server checking a queue that it establishes and having each card play to the foundation by a particular player being indicated in a queue location. As a consequence, the game server checks the appropriate queue location and based on the information in that queue location is able to ascertain the identity of the client making the valid card play. As can be appreciated, the clients and the game server are physically separated from each other and each client can be geographically located at a substantially different distance from the common game server, In such a situation, it may be that, even though the first player initiated a card play to the foundation using the first client at a first time, a second player's card play to the same foundation may reach the game server queue before information related to the card play of the first player. This can occur, for example, when the second player's client is much faster at processing and sending information to the server. In one embodiment, a "fair play" feature is employed when differences in times between card plays at different clients is less than a predetermined time. In this embodiment, each client generates a time stamp for each foundation card play at the time the client displays the foundation card play, which is when the player first sees the foundation card play appear on his display. A delta time is recorded by the client when the player makes a card play to a foundation. This delta time is the actual time difference between the time a player saw a foundation play opportunity and reacted to it, and it is irrespective of any transmission times. The delta time stamp accompanies the other information that is sent to the game server. The game server may use the time stamps accompanying the card play information when a card play conflict arises. In such a case, the game server may determine that card play information received by it second in time actually is the valid play because it has a shorter delta time stamp.

When playing the multiplayer card game, each of the players of the particular game has the same format or layout, but with different cards, illustrated on the screen of the player's client. Each card layout is substantially rectangular or square in shape, with all of the foundations being displayed. That is, the number of foundations corresponds to the number of players. Each player has four foundations since there are four suits in the card deck. The card piles, other than foundations, are depicted relatively adjacent to the bottom of the display screen and with this player's foundations being illustrated just above these card plays. The foundations of the other players having the other clients are displayed relatively adjacent to the periphery of the foundation area on the display screen. In the case of four players playing the multiplayer card game, foundations of other players are displayed along the sides and top of the display screen. None of the other card piles of the other players are displayed so that each player only sees his own card piles, and the foundations of all the players that can be used by all of the players.

Based on the foregoing summary, a number of salient features of the present invention are readily discerned.

Computerized and online card playing of multiplayer card games involving card plays to foundations is provided. The multiplayer game automatically checks for valid or acceptable plays to the foundation. Relatedly, procedures are implemented for resolving card playing conflicts that can arise when two players play to the same foundation close in time. In that regard, an appropriate determination is made as to which of the conflicting card plays was first in time. In doing this, each player's display screen is able to display different animations depending upon the resolution. Moreover, certain card plays are proscribed during this determination related to card plays to the foundation using a card indicator, such as ghosting of the proper card. An effective division of control between clients and the game server is included in the operation associated with card play. Each client has substantial control over animation of the cards being played by its player and not all card plays need be submitted to the game server before it is found to be an acceptable card play. In one embodiment, the game server takes into account the actual time at which a play to the foundation was made to compensate for differences related to sending of card play information by different clients from different locations to the server.

Additional advantages of the present invention will become readily apparent from the following discussion, particularly when taken together with accompanying drawings.

Figure 42:
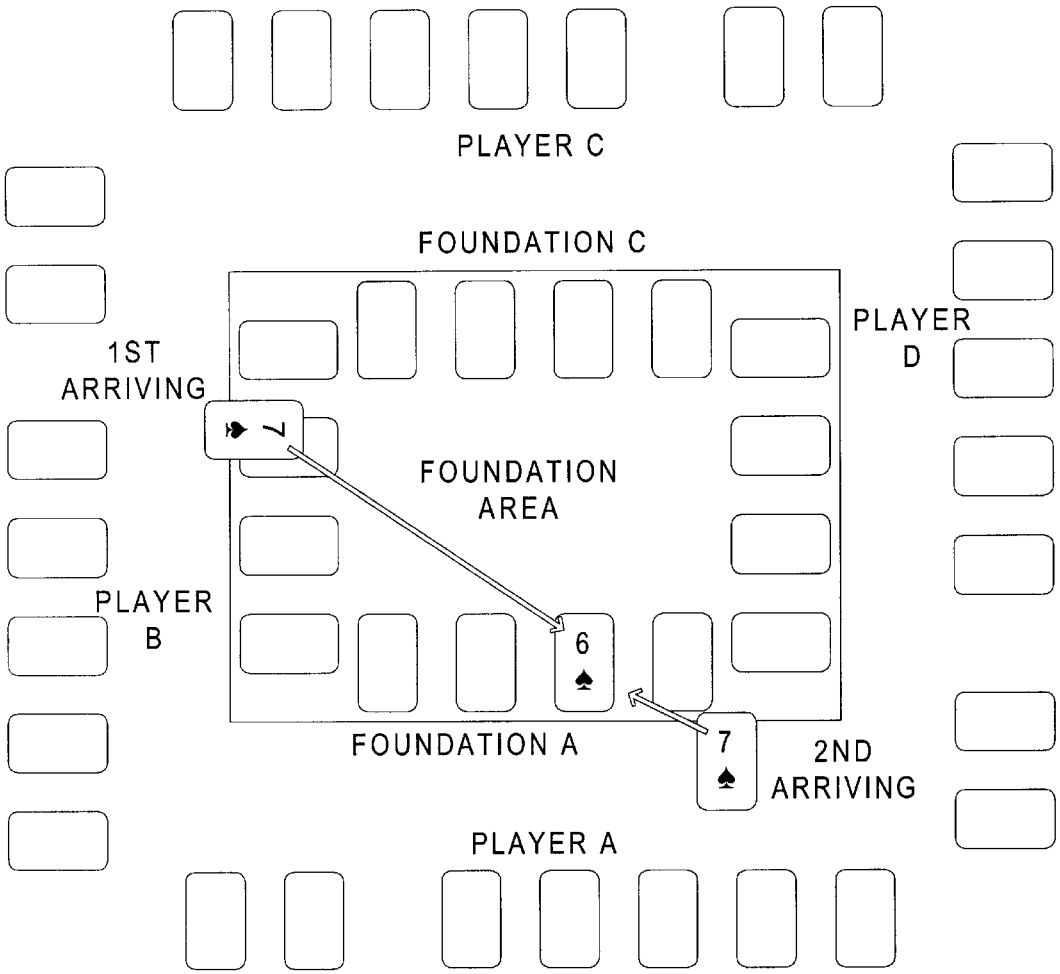
FIG. 42 illustrates an aggregate view of closely timed foundation plays in a real world (non-computer) environment, where all players are sitting around a table or in proximity at a single location. In this example, there is a 6 of spades already played to a foundation pile. Player B is first to make a foundation card play with his 7 of spades. Player A, almost simultaneously, but slightly behind player B, tries to make a foundation card play with his 7 of spades to the identical foundation pile as player B. He sees that player B's card play arrives first. Seeing that there is no other foundation upon which to play his 7 of spades, he immediately returns it to its origination point.

In a networked or online environment, the real world example depicted in FIG. 42 looks different from the server's and every player's perspective. When played online, real world example depicted in FIG. 42 is shown from the server's perspective in FIGS. 49 and 50, from player A's perspective in FIGS. 43 through 45 and FIGS. 51 through 53, and from player B's perspective in FIGS. 46 through 48 and FIG. 54.

Figure 43:
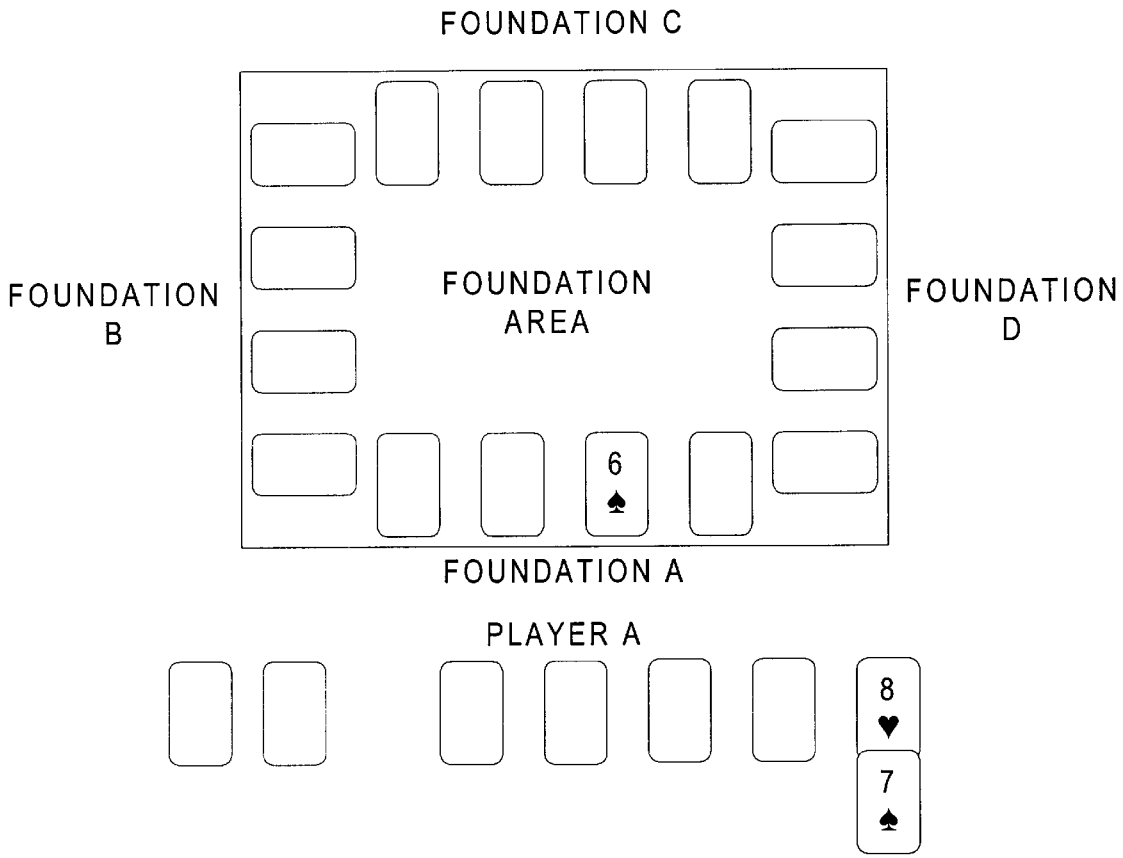
Figure 44:
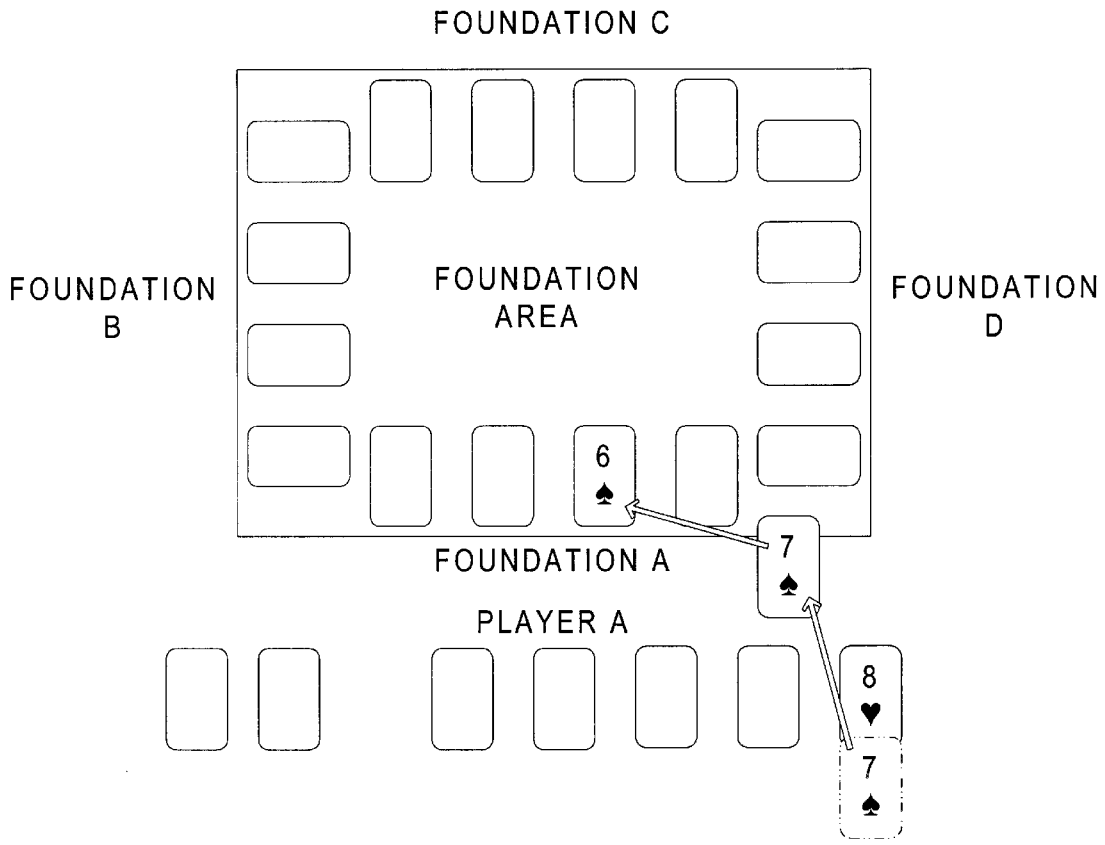
Figure 45:
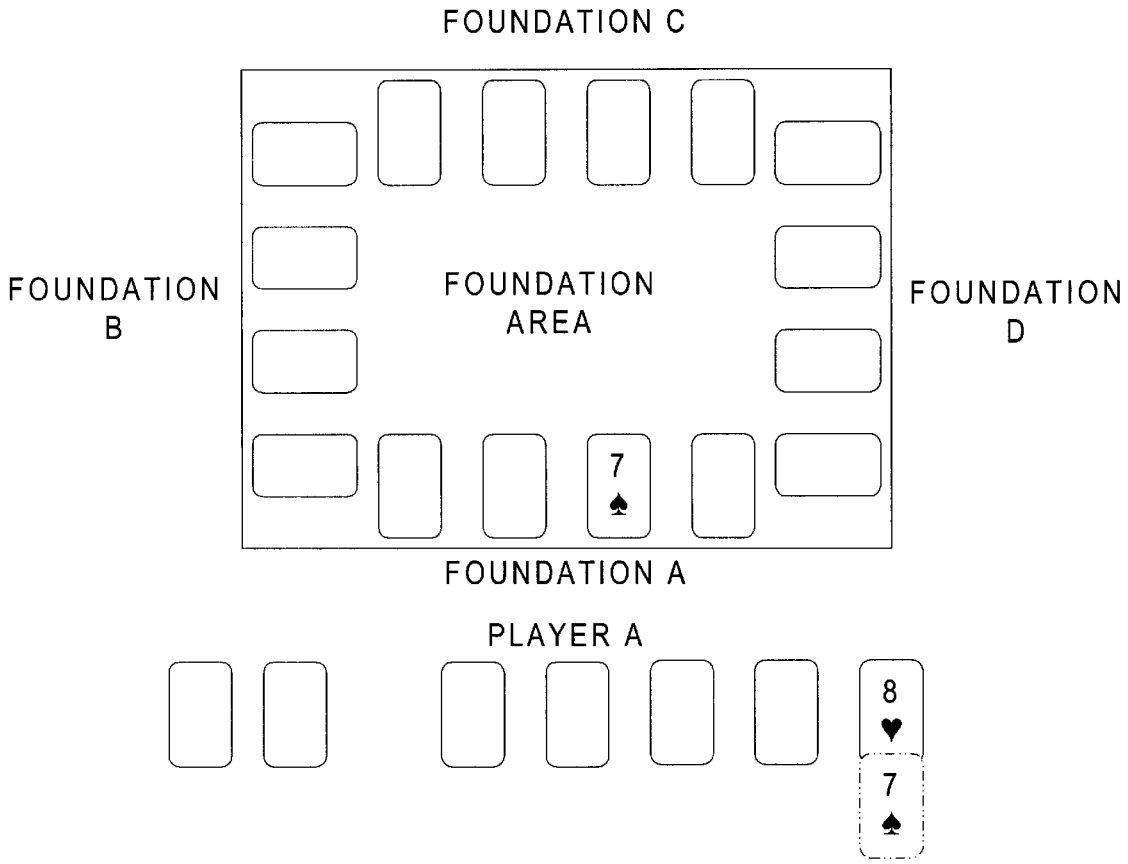
Figure 46:
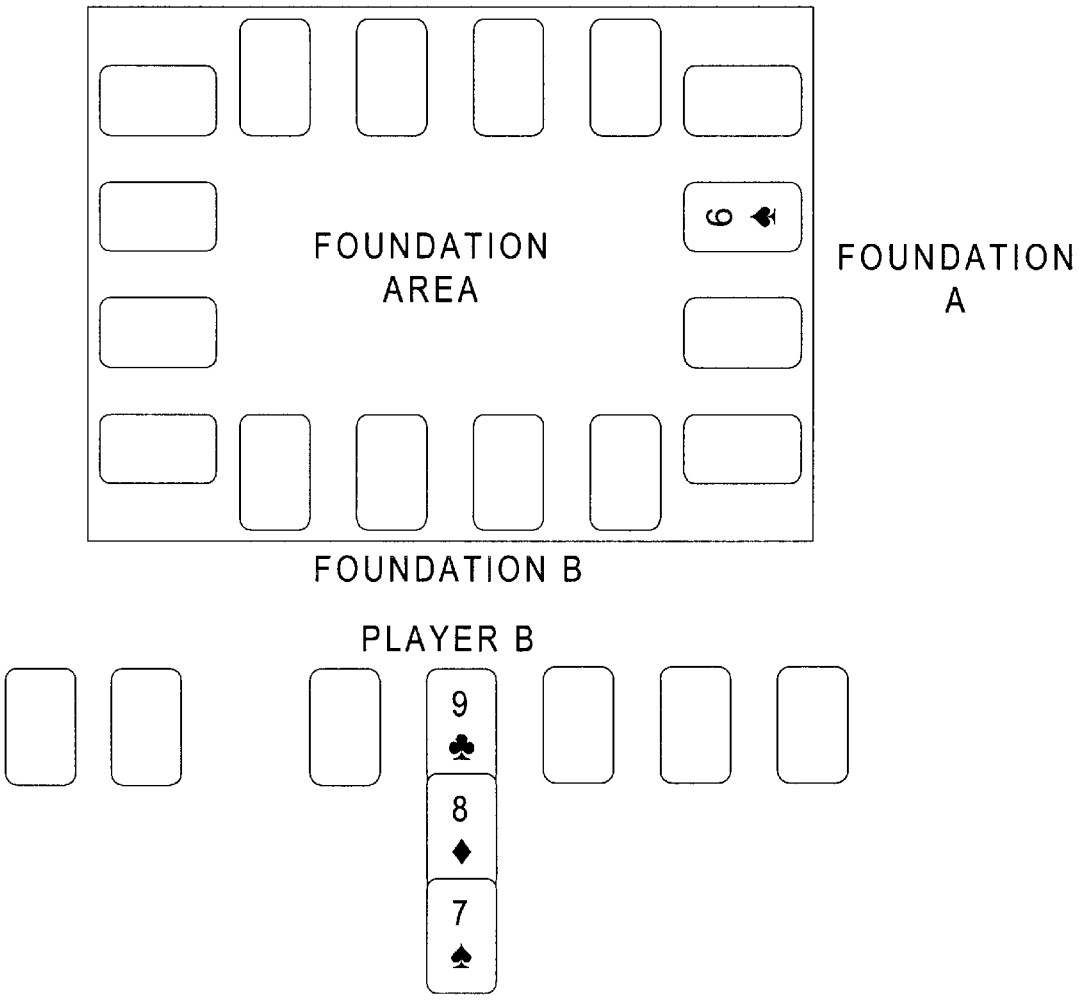
Figure 47:
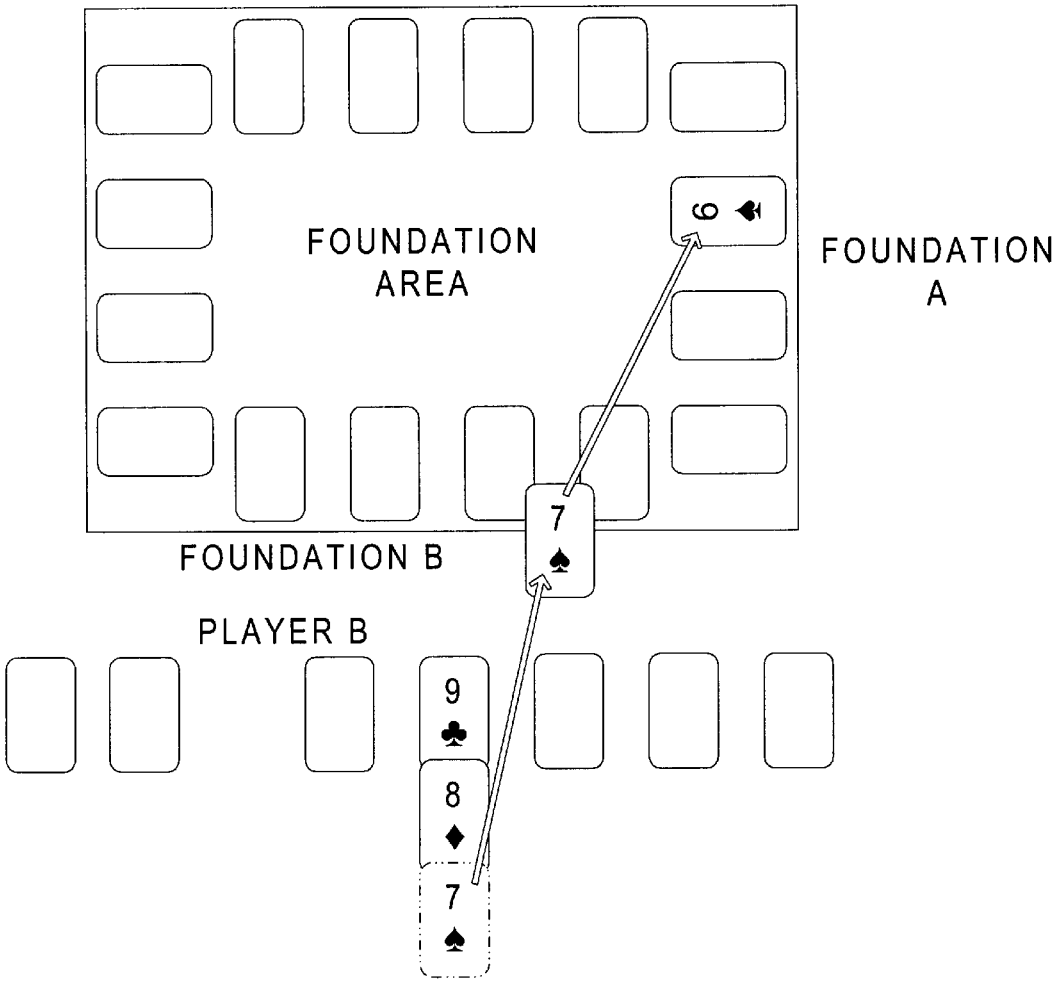
Figure 48:
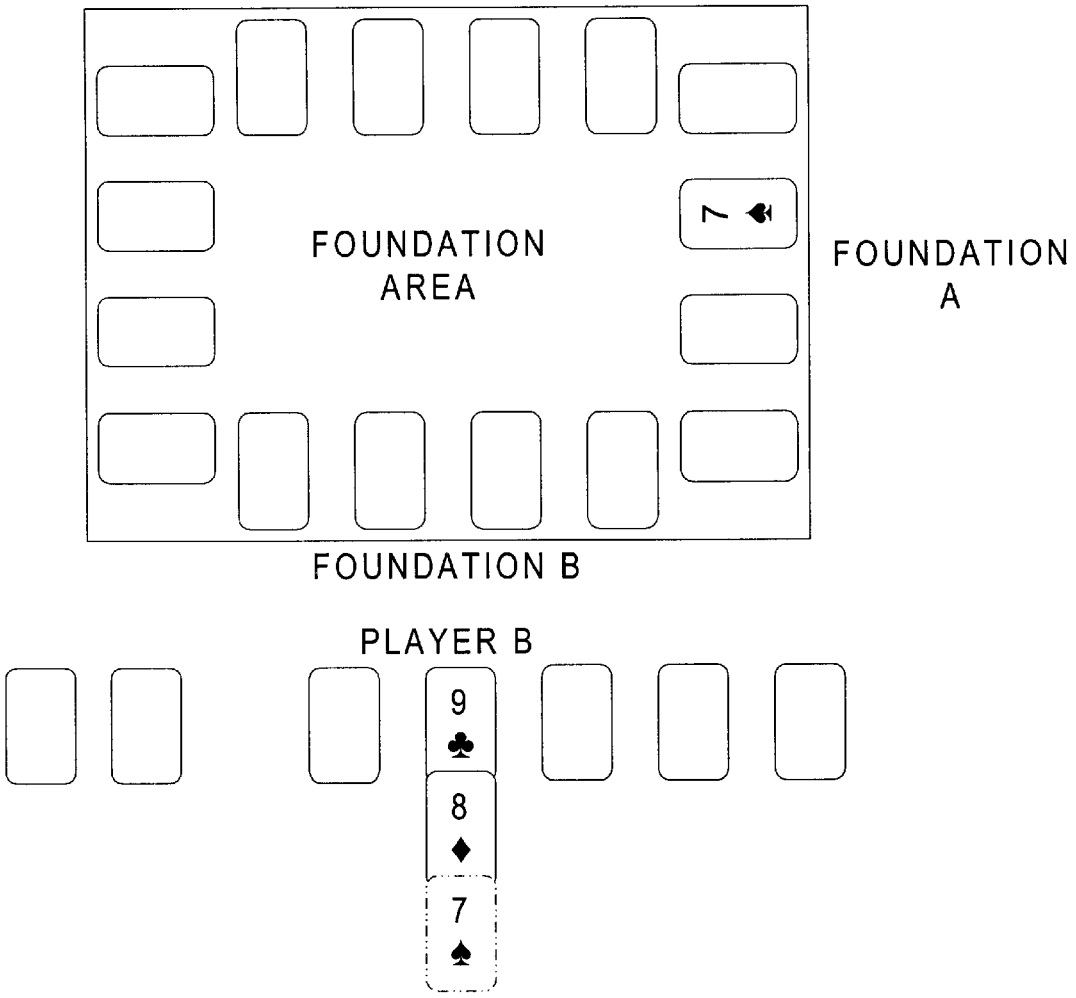
Figure 49:
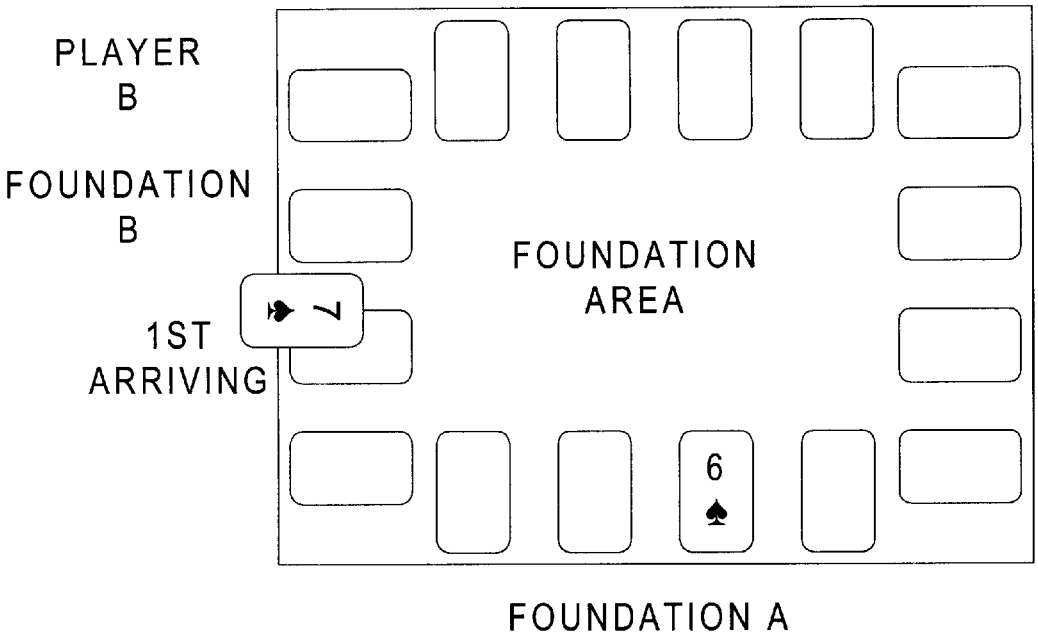
Figure 50:
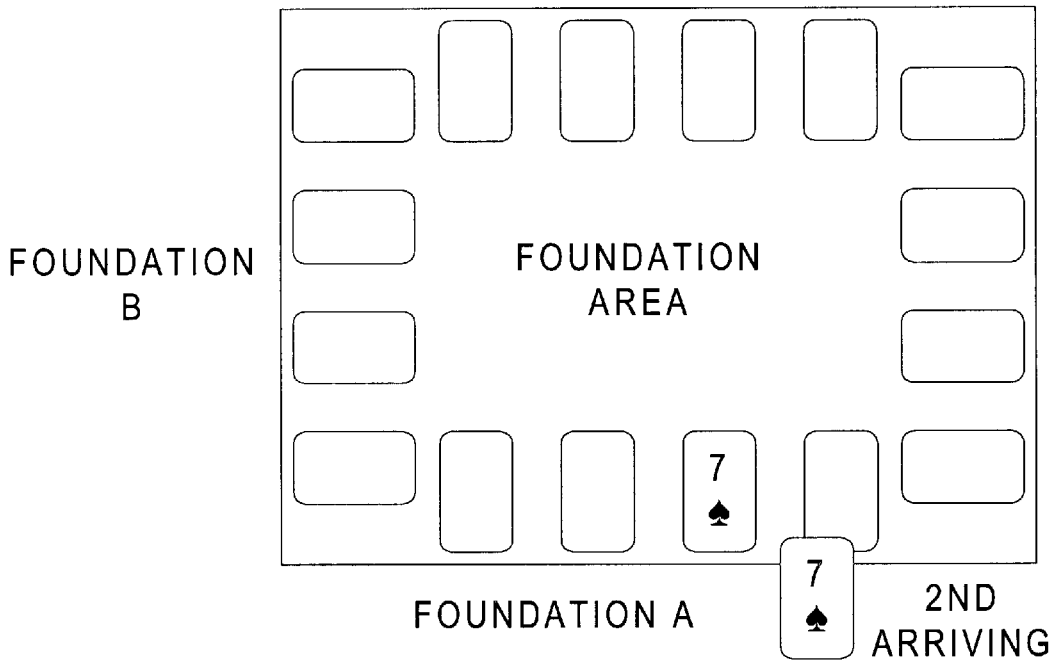
Figure 51:
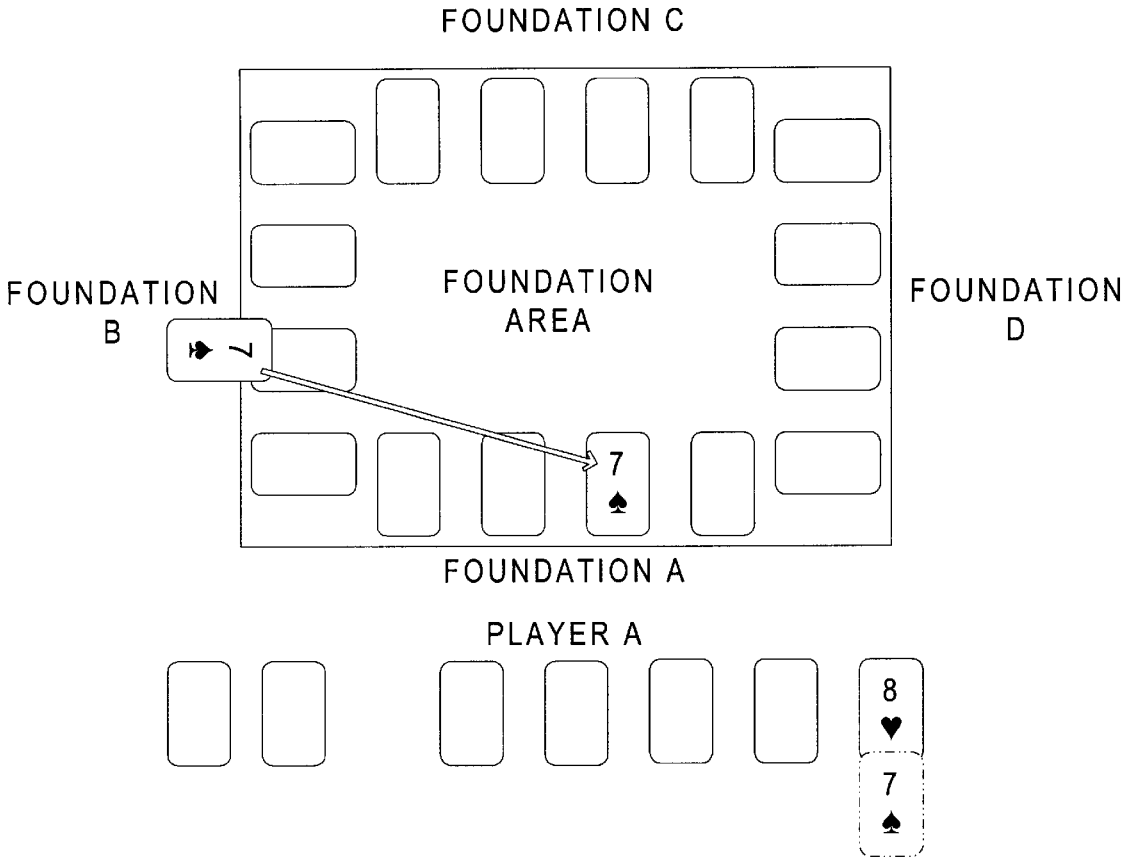
Figure 52:
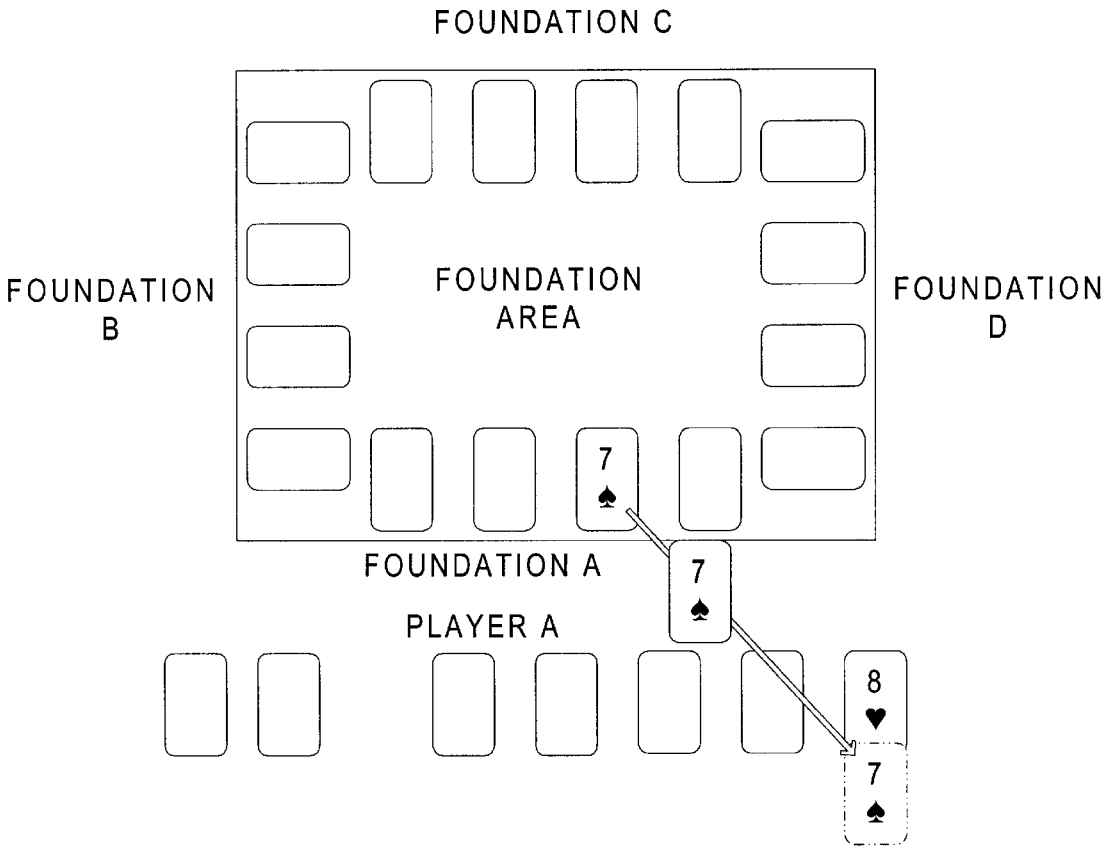
Figure 53:
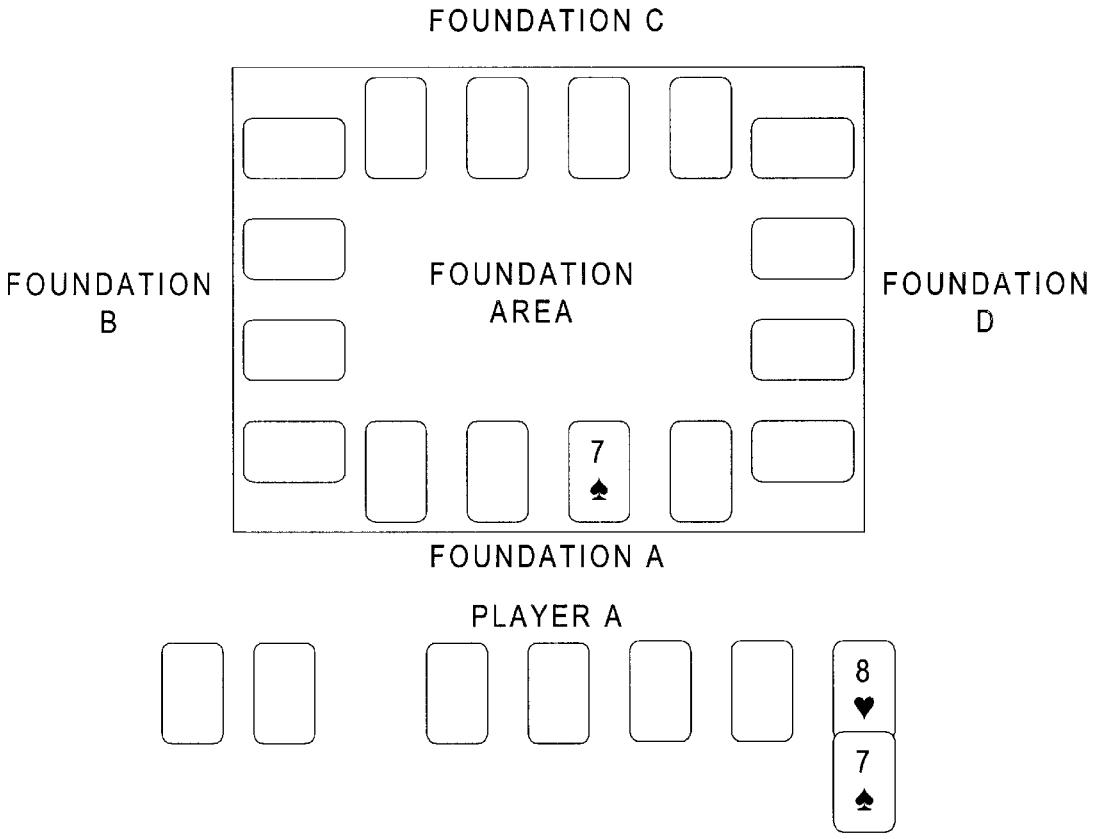
Figure 54:
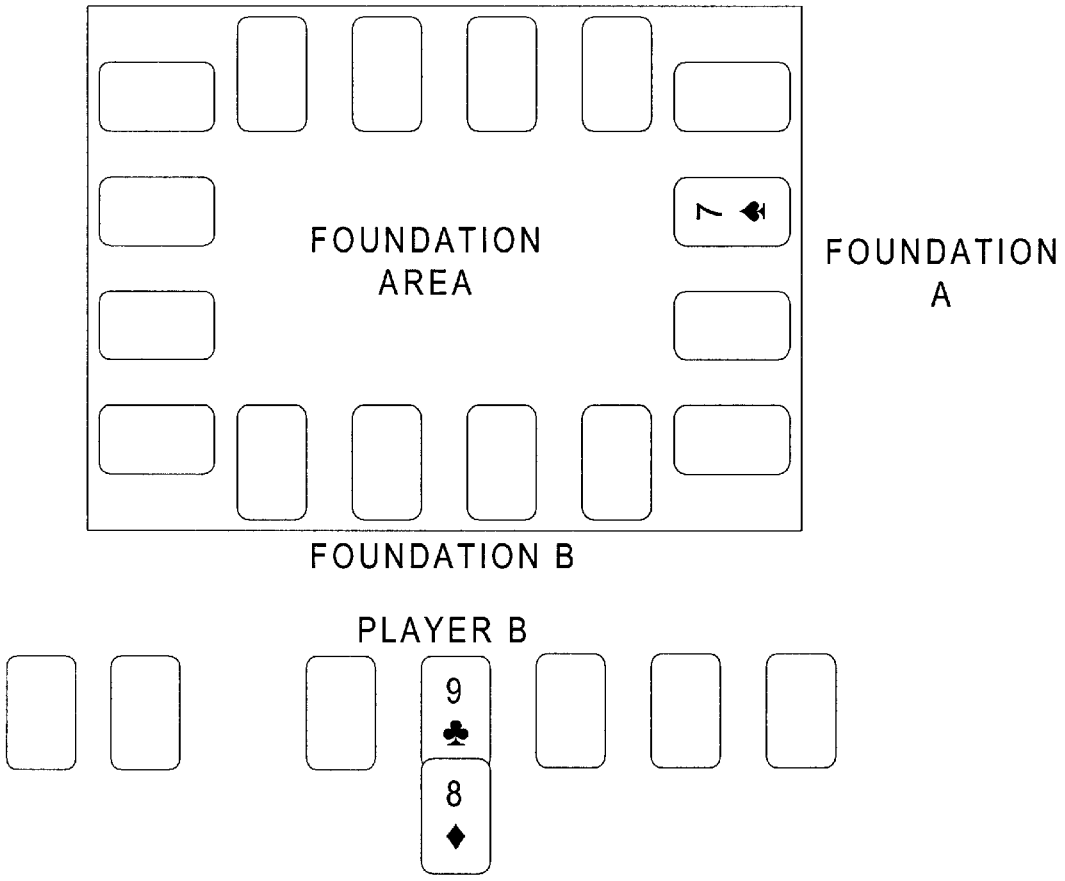
Figure 55:
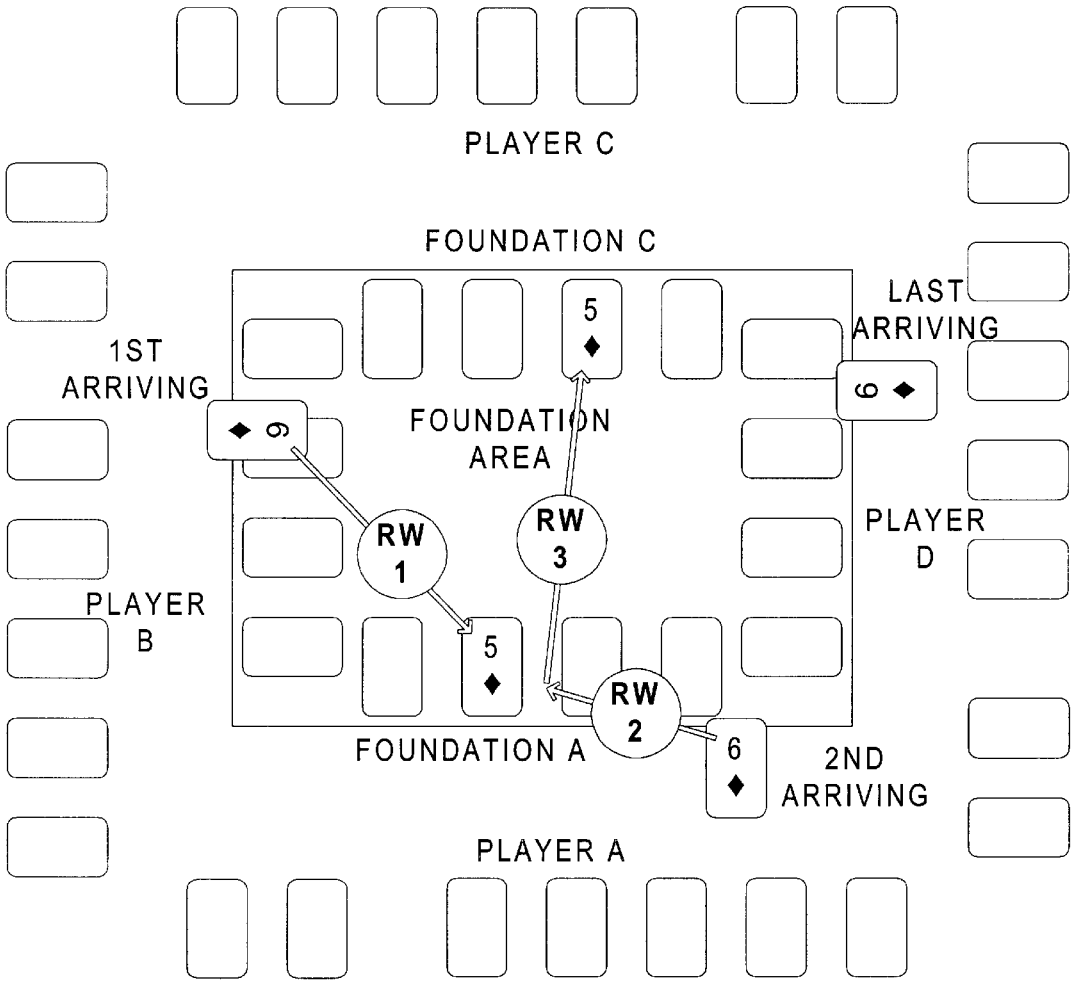

FIG. 43 illustrates a view from player A's perspective of an open 6 of spades on foundation A upon which player A can play his 7 of spades;

FIG. 44 illustrates player A making the 7 of spades foundation card play;

FIG. 45 illustrates the result of player A's 7 of spades foundation card play, the originating card position is ghosted (blocked) until an acceptance or a rejection of the card play by the server is received;

FIG. 46 illustrates a simultaneous view from player B's perspective of an open 6 of spades on foundation A upon which player B can play his 7 of spades. This view is seen at the same time player A views the illustration depicted in FIG. 43;

FIG. 47 illustrates player B making the 7 of spades foundation card play;

FIG. 48 illustrates the result of player B's 7 of spades foundation card play, the originating card position is ghosted (blocked) until an acceptance or a rejection of the card play by the server is received;

FIG. 49 illustrates from the server's perspective the events depicted in FIGS. 43 through 48 inclusive. The server will receive one card play before another. In this case the server receives the foundation card play from player B first. The server will accept the foundation card play to the nearest foundation to player B and communicate this card play acceptance to all clients;

FIG. 50 illustrates from the server's perspective that by the time player A's foundation card play arrives at the server, there was no foundation pile upon which to play it, so the server rejects the card play. The server will only send the rejection notice to the player that sent the card play, in this case player A;

FIG. 51 illustrates from player A's perspective, client A receiving the notice from the server that player B's card play was accepted on foundation A. Client A software will animate player B's card play to foundation A. Note: all clients playing in this game will receive this notification, all clients except client B will animate this card play on their respective screens (client B animated this card play on his screen at the time of the original card play);

FIG. 52 illustrates from player A's perspective, client A software receiving notice from the server that player A's card play to foundation A was rejected. Client A software will animate the return of player A's card to its originating position;

FIG. 53 illustrates the result, from Player A's perspective, of the actions depicted in FIGS. 51 and 52. Player B's card was accepted to foundation A. Player A's card was rejected and returned to its originating position, in which case the ghosting disappears;

FIG. 54 illustrates from player B's perspective, when client B software receives notification from the server that its card play was accepted on foundation A, it will simply remove the corresponding ghosting (block). Note: When another player's foundation card play is rejected, only that player will know that his foundation card play was even attempted, thus player B never sees player A's later attempt to play to the same foundation pile;

FIG. 55 illustrates an aggregate view of closely timed foundation plays in a real world (non-computer) environment, where all players are sitting around a table or in proximity at a single location. In the example, there are two 5 of diamonds already played to foundation piles. Player B is first to make a foundation card play with his 6 of diamonds (shown as step RW1). Naturally, he plays it to the position closest to his physical location. Player A, almost simultaneously, but slightly behind player B, tries to make a foundation card play with his 6 of diamonds to the identical foundation pile as player B (shown as step RW2). He sees that player B's card play arrives first, and before he is able to get his card to foundation A, immediately plays his card on the other open foundation pile, foundation C, (shown as step RW3). Player D initiates a foundation card play with his 6 of diamonds, but sees that he is too late and returns his 6 of diamonds to its origination point;

In a networked or online environment, the real world example depicted in FIG. 55 looks different from the server's and every player's perspective. When played online, the real world example depicted in FIG. 55 is shown from the server's perspective in FIGS. 56 through 60, from player A's perspective in FIGS. 61 through 65, from player B's perspective in FIGS. 66 through 70, and from player D's perspective in FIGS. 71 through 76.

FIGS. 56 through 60 inclusive will illustrate from the server's perspective what must occur in a networked or online environment to emulate the real world occurrence illustrated in FIG. 55.

Figure 56:
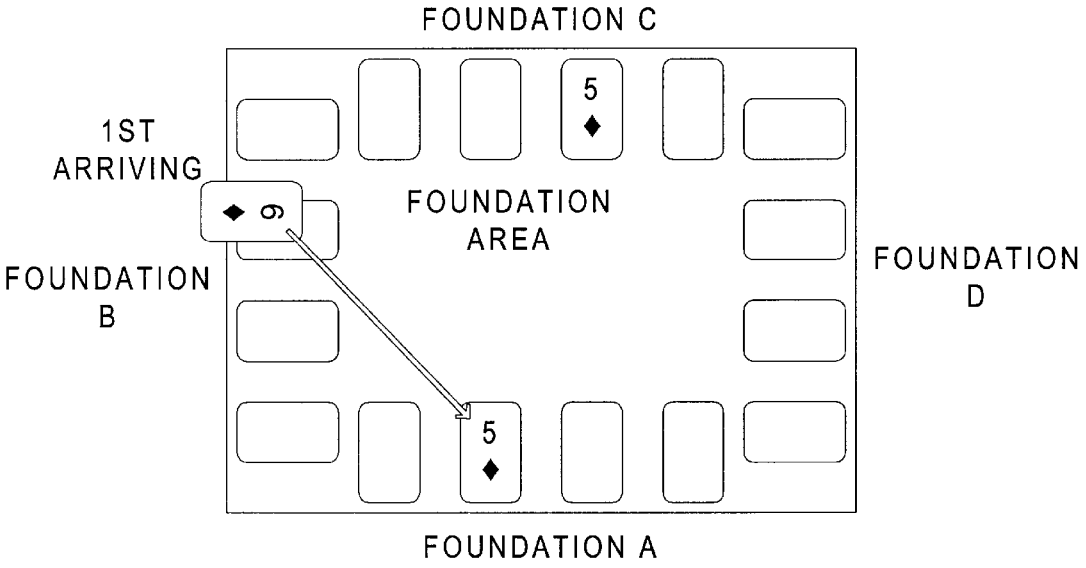
Figure 57:
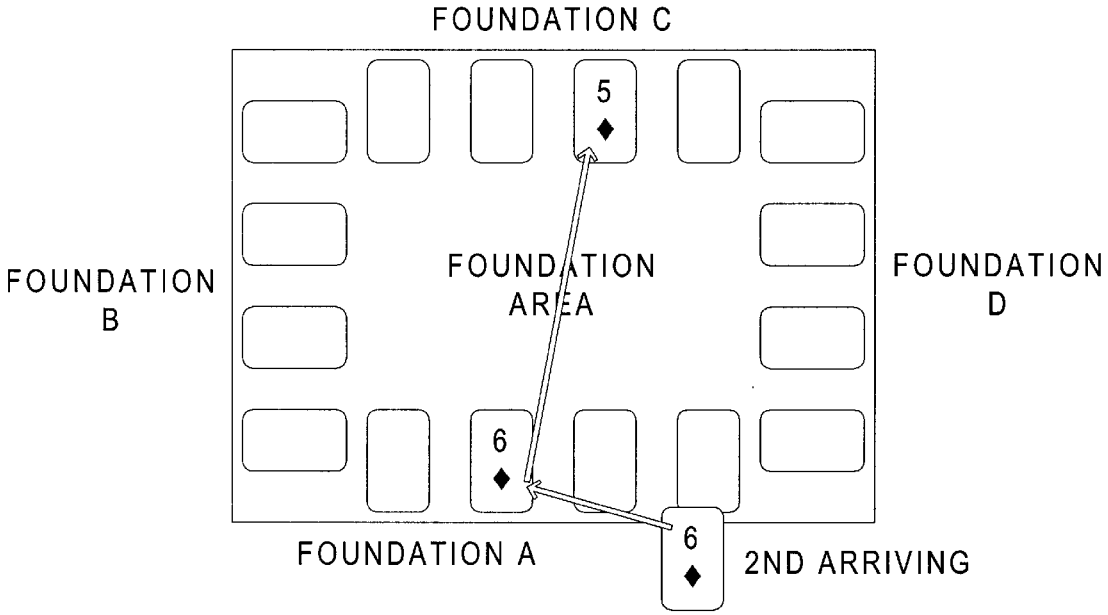
Figure 58:
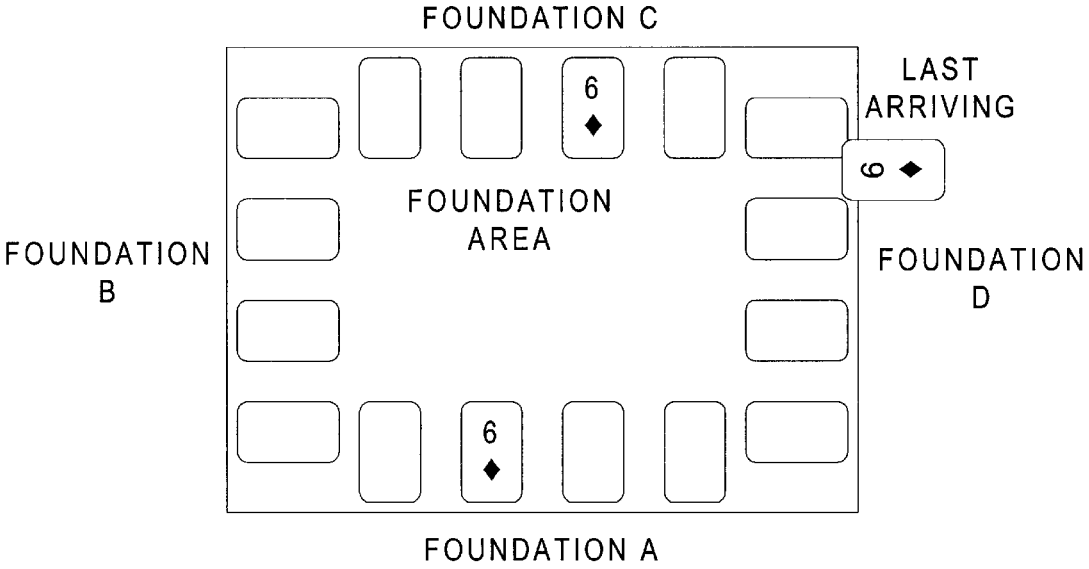
Figure 59:
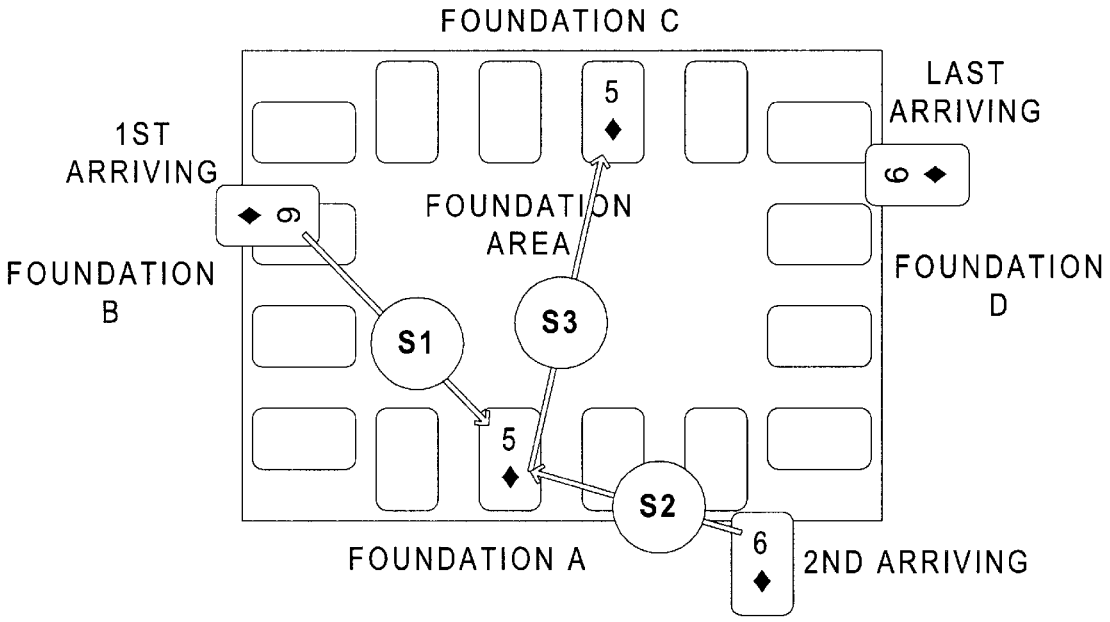
Figure 60:
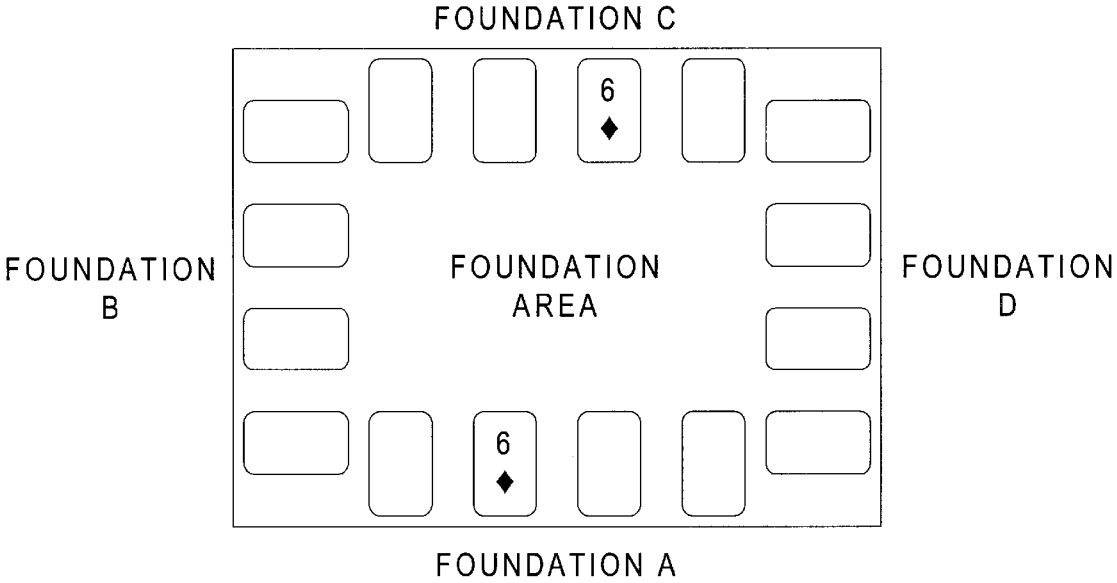

FIG. 56 illustrates that the server first receives notification of a 6 of diamonds card play from player B to foundation A. The server accepts this card play from player B and sends notification to all clients that player B made a successful card play of the 6 of diamonds to foundation A;

FIG. 57 illustrates the server then receives notification of a 6 of diamonds card play from player A to foundation A. The server has already accepted a 6 of diamonds foundation card play to foundation A from player B. The server accepts this card play from player A, however, the server's acceptance of this card play is to another available foundation, foundation C. The server then sends notification to all clients that player A made a successful foundation card play of the 6 of diamonds to foundation C;

FIG. 58 illustrates the server then receives notification of a 6 of diamonds card play from player D to foundation C. The server has already accepted a 6 of diamonds foundation play to foundation C from player A. The server rejects this card play from player D and sends notification only to client D that his card play was rejected;

FIG. 59 illustrates a summary of the events depicted in FIGS. 56 through 58. The server first receives notification of a 6 of diamonds card play from player B to foundation A (shown as step S1). The server accepts this card play from player B and sends notification to all clients that player B made a successful card play of the 6 of diamonds to foundation A. The server then receives notification of a 6 of diamonds card play from player A to foundation A (shown as step S2). The server has already accepted a 6 of diamonds foundation play to foundation A from player B. The server accepts this card play from player A, however, the server's acceptance of this card play is to another available foundation, foundation C (shown as step S3). The server then sends notification to all clients that player A made a successful foundation card play of the 6 of diamonds to foundation C. The server then receives notification of a 6 of diamonds card play from player D to foundation C. The server has already accepted a 6 of diamonds foundation play to foundation C from player A. The server rejects this card play from player D and sends notification only to client D that his card play was rejected;

FIG. 60 illustrates the result of the actions depicted in FIGS. 56 through 59 from the server's perspective. Player B's 6 of diamonds was played on foundation A, player A's 6 of diamonds was played on foundation C;

FIGS. 61 through 65 inclusive will illustrate from the player A's perspective what must occur in a networked or online environment to emulate the real world occurrence illustrated in FIG. 55.

Figure 61:
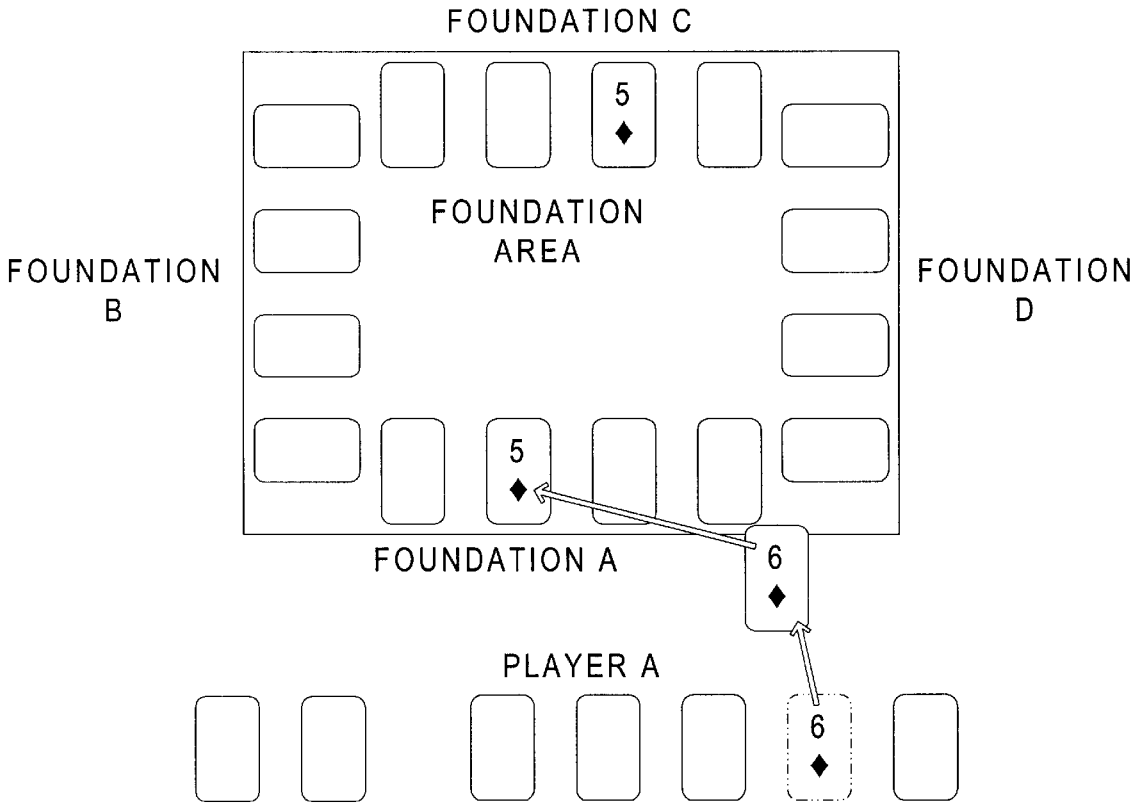
Figure 62:
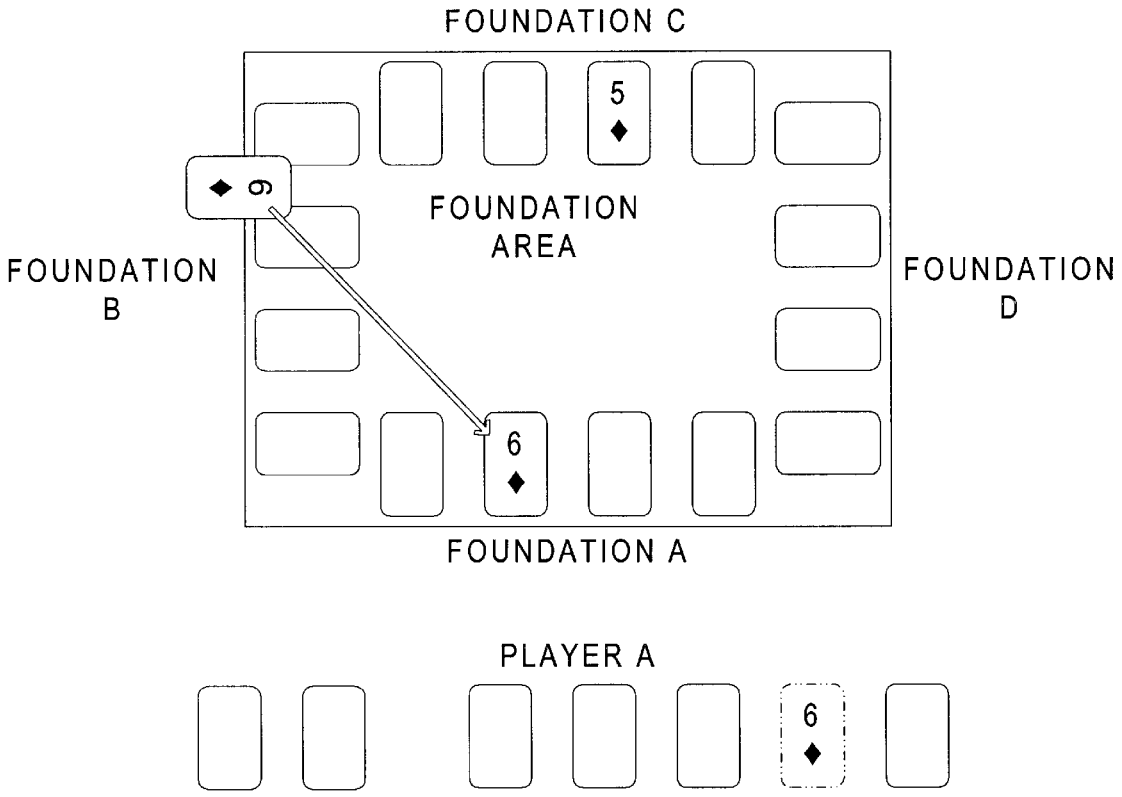
Figure 63:
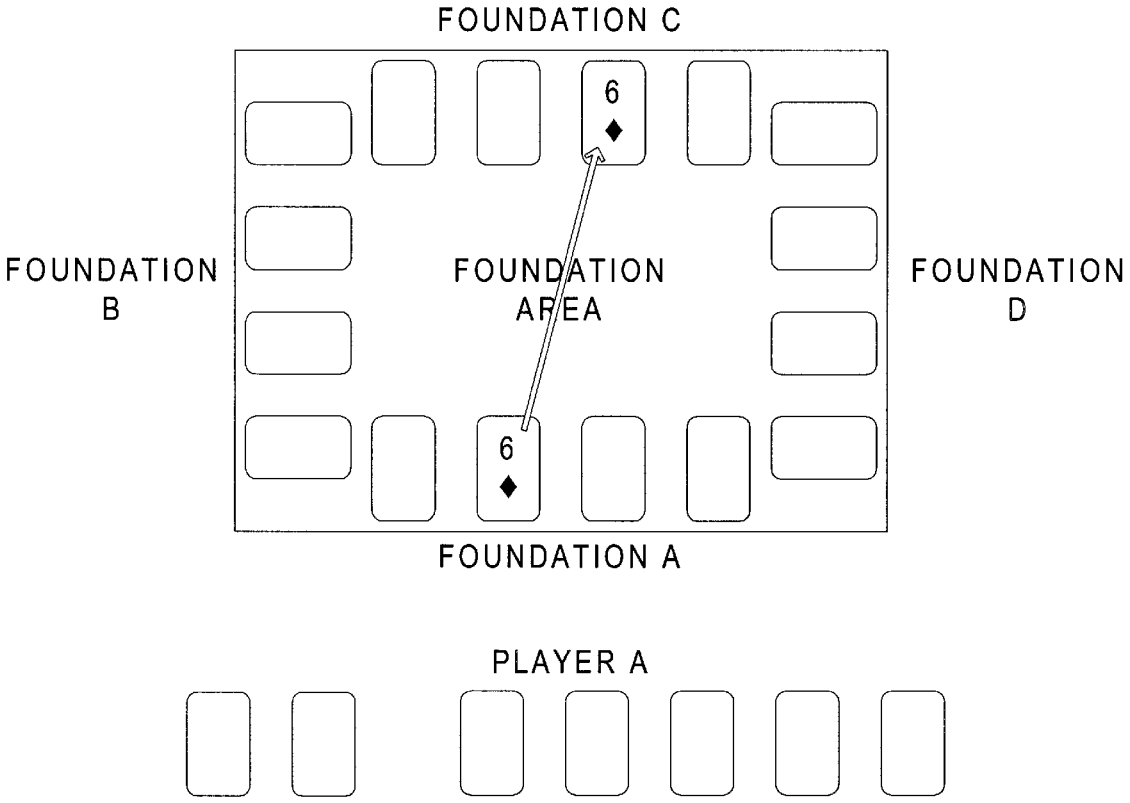
Figure 64:
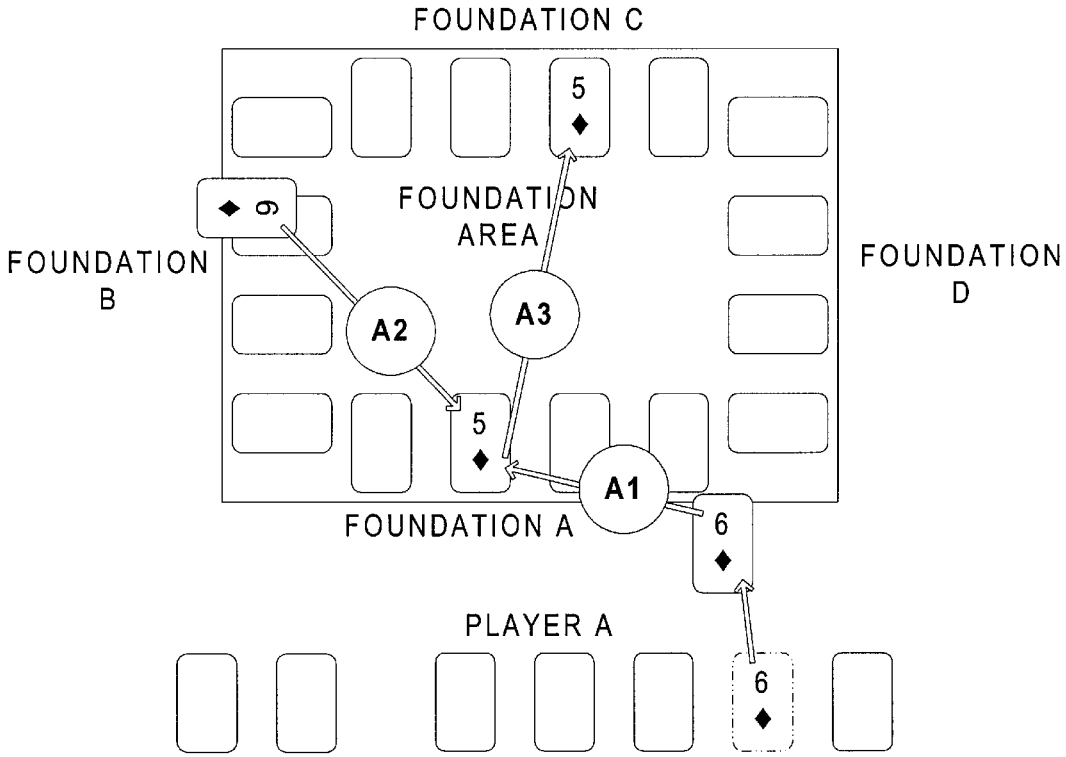

FIG. 61 illustrates Player A makes his foundation card play with the 6 of diamonds. To do so, player A drags the card to the foundation area then releases the mouse button. Player A's client software will then animate the movement of his card play to the nearest legal foundation pile, which happens to be on foundation A, then sends a signal to the server saying, player A made a card play to an identified foundation pile. The 6 of diamonds is ghosted on the origination point because the card play is subject to rejection. On foundation A the 6 of diamonds will appear in full color because the only reason this card play can be rejected would be that the server has already accepted an identical foundation card play to this foundation pile from another player;

FIG. 62 illustrates client A software then receives notice that the server has accepted a 6 of diamonds foundation play to foundation A from player B. Client A then animates the card play movement from player B's position to Foundation A;

FIG. 63 illustrates client A software receives notice that the server has accepted his 6 of diamonds foundation play to foundation C. Client A software had originally placed player A's 6 of diamonds on foundation A. Client A software will animate the card movement of player A's 6 of diamonds from foundation A to foundation C. Meanwhile, player B's 6 of diamonds remains on foundation A. Because the foundation play was accepted, client A software will remove the ghosted 6 of diamonds from its origination point;

FIG. 64 illustrates a summary of the events depicted in FIGS. 61 through 63. Player A makes his foundation card play with the 6 of diamonds. To do so, player A drags the card to the foundation area then releases the mouse button.

Figure 65:
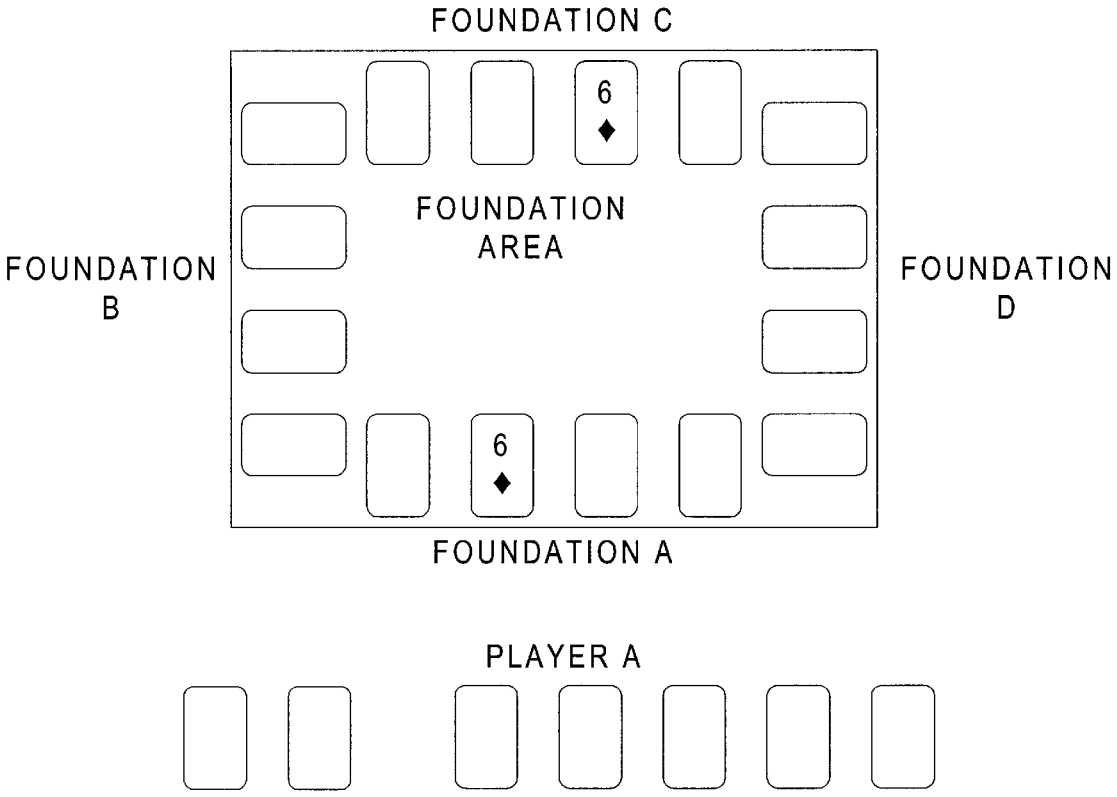

Player A's client software will then animate the movement of his card play to the nearest legal foundation pile, which happens to be on foundation A (shown as step A1), client A then sends a signal to the server saying, player A made a card play to an identified foundation pile. The 6 of diamonds is ghosted on the origination point because the card play is subject to rejection. On foundation A the 6 of diamonds will appear in full color because the only reason this card play can be rejected would be that the server has already accepted an identical foundation card play from another player. Client A software then receives notice that the server has accepted a 6 of diamonds foundation play to foundation A from player B, client A then animates the card play movement from player B's position to foundation A (shown as step A2). Client A software then receives notice that the server has accepted his 6 of diamonds foundation play to foundation C. Client A software had originally placed player A's 6 of diamonds on foundation A. Client A software will animate the card movement of player A's 6 of diamonds from foundation A to foundation C (shown as step A3). Meanwhile, player B's 6 of diamonds remains on foundation A. Because player A's foundation card play was accepted, client A software will also remove the ghosted 6 of diamonds from its origination point;

FIG. 65 illustrates the result of the actions depicted in FIGS. 61 through 64 from player A's perspective. Player B's 6 of diamonds was played on foundation A, player A's 6 of diamonds was played on foundation C, player A's ghosting was removed because of an acceptance of his card play to a foundation pile;

FIGS. 66 through 70 inclusive will illustrate from player B's perspective what must occur in a networked or online environment to emulate the real world occurrence illustrated in FIG. 55.

Figure 66:
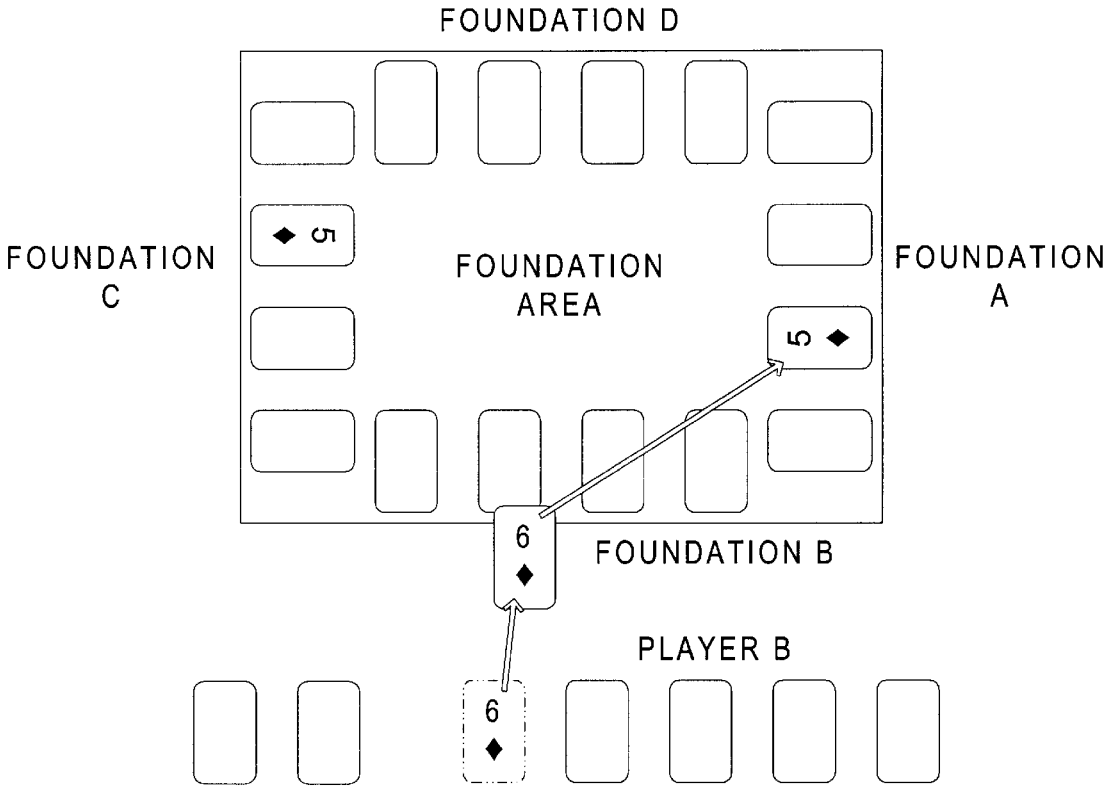
Figure 67:
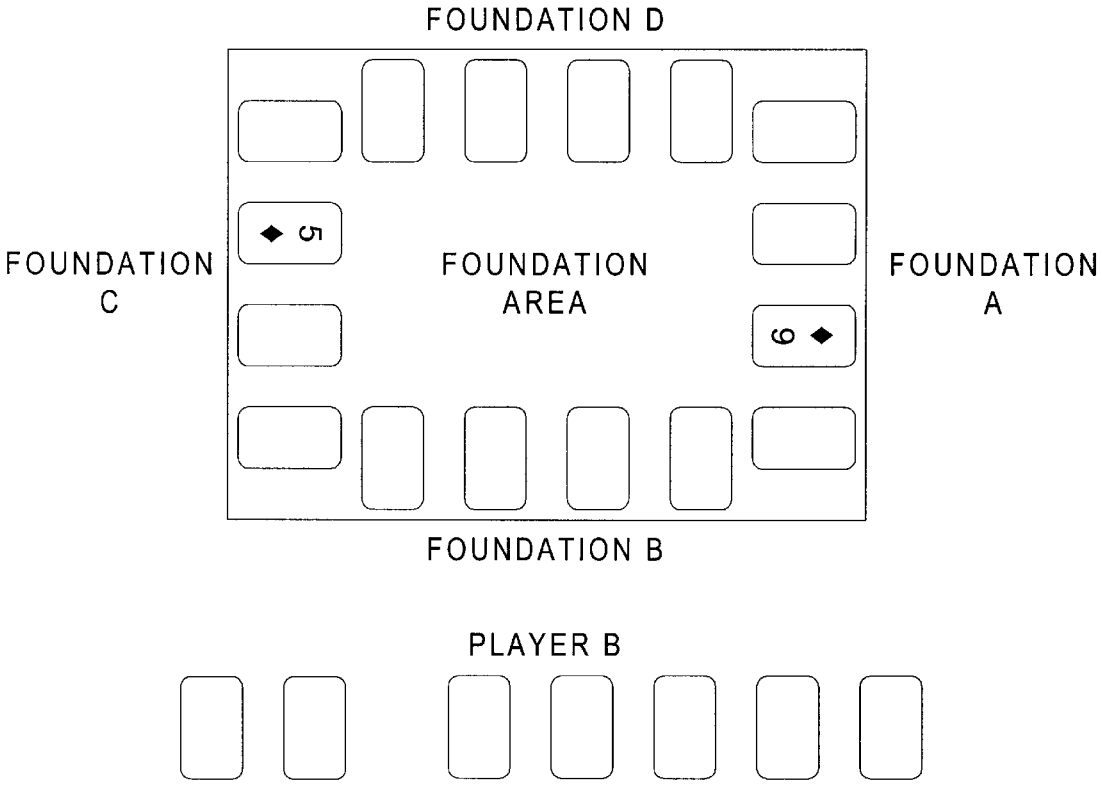
Figure 68:
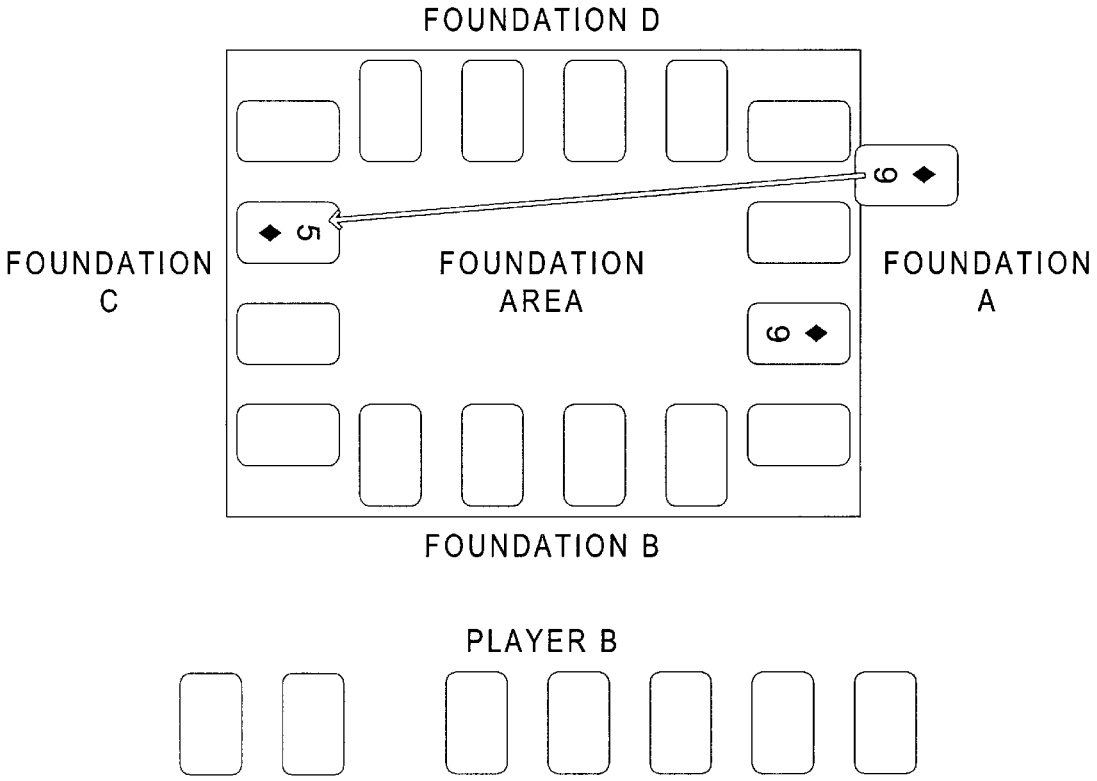
Figure 69:
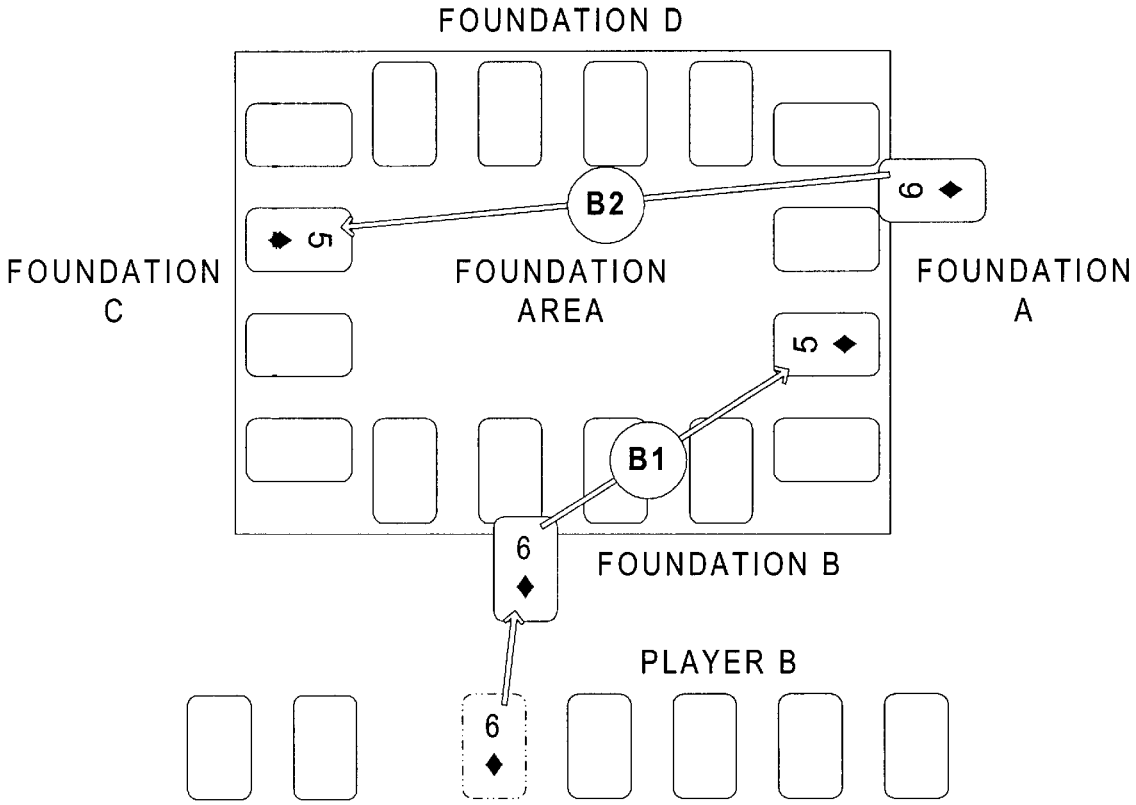
Figure 70:
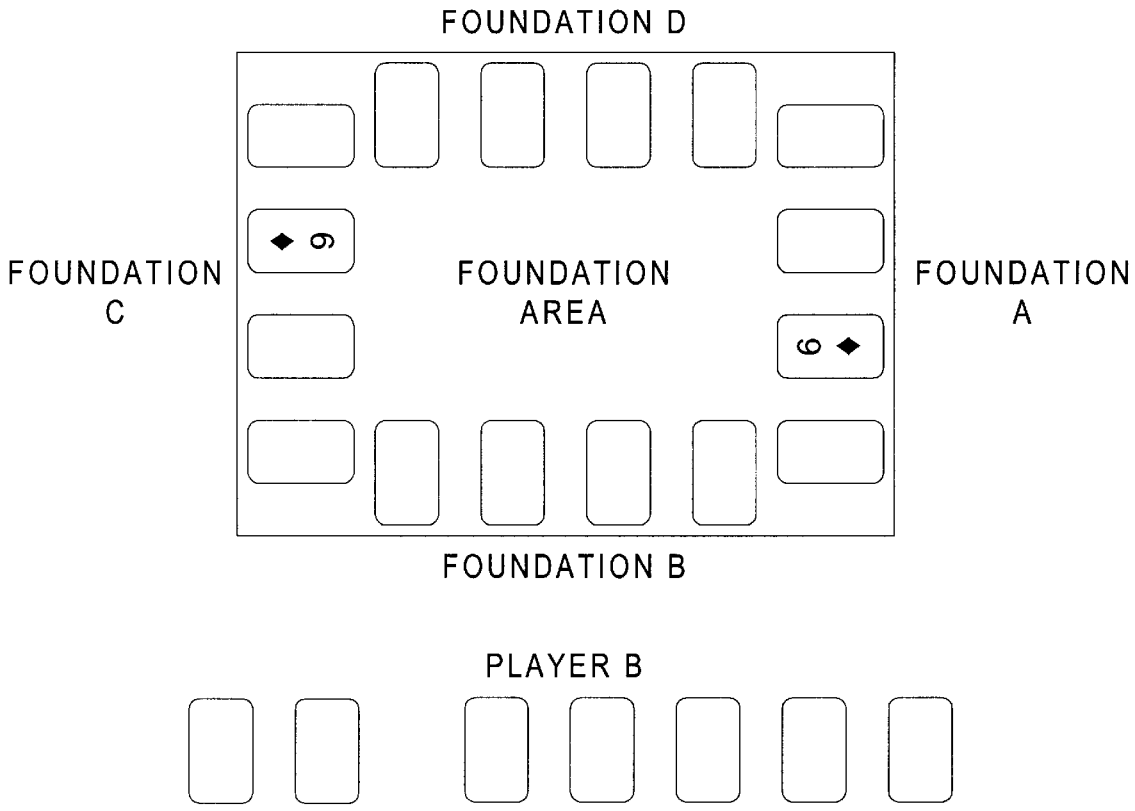

FIG. 66 illustrates Player B makes his foundation card play with the 6 of diamonds. To do so, player B drags the card to the foundation area then releases the mouse button. Player B's client software will then animate the movement of his card play to the nearest legal foundation pile, which happens to be on foundation A. Client B software immediately sends a signal to the server saying, player B made a card play to an identified foundation pile. The 6 of diamonds is ghosted on the origination point because the card play is subject to rejection. On foundation A the 6 of diamonds will appear in full color because the only reason this card play can be rejected would be that the server has already accepted an identical foundation card play from another player;

FIG. 67 illustrates client B software receives notice that the server has accepted his 6 of diamonds foundation play to foundation A. At this point client B software will remove the ghosted 6 of diamonds from its origination point;

FIG. 68 illustrates client B software receives notice that the server has accepted a 6 of diamonds foundation play from player A to foundation C. Client B software will animate the card movement of player A's 6 of diamonds directly to foundation C;

FIG. 69 illustrates a summary of the events depicted in FIGS. 66 through 68. Player B makes his foundation card play with the 6 of diamonds. To do so, player B drags the card to the foundation area then releases the mouse button. Player B's client software will then animate the movement of his card play to the nearest legal foundation pile, which happens to be on foundation A (shown as step B1). Client B software immediately sends a signal to the server saying, player B made a card play to an identified foundation pile. The 6 of diamonds is ghosted on the origination point because the card play is subject to rejection. On foundation A the 6 of diamonds will appear in full color because the only reason this card play can be rejected would be that the server has already accepted an identical foundation card play from another player. Client B software receives notice that the server has accepted his 6 of diamonds foundation play to foundation A. At this point client B software will also remove the ghosted 6 of diamonds from its origination point. Client B software receives notice that the server has accepted a 6 of diamonds foundation play from player A to foundation C. Client B software will animate the card movement of player A's 6 of diamonds directly to foundation C (shown as step B2);

FIG. 70 illustrates the result of the actions depicted in FIGS. 66 through 69. Player B's 6 of diamonds was played on foundation A, player A's 6 of diamonds was played on foundation C, player B's ghosting was removed because of an acceptance of his card play to a foundation pile;

FIGS. 71 through 76 inclusive will illustrate from the player D's perspective what must occur in a networked or online environment to emulate the real world occurrence illustrated in FIG. 55.

Figure 71:
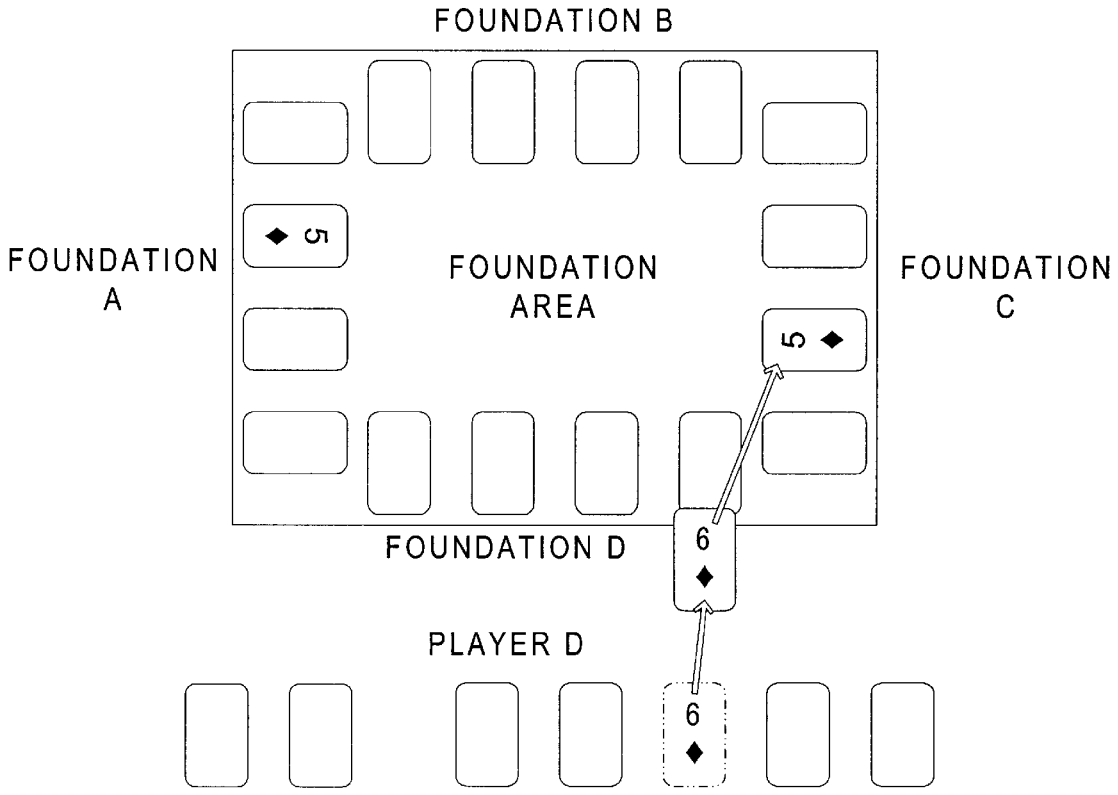
Figure 72:
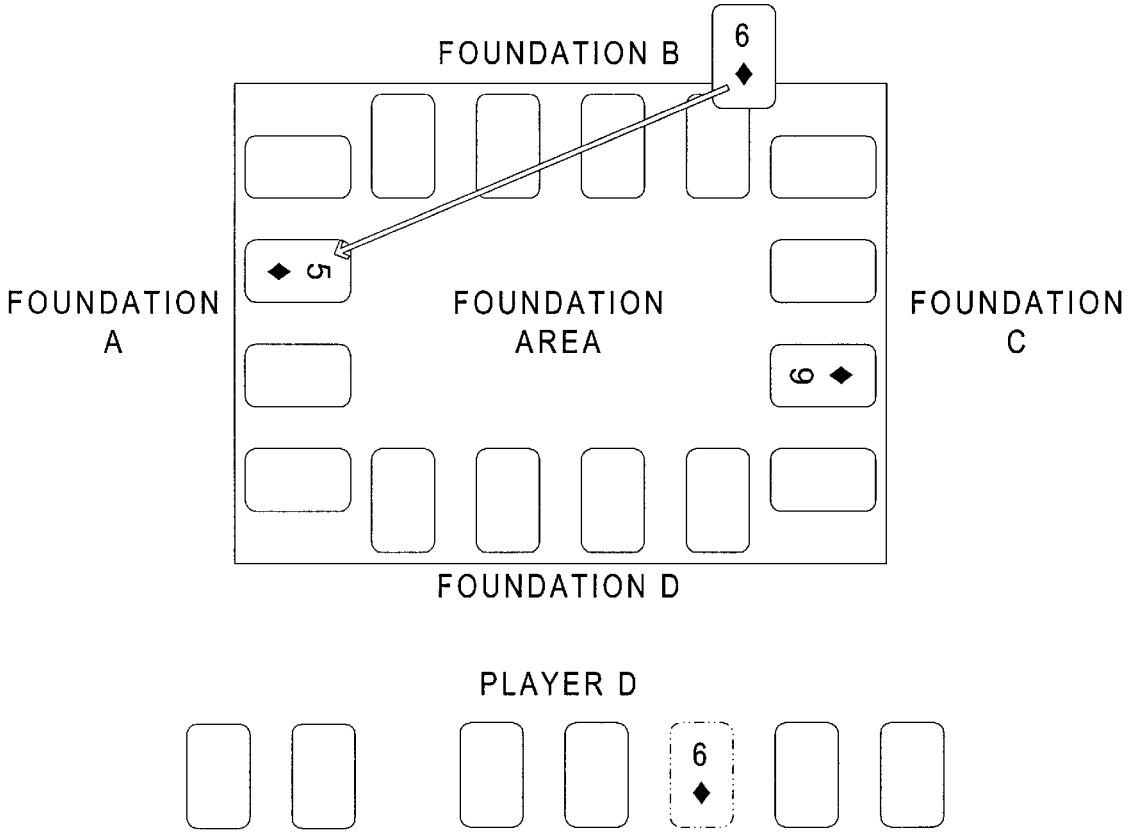
Figure 73:
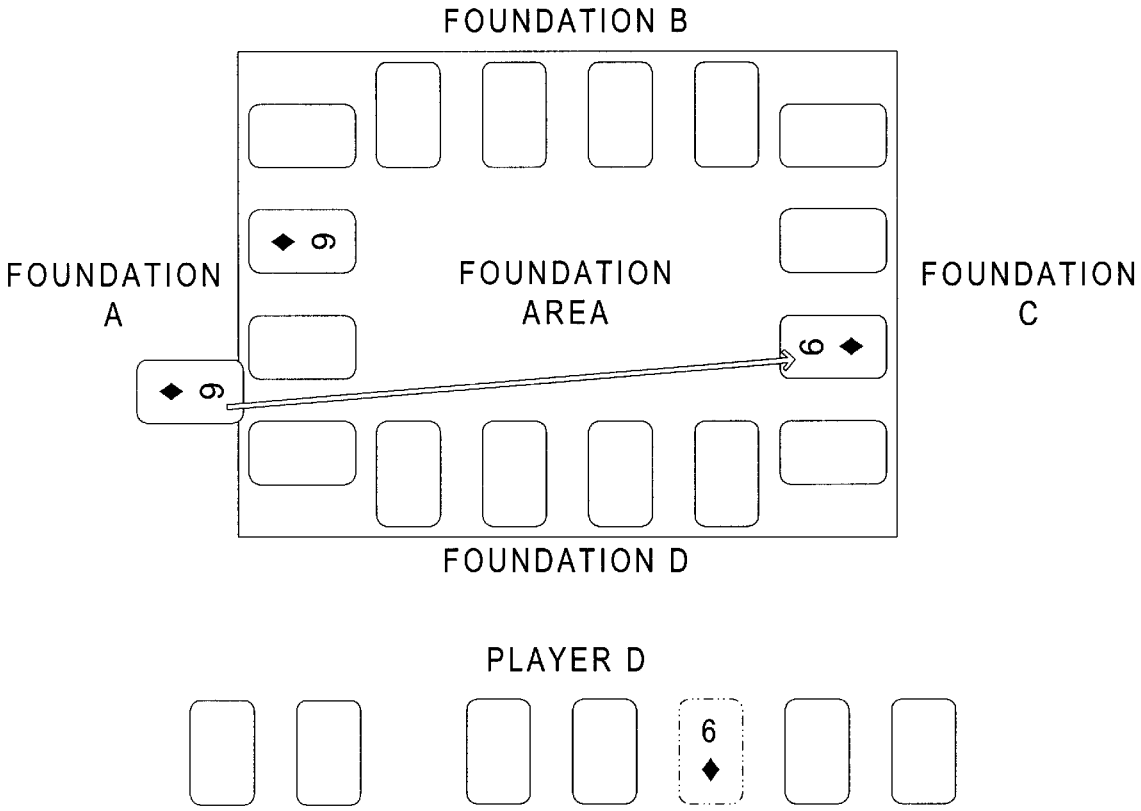
Figure 74:
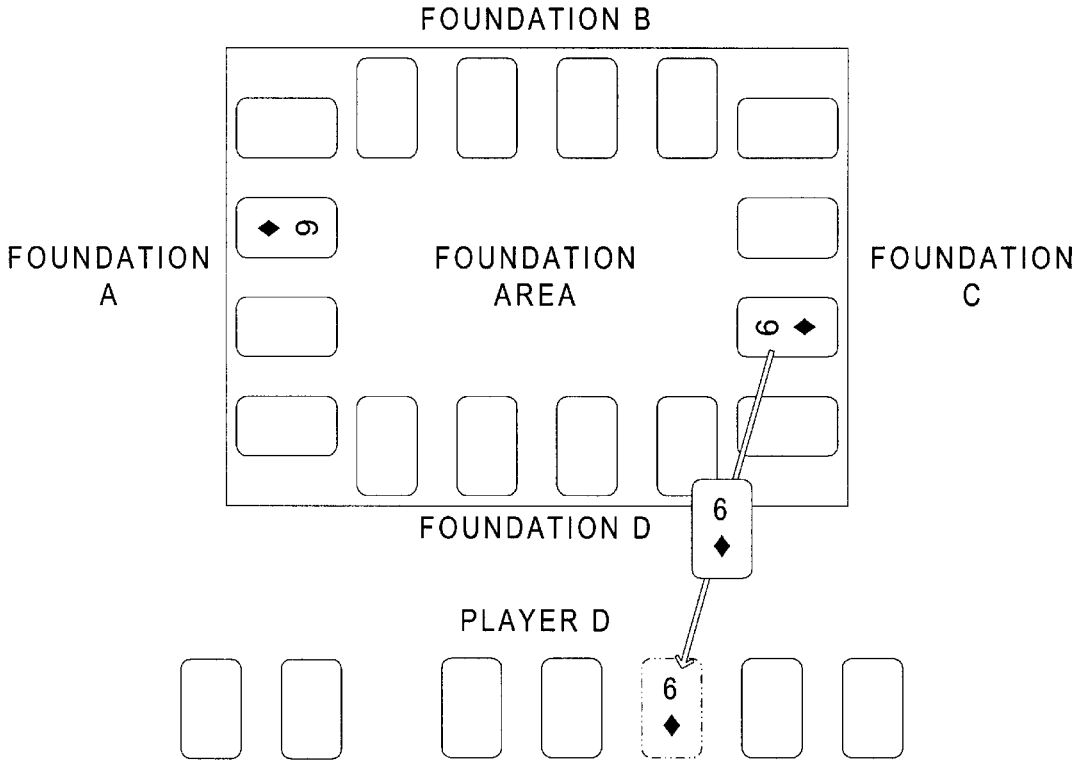
Figure 75:
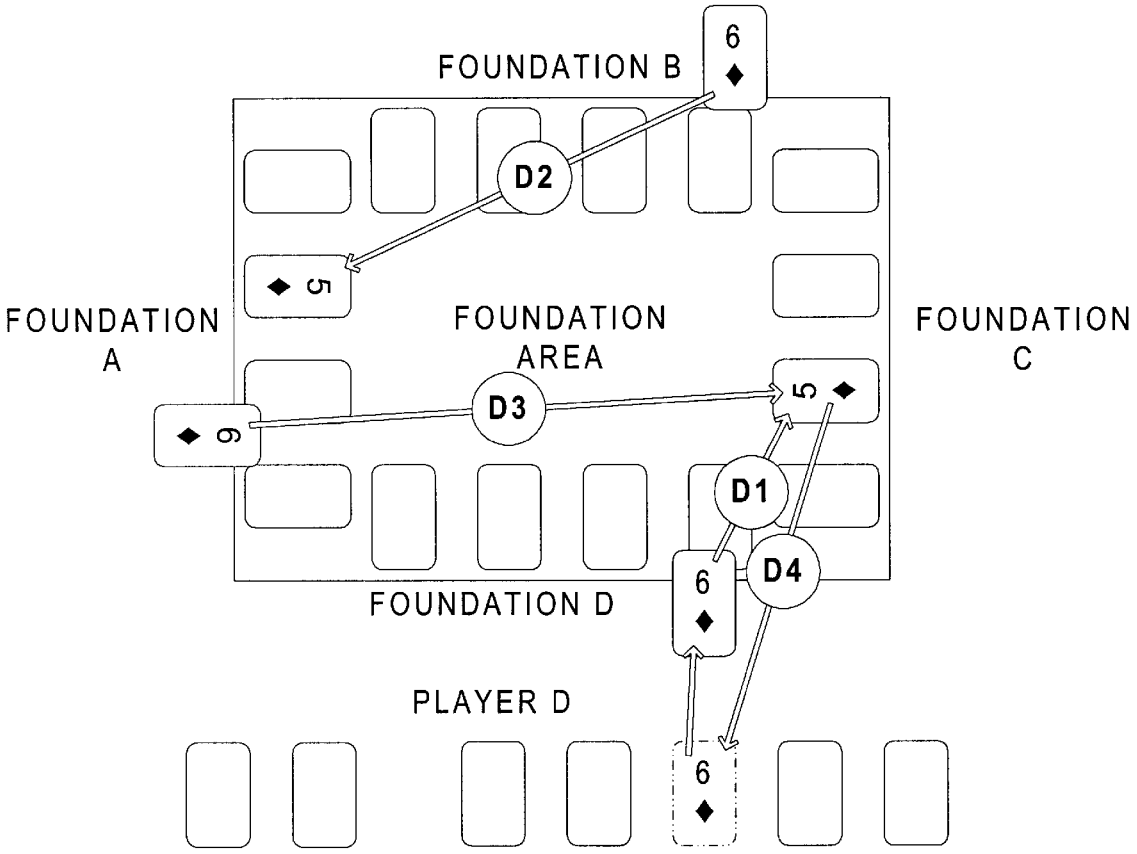
Figure 76:
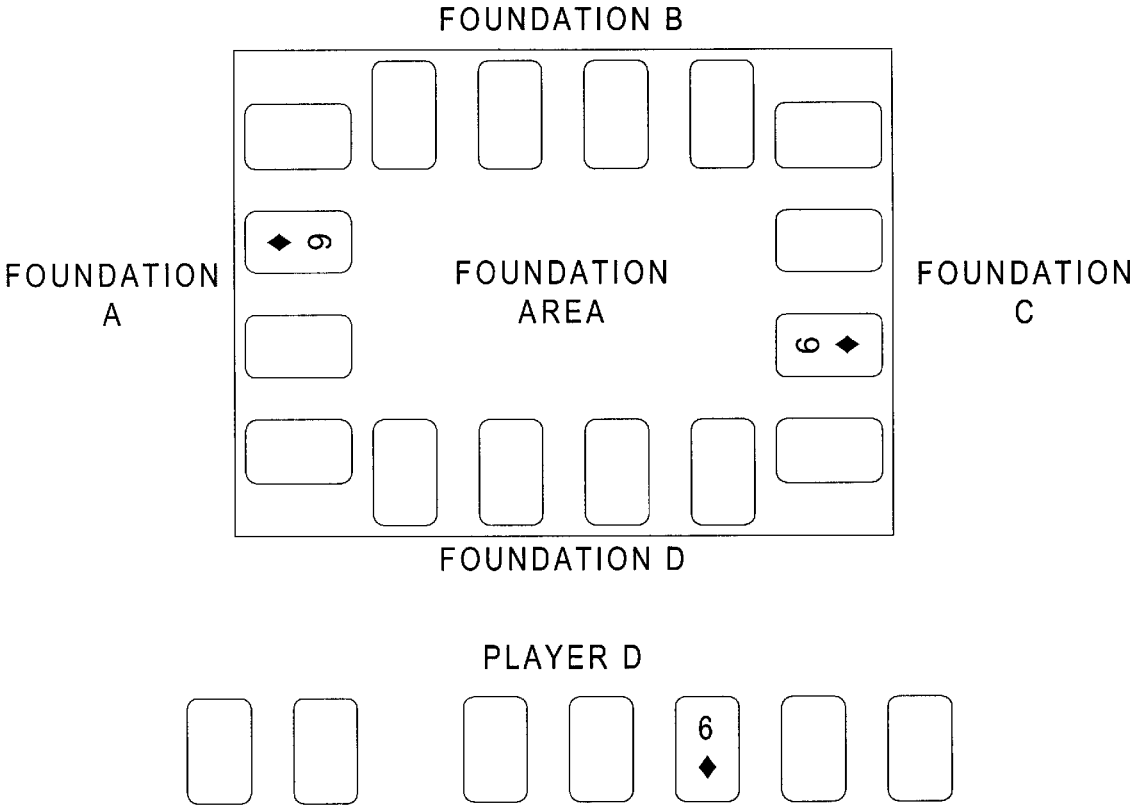
Figure 77:
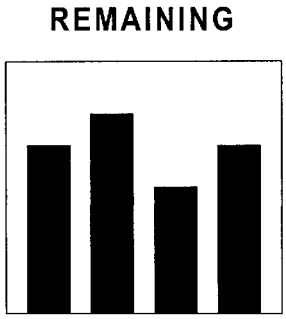
Figure 78:
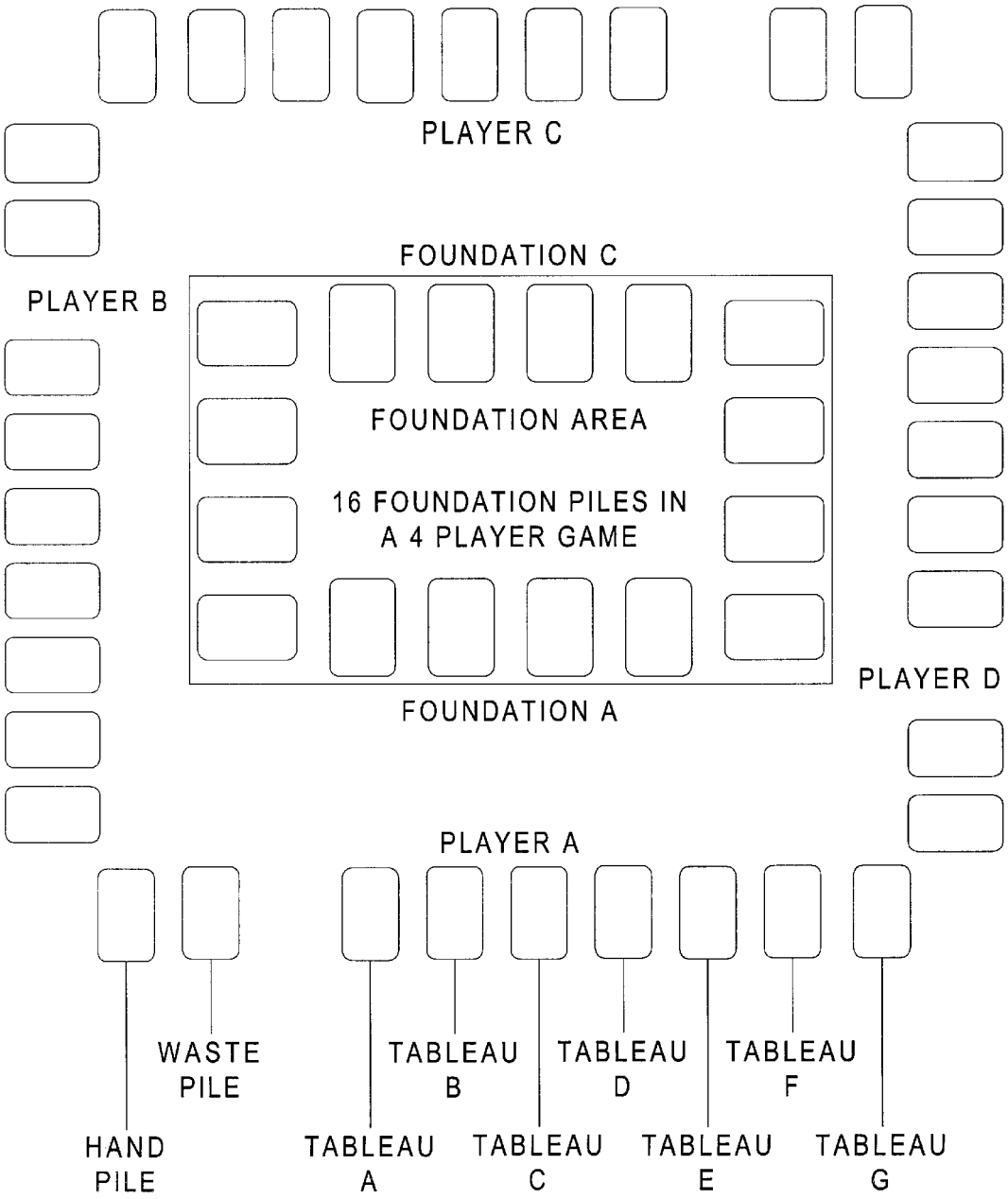
Figure 79:
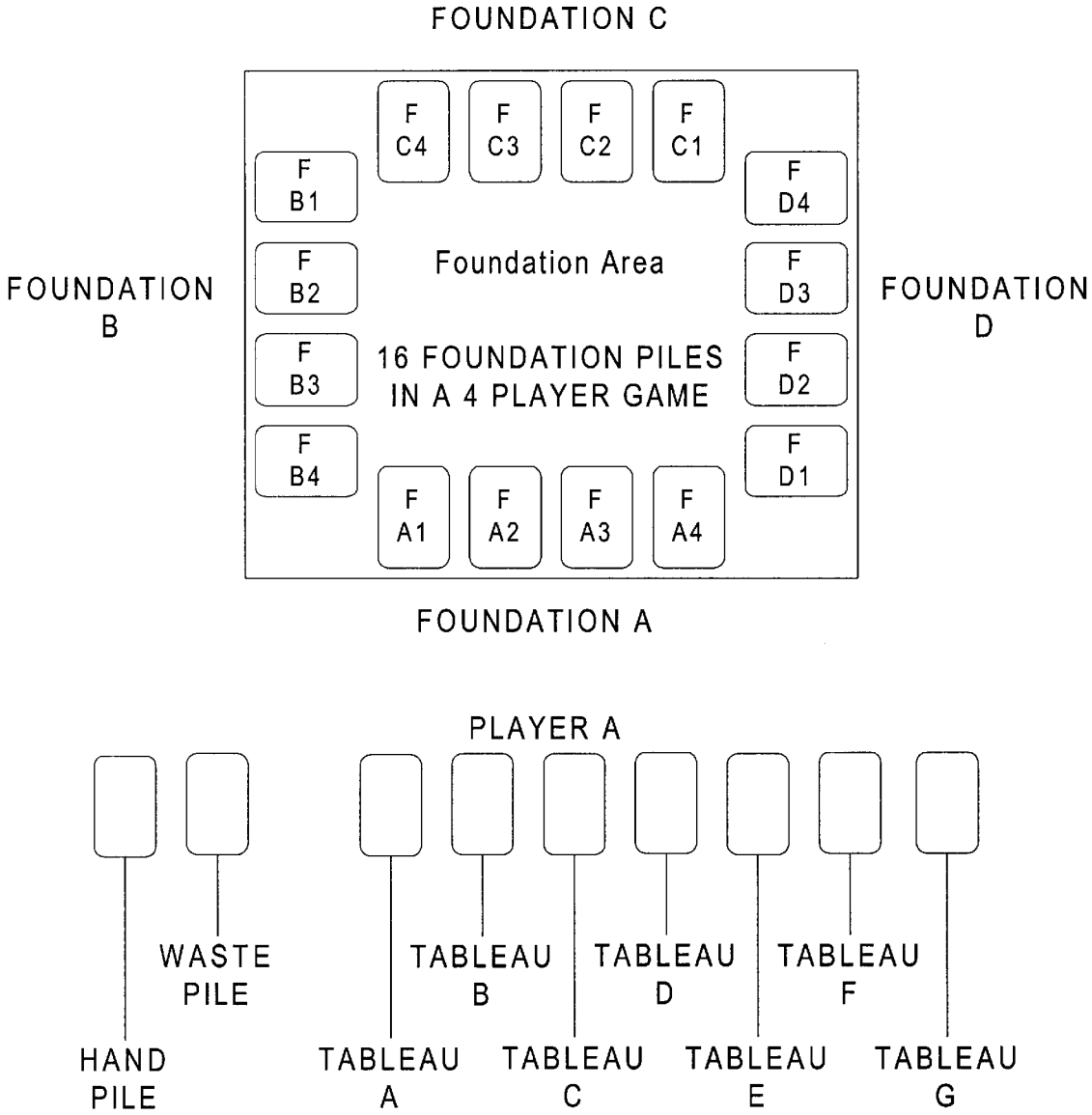
Figure 80:
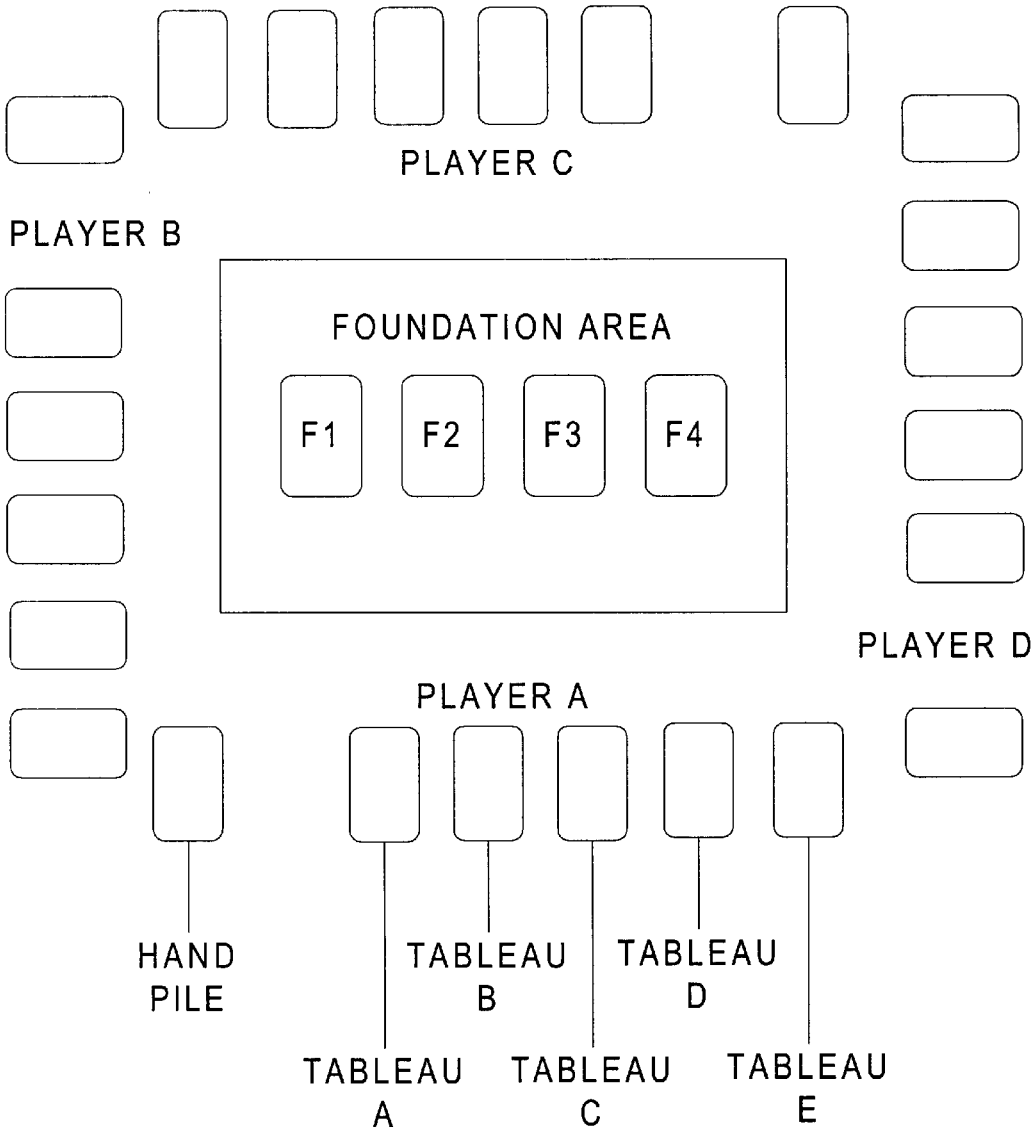
Figure 81:
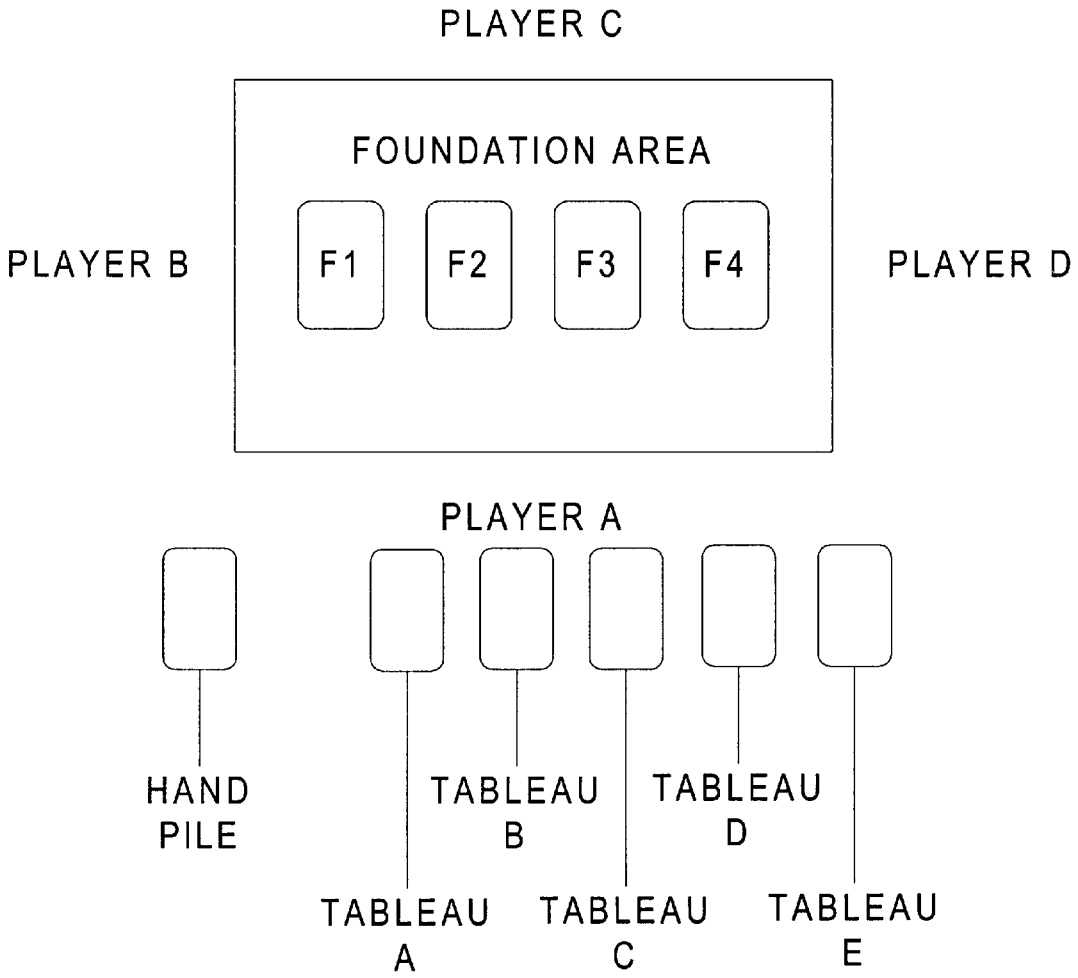
Figure 82:
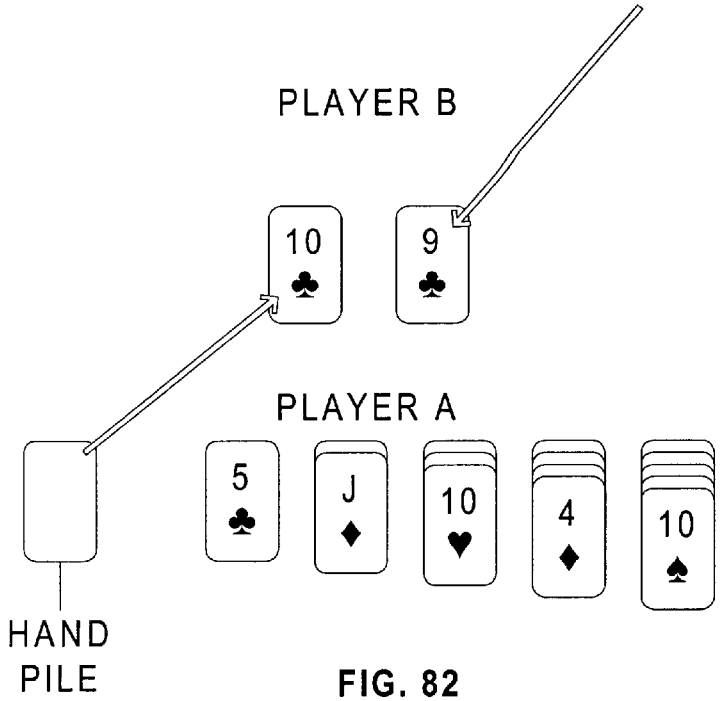
Figure 83:
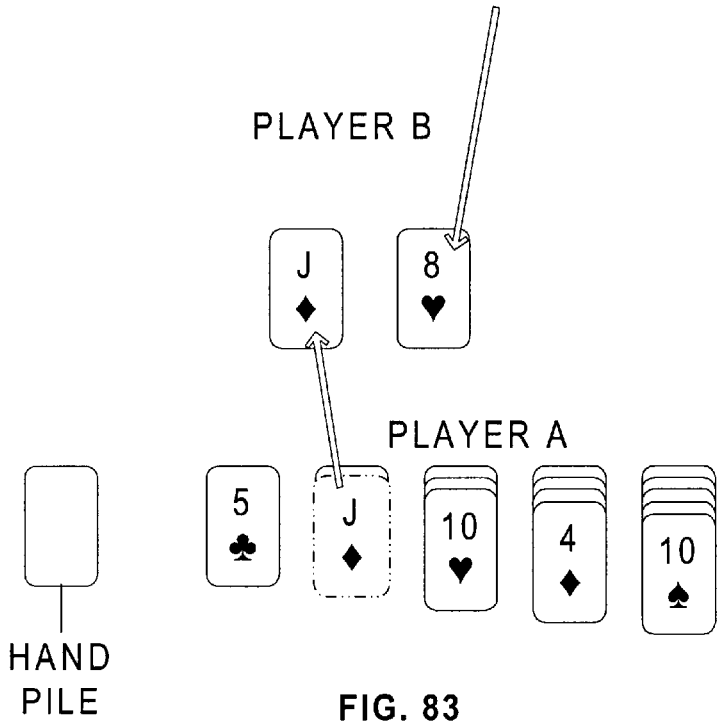
Figure 84:
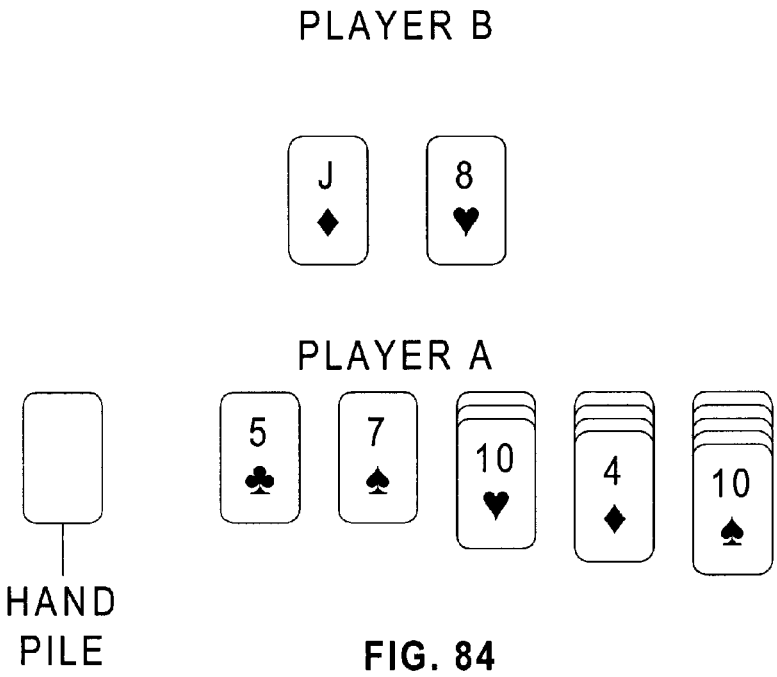
Figure 85:
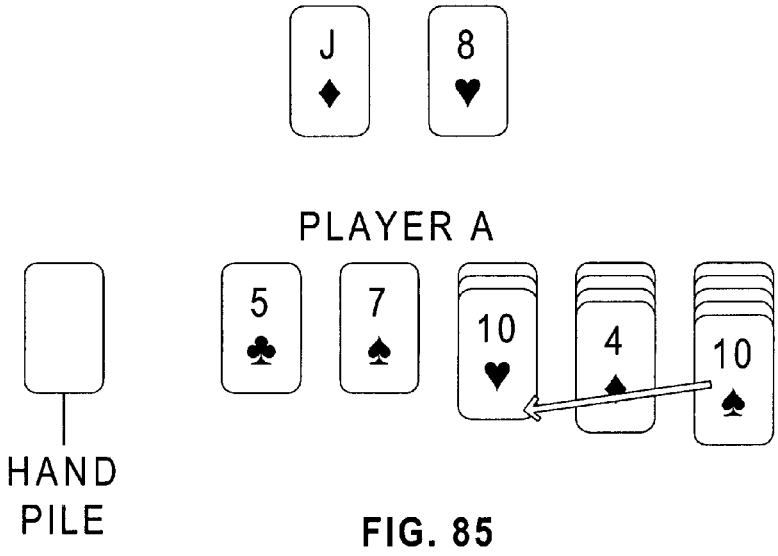
Figure 86:
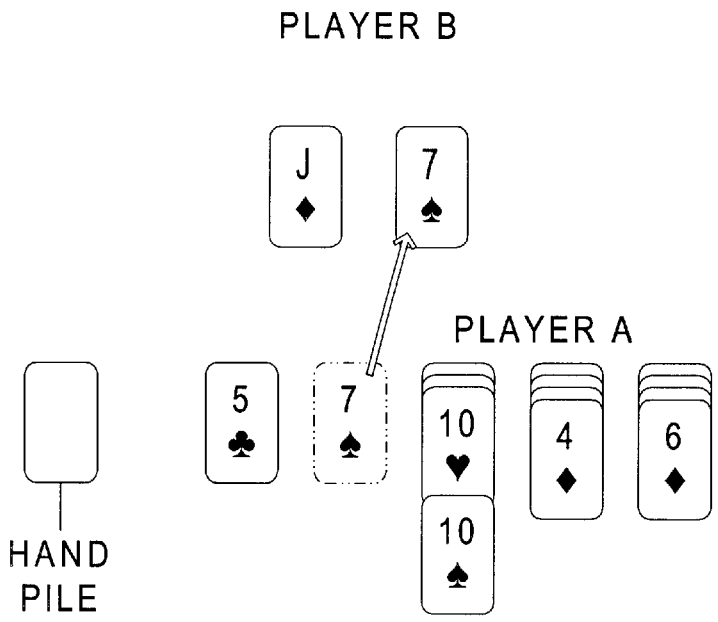
Figure 87:
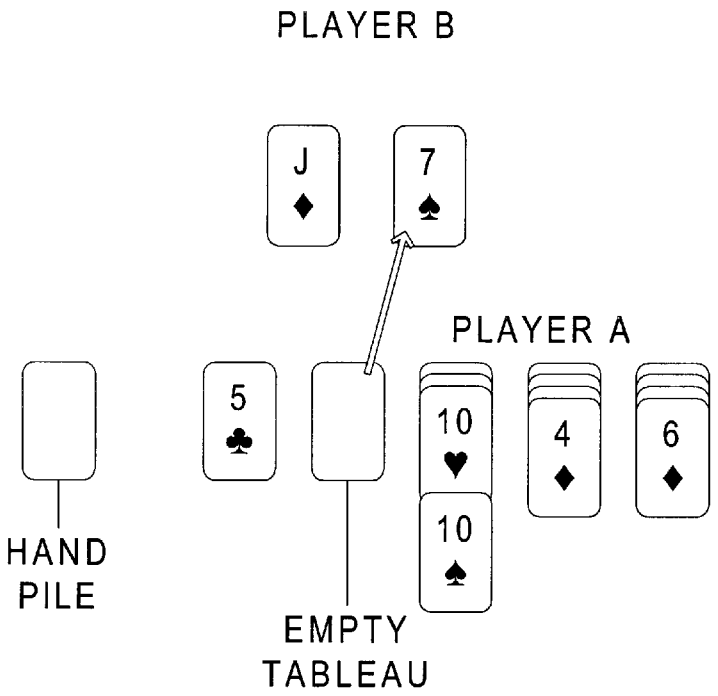

FIG. 71 illustrates Player D makes his foundation card play with the 6 of diamonds. To do so, player D drags the card to the foundation area then releases the mouse button. Player D's client software will then animate the movement of his card play to the nearest legal foundation pile, which happens to be on foundation C. Client D software immediately sends a signal to the server saying, player D made a card play to an identified foundation pile. The 6 of diamonds is ghosted on the origination point because the card play is subject to rejection. On foundation C the 6 of diamonds will appear in full color because the only reason this card play can be rejected would be that the server has already accepted an identical foundation card play from another player;

FIG. 72 illustrates client D software receives notice that the server has accepted player B's 6 of diamonds foundation card play to foundation A. Client D software will animate the card movement of player B's 6 of diamonds to foundation A;

FIG. 73 illustrates client D software receives notice that the server has accepted player A's 6 of diamonds foundation play to foundation C. Client D software will animate the card movement of player A's 6 of diamonds directly to foundation C;

FIG. 74 illustrates client D software receives notice that the server has rejected its 6 of diamonds foundation play to foundation C. Client D software will animate the card movement of player D's 6 of diamonds from foundation C to its origination point, at which point the ghosting will disappear. Player A's 6 of diamonds remains played on foundation C;

FIG. 75 illustrates a summary of the events depicted in FIGS. 71 through 74. Player D makes his foundation card play with the 6 of diamonds. To do so, player D drags the card to the foundation area then releases the mouse button. Player D's client software will then animate the movement of his card play to the nearest legal foundation pile, which happens to be on foundation C (shown as step D1). Client D software immediately sends a signal to the server saying, player D made a card play to an identified foundation pile. The 6 of diamonds is ghosted on the origination point because the card play is subject to rejection. On foundation C the 6 of diamonds will appear in full color because the only reason this card play can be rejected would be that the server has already accepted an identical foundation card play from another player. Client D software receives notice that the server has accepted player B's 6 of diamonds foundation play to foundation A. Client D software will animate the card movement of player B's 6 of diamonds to foundation A (shown as step D2). Client D software receives notice that the server has accepted player A's 6 of diamonds foundation play to foundation C. Client D software will animate the card movement of player A's 6 of diamonds to foundation C (shown as step D3). Client D software receives notice that the server has rejected his 6 of diamonds foundation play to foundation C. Client D software will animate the card movement of player D's 6 of diamonds from foundation C to its origination point (shown as step D4), at which point the ghosting will disappear;

FIG. 76 illustrates the result of the actions depicted in FIGS. 71 through 75. Player B's 6 of diamonds was played on foundation A, player A's 6 of diamonds was played on foundation C, player D's 6 of diamonds was returned to its origination point, player D's ghosting was removed because the server rejected his card play to a foundation pile causing the return of that card play;

FIG. 77 illustrates a graphic that is displayed on all client screens. The graphic represents the number of cards remaining in each player's middle stack. This gives all players a relative idea of how far each player is from ending the game;

FIG. 78 illustrates a real world (non-computer) environment layout for "Multiple Klondike", a second form of multiplayer solitaire-related games that is derived from the most popular form of solitaire, Klondike, but played with multiple players. In a real world environment, all player layouts and cards can be seen as well as all player card plays and movements. All players may make card plays to the same established foundation piles. In Multiple Klondike, the first player to successfully play all of his cards to the foundation piles wins the game;

FIG. 79 illustrates a computer screen layout of a Multiple Solitaire game to be played in a networked or online environment. Each player only sees his own cards and all foundation piles. Such multiple player solitaire-related games played in the online environment would experience the same graphical display limitations, timing latency and contention problems that will be solved in a networked or online environment using the techniques outlined for Zip solitaire;

FIG. 80 illustrates a real world (non-computer) environment layout for "Spit", a third form of multiplayer solitaire-related games. In a real world environment, all player layouts and cards can be seen as well as all player card plays and movements. All players may make card plays to the same established foundation piles. The first player to play all of his cards to the foundation piles wins the game;

FIG. 81 illustrates a computer screen layout of a Spit game to be played in a networked or online environment. Each player only sees his own cards and all foundation piles. Such multiple player solitaire-related games played in the online environment would experience the same graphical display limitations, timing latency and contention problems that will be solved in a networked or online environment using the techniques outlined for Zip solitaire;

FIG. 82 illustrates each player "spits", turns one card from the hand face up to the foundation piles to start the round. The number of foundation piles equals the number of players;

FIG. 83 illustrates players quickly play to either foundation pile. With each play to a foundation, the originating card position is ghosted (blocked) to indicate that the card or position underlying that card can not be played nor played upon until acceptance or rejection of that card play is received from the server;

FIG. 84 illustrates acceptance of the card play to a foundation pile depicted in FIG. 83. The ghosted card disappears. If the card beneath the previously ghosted card is lying face down, it is turned face up;

FIG. 85 illustrates a play from one tableau to another, the card beneath the moved tableau card will be turned face up;

FIG. 86 illustrates a card play to a foundation pile, the originating position is ghosted until acceptance or rejection of the foundation card play;

FIG. 87 illustrates an empty tableau pile which resulted in acceptance of the foundation card play depicted in FIG. 86. The empty tableau pile position can be filled with all face up cards from any other single tableau pile. In this case, the empty tableau position can be filled with the pile of 10's, the 4 or 6. The empty tableau may not be filled with a single 10. Such movement of face up tableau piles allows a player to turn up other face down tableau cards lying under the recently moved pile or card.

DETAILED DESCRIPTION

Figure 1:
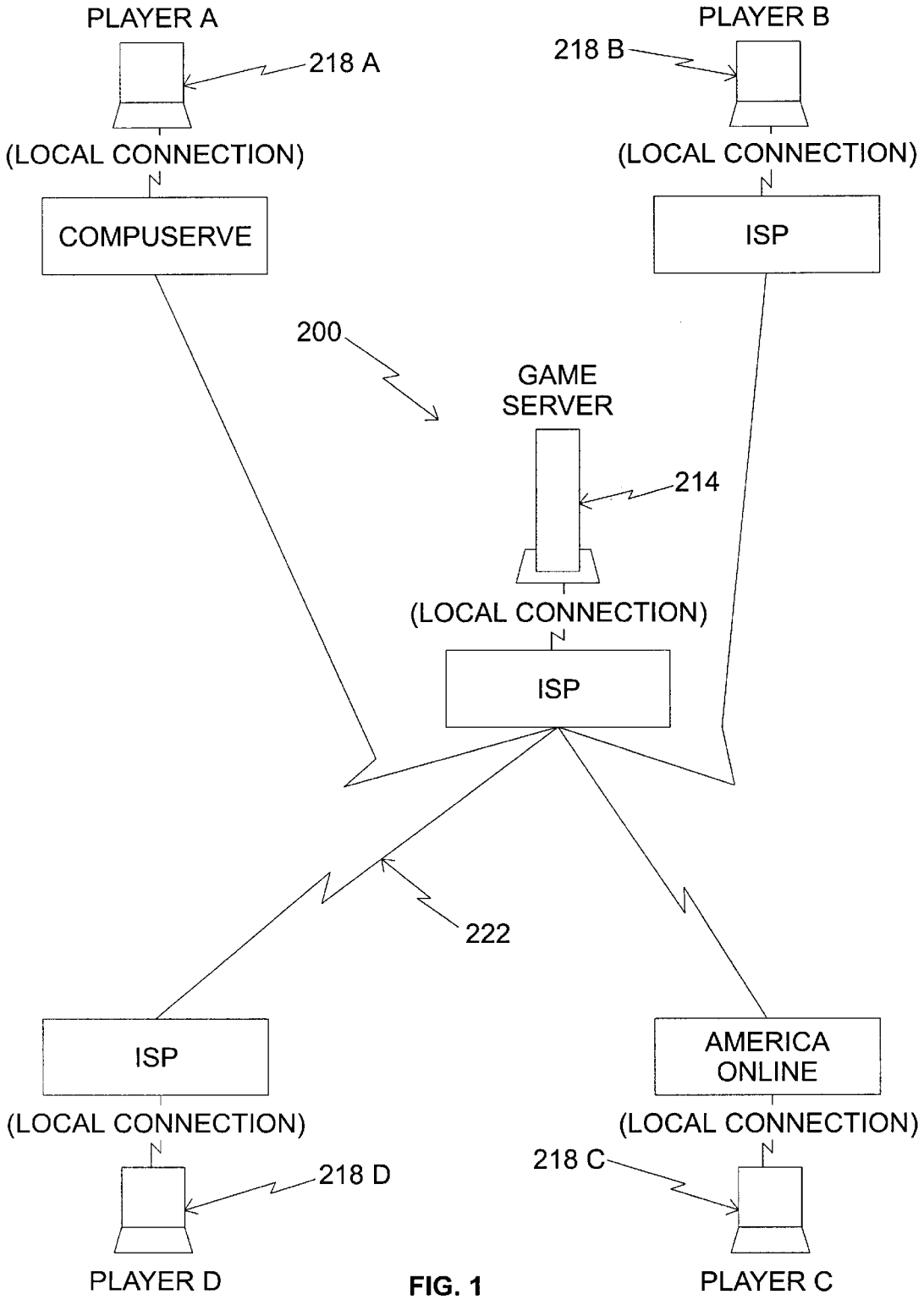
FIG. 1 is a block diagram of the present invention that illustrates the interconnectivity among the clients and the game server using a communications network.

With reference to FIG. 1, a system 200 is provided for playing multiplayer solitaire-related card games online. System 200 includes a game server 214 having overall control associated with playing the multiplayer card game. A number of clients 218 are electrically connected to the game server 214 using a communications network 222. The communications network 222 can include a number of communication sub-systems or apparatuses. In one embodiment, the communications network 222 includes the Internet. Each client 218*a*, 218*b*, . . . 218*n* is able to electronically communicate with the Internet using an Internet service provider (ISP) or through an online service provider, such as America Online (AOL) or CompuServe. Access to such service providers is achieved through a local telephone or other communications connection from each client 218. The clients 218*a*, 218*b*, . . . 218*n* typically include common hardware and software, for example personal computers (PCs). Each client 218 includes a processor for processing and handling certain operations associated with card playing. An input device, such as a mouse, enables the player to initiate the player's own card movements. A computer display screen depicts the card game including the layouts of the cards, as well as animation of the cards when card plays are initiated by the players. Such card playing will be described in greater detail herein in conjunction with a number of examples related to playing the multiplayer solitaire-related card games. The game server 214, like the clients 218 also communicates with the Internet through a local connection and a service provider to the Internet. Each of the clients 218 has an address associated with it that the game server 214 uses in connection with communication transfers. Likewise, the game server 214 has an address that enables desired communications to reach it from the clients 218 in the context of initiating and playing the card game. The game server 214 also includes hardware and software. The game server 214 typically is a multi-processing unit capable to handling a substantial number of clients in the context of one or more card games being simultaneously played. The server software is different from client software. Although it is technically feasible to designate one of the clients 218 to run the server software, in addition to its client software and thereby fulfill the role of the game server 214, such a choice is not practical. For example, if the responsible client 218 should log off, or exit the network environment, the card game would thereby be discontinued for the other players. In connection with playing the online card game, each client 218 has identical software and such software is typically obtained by downloading the software from the game server 214.

With respect to initiating playing of a multiplayer game involving foundations, in one embodiment, the players first congregate in a game lobby. To do so, the players negotiate their way to the game server 214 by inputting the address of the game server 214. Internet-based protocol TCP/IP (transmission control protocol/Internet protocol) automatically provides them access to the game server 214. Once in communication with the game server 214, players access the game lobby by inputting appropriate access information, such as using the mouse to click on icons or using a keyboard to type in key words. The game lobby typically has a number of players that wish to play the multiplayer card game. Once in the game lobby, individual players can access a newly forming multiplayer card game. Alternatively, players may form or join a group in order to setup a multiplayer card game together. Players input information in the game lobby in order to select a game. In such a case, the game server 214 automatically selects a newly forming game or starts a new game. The game server 214 also sends a packet to each client 218 instructing them to start the client software associated with the multiplayer card game.

Information in any networked environment, particularly on the Internet is not instantaneously available to users of the network. There are timing delays inherent with every piece of data that travels from one point to another over a network. When a network is heavily used, a significant amount of time can pass before the data reaches its destination point. These delays can be multiple seconds on the Internet. Information that each player has at any given point in a game may not be the same, due to the inherent network timing delays.

At the start of play, the game server 214 transmits one data packet to each client 218. Each of the initial data packets contain a full deck of uniquely prepared or shuffled cards. Each of the clients 218 deals its card in accordance with the layout as prescribed in the rules of the particular multiplayer card game. Since the game server 214 establishes the ordering of the card deck and the layout rules, it also monitors the card game layout on each client 218. A short period of time later, the game server 214 sends a start signal to each client 218. Each of the clients 218 that receive the start signal store the time of receipt thereof, and immediately players are able to play the card game on such clients 218.

As more fully explained in the discussion of the rules and examples of card game plays set out further herein, the interaction among the game server 214 and the clients 218 involved in playing a particular card game are different depending upon whether or not the card play is to the foundations that are common to all players or a card play that is not to the foundations. In the case in which card play is not to the foundations, such as hand, waist, middle stack and tableau card plays in multiplayer solitaire, no immediate reporting to the game server 214 by the particular client 218 is required. Instead, each of the clients 218 is able to store the hand, waste, middle stack and tableau card plays in a memory buffer for later transmission to the game server 214.

Card plays to the foundations have different game client/server involvement including the game server 214 immediately receiving such card play information. More particularly, when a player initiates a card play to a foundation, the client software verifies, given its currently available information, whether or not the card play was valid. If not valid, the client software is used in animating the return of the card to its origination point. If it were a valid card play, the client software animates the card to the closest valid foundation. The client 218 involved with such a card play then immediately sends a data packet to the game server 214 notifying it of the card play and the delta time. When data packet transmission delays are short, the game server 214, upon receiving such a client packet transmission, queues it in the order it was received and checks the card play's delta time against subsequently received packets during a predetermined amount of time to determine which player acted the quickest. Alternatively, when the transmission delays are long, the game server 214 simply processes the information contained in the data packet in the order that it was received. Upon acceptance of a foundation card play, the game server 214 sends a packet to all clients 218 in order to notify them of the acceptance of the card play and the foundation upon which the card play was accepted. Those clients 218 that did not initiate the foundation card play will animate a card movement from the player's position that made the foundation card play to the foundation that was played upon, thereby providing the remaining players with a visual notice of another player's foundation card play, and time-stamp receipt of each accepted foundation card play.

When the card game is over according to the rules thereof, all players are notified of the score of the card game and of the time that the next game starts. Players are able to leave the game area using an available menu. Once a player leaves a particular card game, the game server software automatically routs the player to the game lobby.

More substantial details of the identification of the multiplayer card games, their rules, together with card layouts and methodology employed in controlling card game plays, are next illustrated and discussed.

Figure 2:
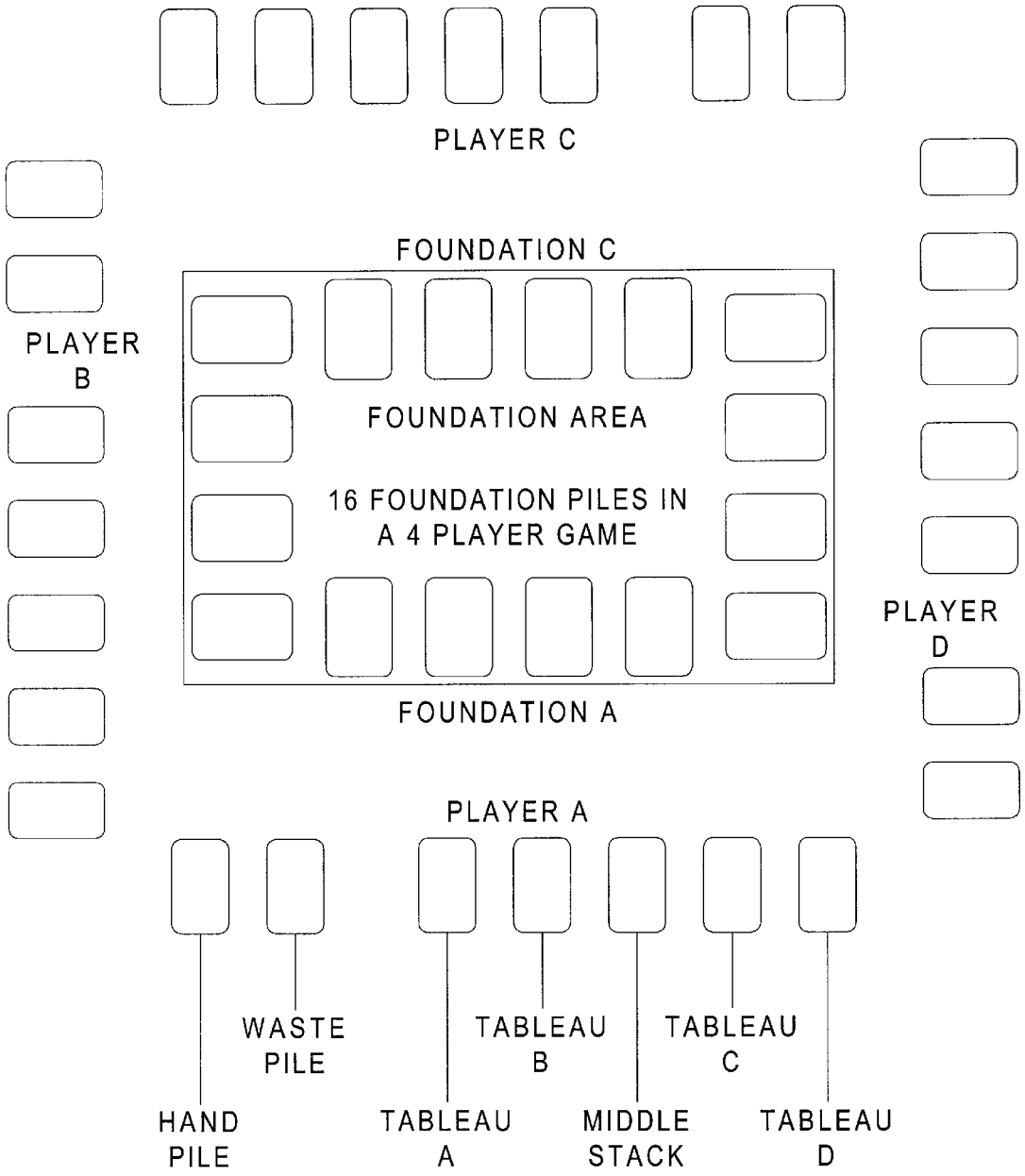
FIG. 2 illustrates a multiplayer card game layout for a first multiplayer solitaire-related card game named "Zip" in a real world (non-computer) environment, all player cards can be seen as well as all player card plays and movements.

A first multiplayer solitaire-related game is identified as "Zip" solitaire. Each player has a unique deck. In a real world (non-computer) game environment, a table or floor area is needed as players are seated with identical card layouts around a central foundation area, as depicted in FIG. 2. There are a number of different card piles. Piles of cards are played for points on the foundations. Initially, there are no cards played on the foundations. All foundations must begin with aces and be built up in rank and suit to kings. Players may play cards on foundations started or played upon by any player. When two players simultaneously attempt to place a card upon the same foundation, the first card that arrives stays, the other player must return his card to its previous location. Foundation cards may be played from a waste pile, a middle stack, or the lowest ranking face up card of any tableau pile. Once a card is played to a foundation pile, it may no longer be moved.

There are a total of four piles of cards in the tableau area, labeled A, B, C and D in FIG. 2. When the cards are dealt out, only one card is dealt face up to each tableau. Cards or stacks of cards may be played on the face up tableau piles, from the waste pile, middle stack or other tableaus, in decrementing rank and alternating color order only. If cards are moved from one tableau to another, all face up cards from the tableau must be moved and the decrementing rank and alternating color ordering must be maintained. When a face-up pile is empty, it may be filled by the topmost card of the middle Stack or from the waste.

When the cards are dealt out, the middle stack consists of twelve (12) cards face down and a 13th card face up on top. When a play is made from the middle stack the underlying, face down card is turned face up on the middle stack. No cards may be played on the middle stack.

The card layout also includes the hand pile. The hand pile is a pile of face down cards that has not been dealt to the other piles. At the outset of the game the hand contains 35 cards (a 52 card deck minus one card to each of 4 tableau piles and 13 cards to the middle stack).

The waste pile is a pile of face up cards that come from the hand three cards at a time. Cards may be moved from the waste pile to any legal tableau or foundation pile.

The object of Zip solitaire is to play as quickly as a player can and exhaust its middle stack. Play ends when any player empties his middle stack. Upon doing so, that player calls, "Zip". All opponents must immediately stop play. Points are counted +1 for each card played to a foundation pile and −2 for each card remaining in the middle stack. Cards are reshuffled and successive rounds are played until one player reaches an agreed upon number of total points.

Figure 3:
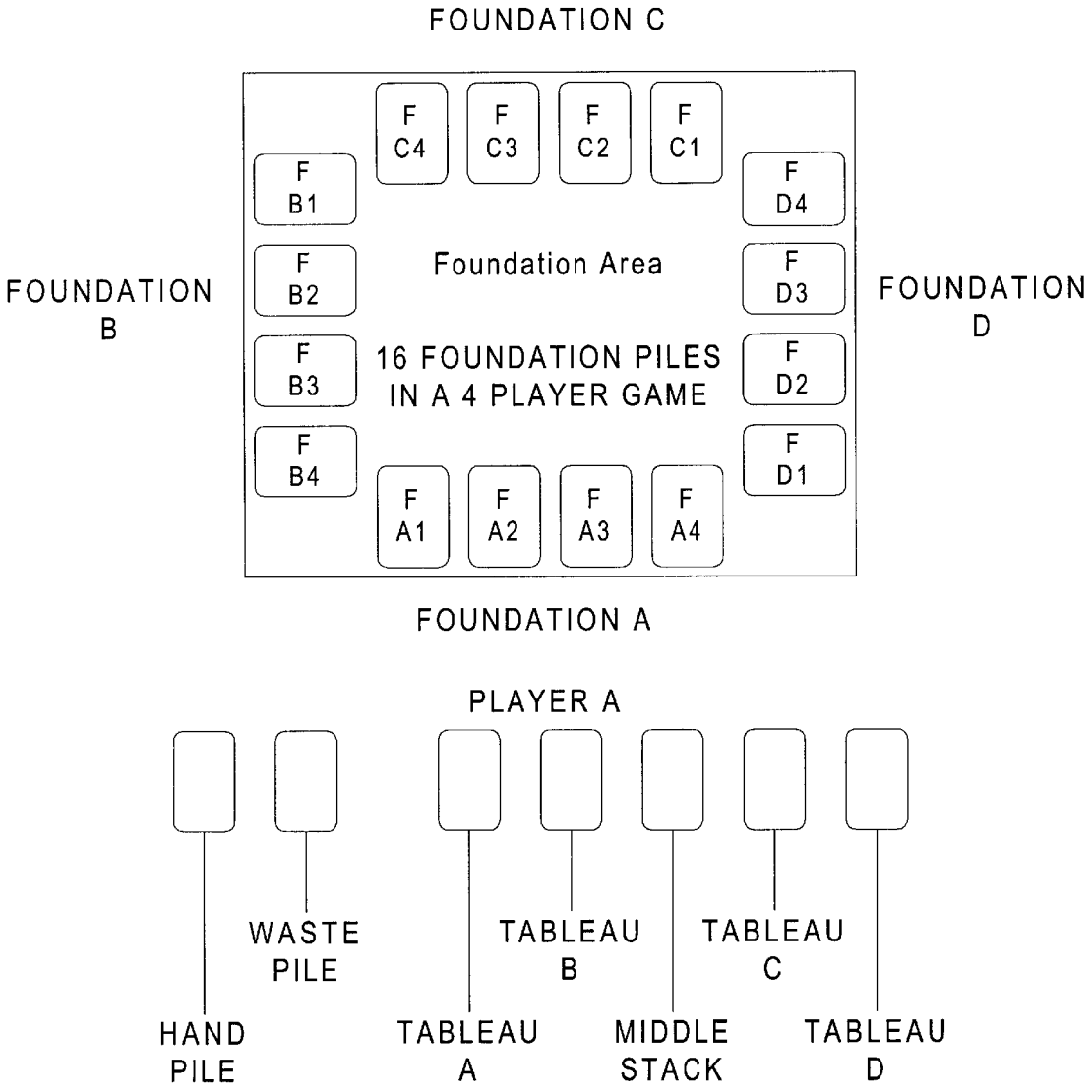
FIG. 3 illustrates Zip solitaire computer screen layout as seen from player A's perspective, only his cards and all foundation piles can be seen.
Figure 4:
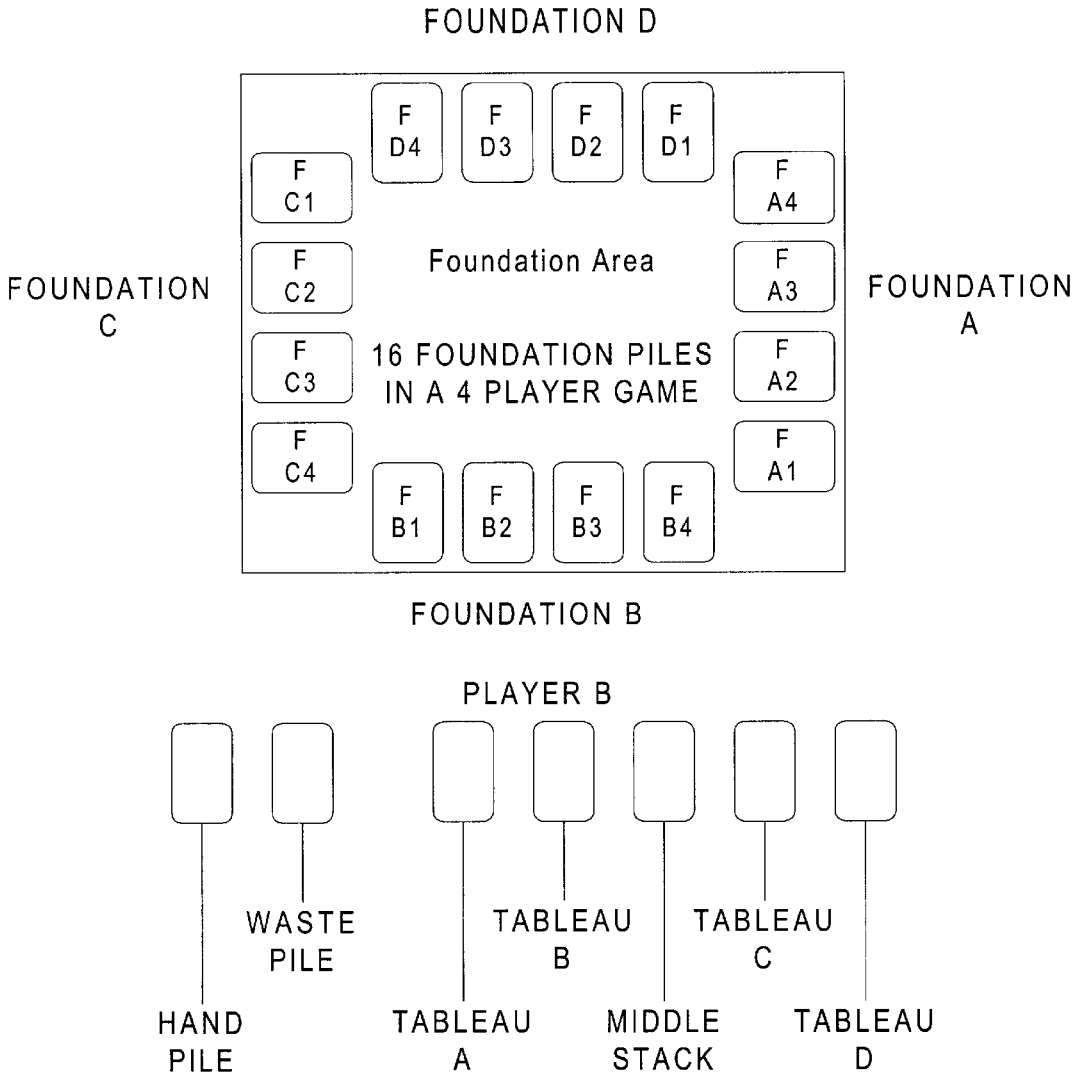
FIG. 4 illustrates Zip solitaire computer screen layout as seen from Player B's perspective, only his cards and all foundation piles can be seen.

A more detailed description of Zip solitaire follows in the context of computerized online playing. Each solitaire player sees his own hand pile, waste pile, tableaus, and middle stack. Although any plural number of players could play a single Zip solitaire game, an example of Zip solitaire will be described where there are four players (Player A, Player B, Player C, Player D). Each player also sees the foundations for all players. This layout is shown from player A's perspective in FIG. 3. For the same game, player B would see the same foundations, except that his relative position would have shifted to match the real-world perspective of sitting at a 90° angle to player A. This shifted perspective is illustrated in FIG. 4.

Figure 5:
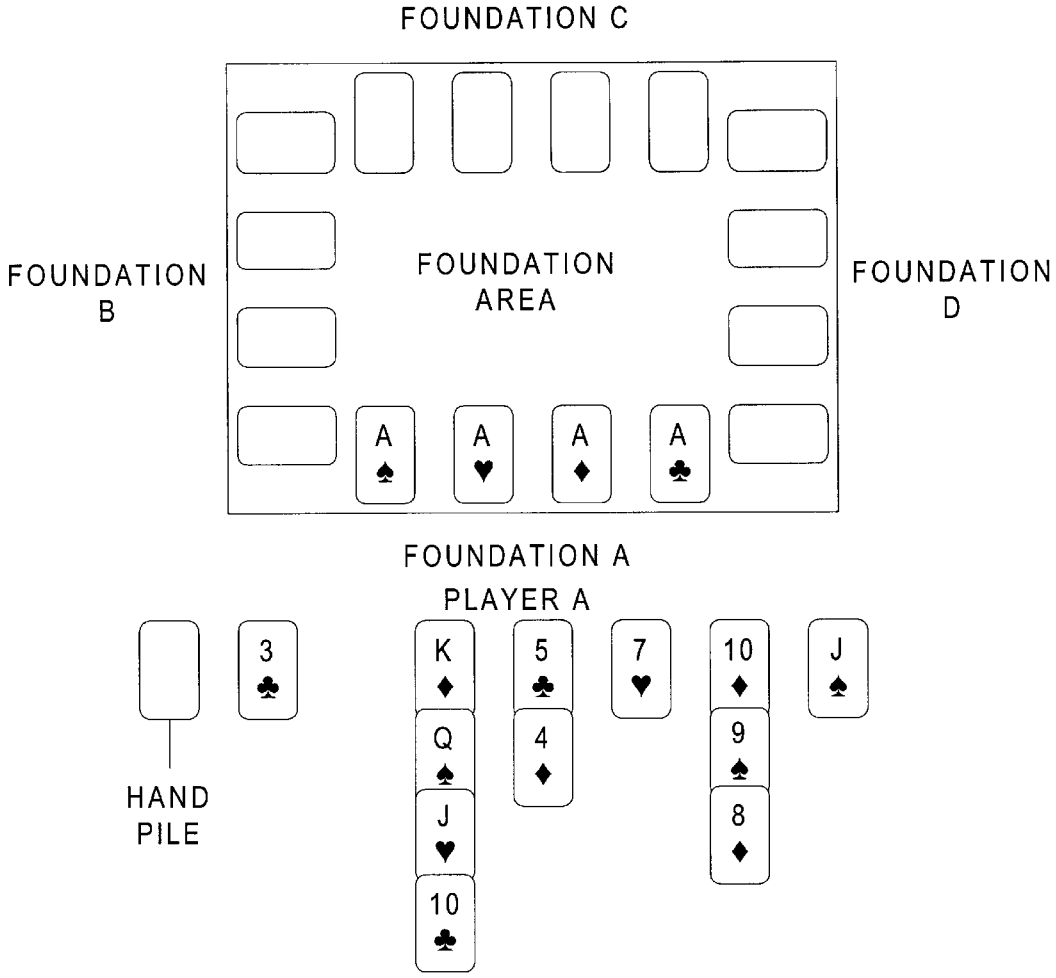
FIG. 5 illustrates a typical Zip solitaire midgame layout wherein Aces played to a foundation always appear in front of the player that played them. After a foundation pile is established any player may make card plays on it.

When aces are played to the foundation, they automatically go to that player's foundation, as opposed to the other foundations in the foundation area. A typical scene early in a game is illustrated in FIG. 5. Note that all four aces, which have been played by player A, have been played to foundation A. In this typical scene, note that player A has moved cards to the tableaus and has played cards from the hand pile to the discard (waste) pile. These moves will be explained below.

When playing computerized Zip solitaire, one player's plays to the common foundations are not immediately known to other players. This can mean that several clients 218 can simultaneously accept foundation plays that still appear to be legitimate on the clients 218 but which may no longer actually be available on the game server 218. Multiplayer solitaire clients 218 reflect this uncertainty by blocking certain moves pending confirmation from the game server 214.

Whenever a player makes a play to the common foundations, that player's client 218 leaves a "ghosted" card in place as it waits for confirmation or rejection by the server. If the game server 214 accepts the play, the ghosted card disappears. If the game server 214 rejects the play, the card returns from the foundation to take the position of the ghosted card. With a ghosted card in place, the player is blocked only from making those moves that would use the ghosted card or that depend on the server's acceptance of the foundation card play. The player may make any moves that do not depend on the ghosted card's presence or absence. This concept will be explained in further detail for each example below.

Figure 6:
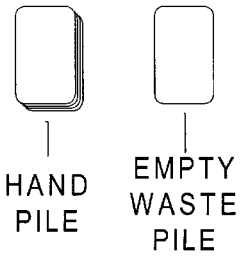
FIG. 6 illustrates card plays from a hand to a waste before any cards are turned over. Cards are moved from hand to waste, three cards at a time, by clicking on the hand pile.
Figure 7:
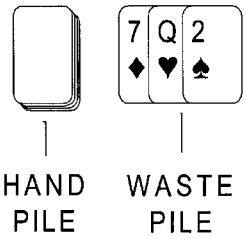
FIG. 7 illustrates card plays from a hand to a waste depicting three cards turned simultaneously.

Sources of cards for each player are the hand pile and the waste pile. The way they work is very similar to typical single-player solitaire. At the beginning of each game, the hand pile contains 35 cards and the waste pile is empty, as shown in FIG. 6. One of the moves a player can make is to turn over a set of three cards from the hand pile to the waste pile, as shown in FIG. 7. The player may then move only the topmost card from the waste pile by dragging the topmost card with his mouse to a new position, or the player may then turn over three more cards from the hand pile to the waste pile by clicking his mouse on the hand pile. As an example, in FIG. 7, the player may move the two of spades to any other eligible position. If the player moves the two of spades, that frees the queen of hearts to be moved; otherwise, the player may not move the queen of hearts.

Figure 8:
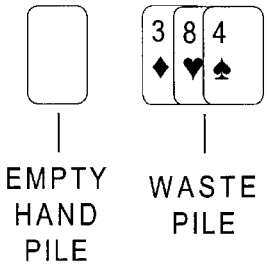
FIG. 8 illustrates card plays from a hand to a waste in which all cards were turned over from the hand to the waste. A player clicks on the empty hand pile location in order to reset all waste cards to the hand.
Figure 9:
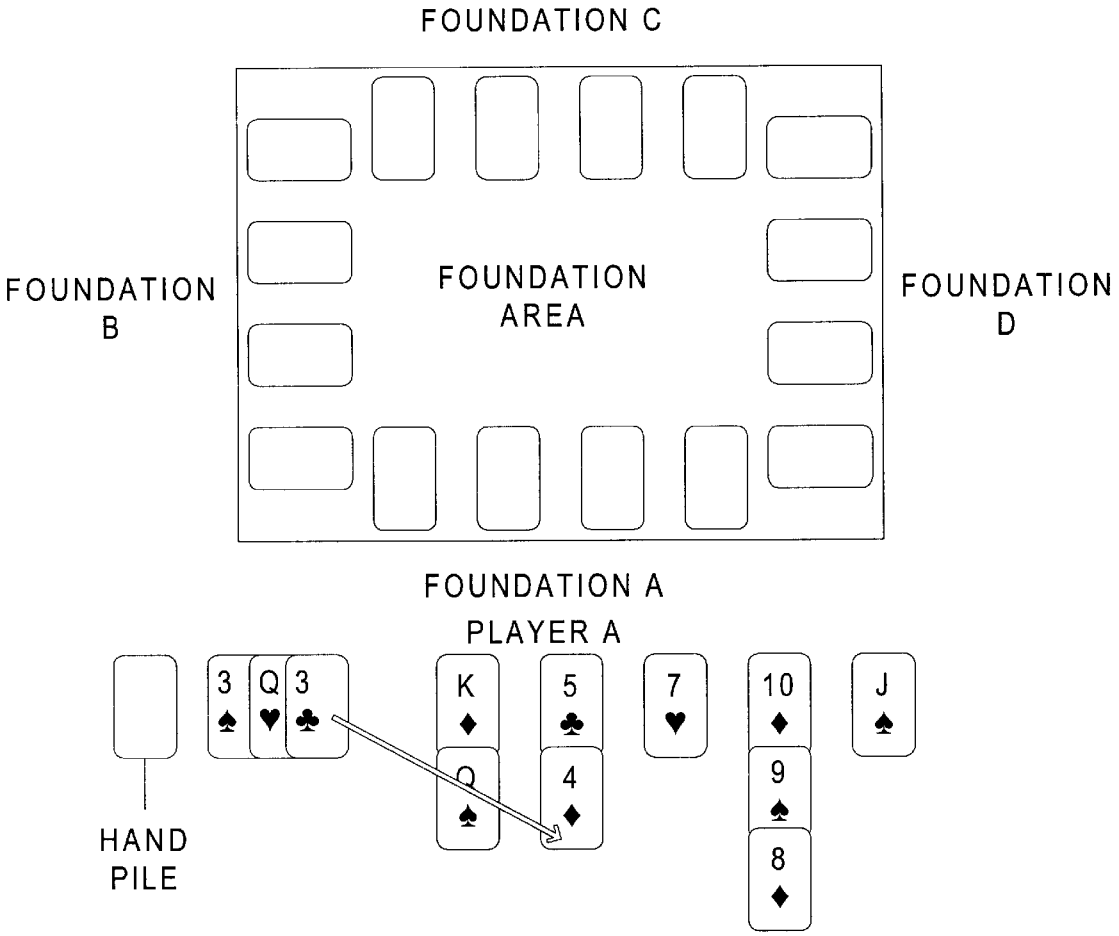
FIG. 9 illustrates a typical waste pile card play to a tableau pile. The player simply drags the waste card to the tableau pile upon which it will be played.
Figure 10:
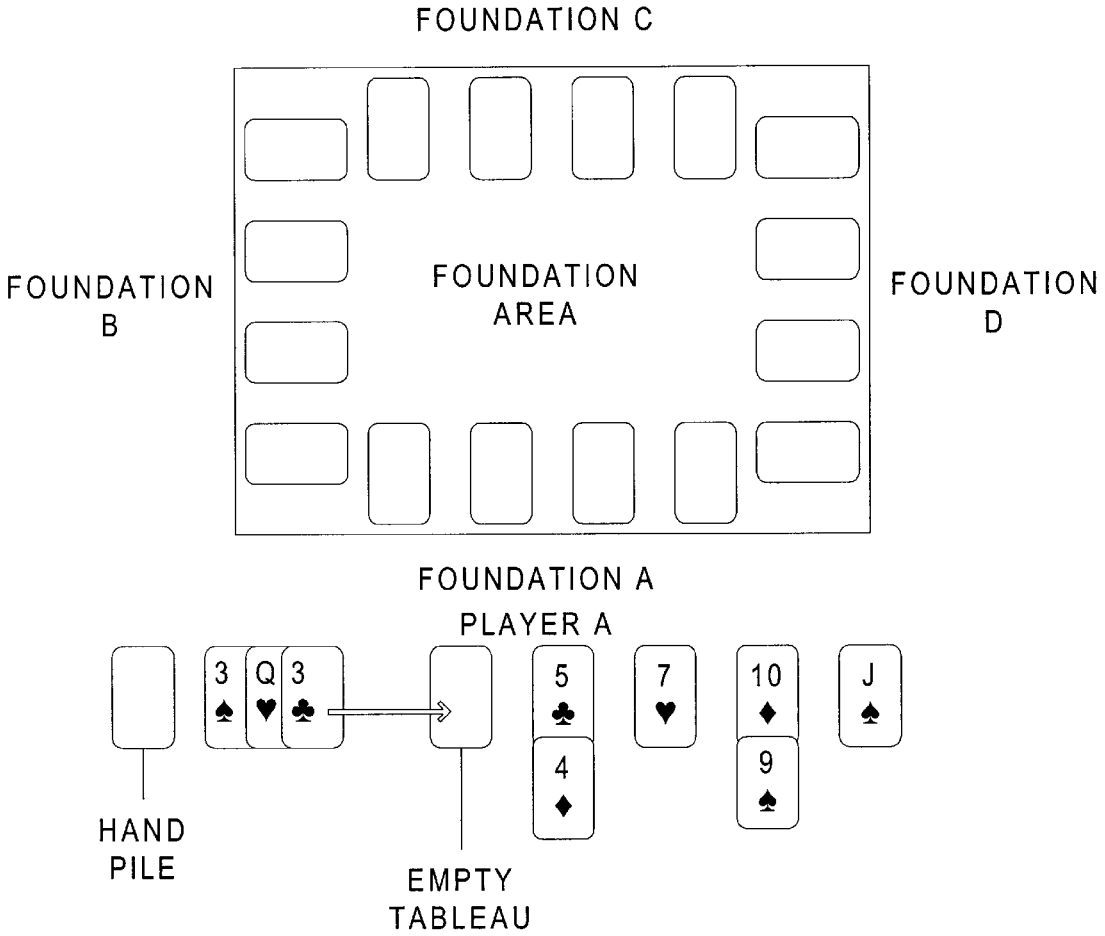
FIG. 10 illustrates a typical waste pile card play to an empty tableau pile. The player drags the card from the waste to the empty tableau.

When a player has moved all cards from the hand pile to the waste pile, as shown in FIG. 8, he may turn over the entire waste pile back onto the hand pile by double-clicking his mouse on the waste pile, restoring it to the position shown in FIG. 6. That player may then continue turning over cards three at a time from the hand pile to the waste pile. Note that if the waste pile remains unchanged (if none of the cards are moved to other positions), then the order in which they appear will not change. A player may move waste pile cards to tableaus or to foundations. FIG. 9 shows that a waste pile card may be played to an eligible position on an occupied tableau, and FIG. 10 shows that a waste pile card may be played to any empty tableau.

When a player moves a waste pile card to a foundation, some of his other waste pile moves are temporarily blocked as he waits for confirmation or rejection by the game server 214.

Figure 11:
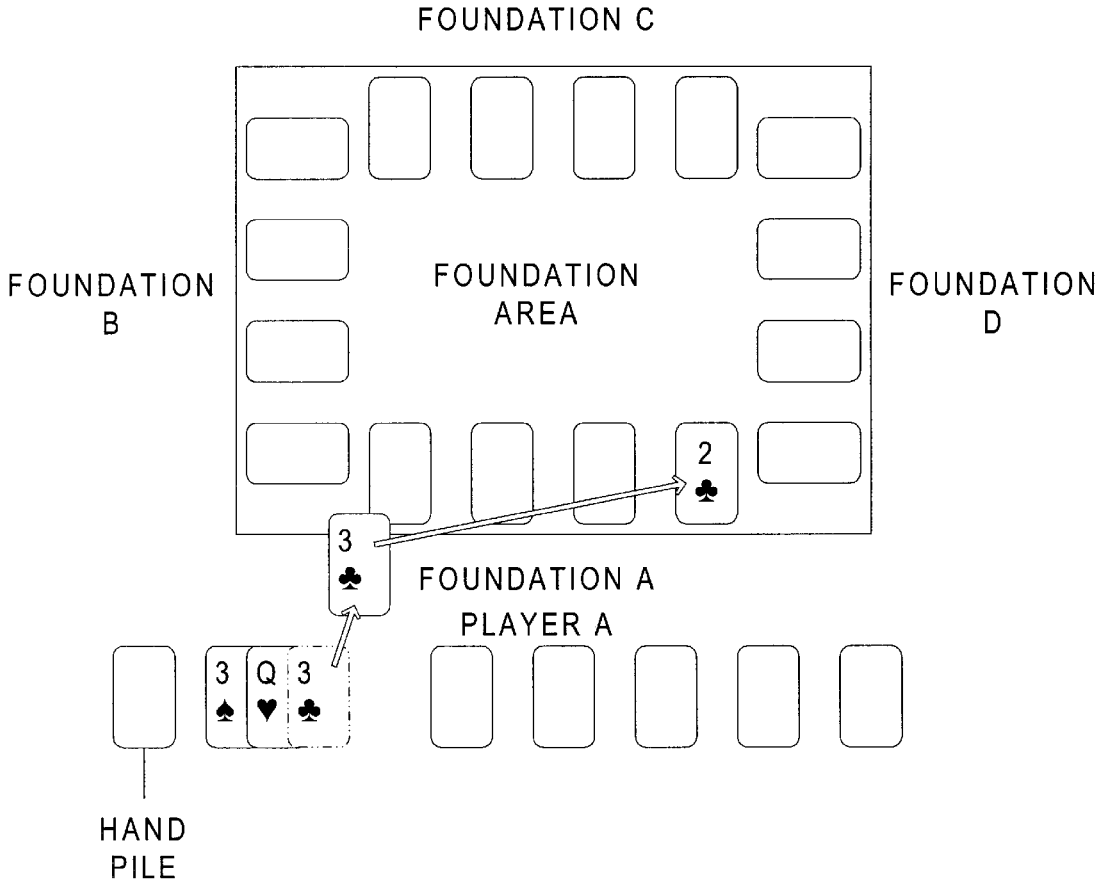
FIG. 11 illustrates a waste card play to a foundation pile. The player drags the card to the foundation area, releases the mouse button, the client software animates the movement to the closest foundation pile.
Figure 12:
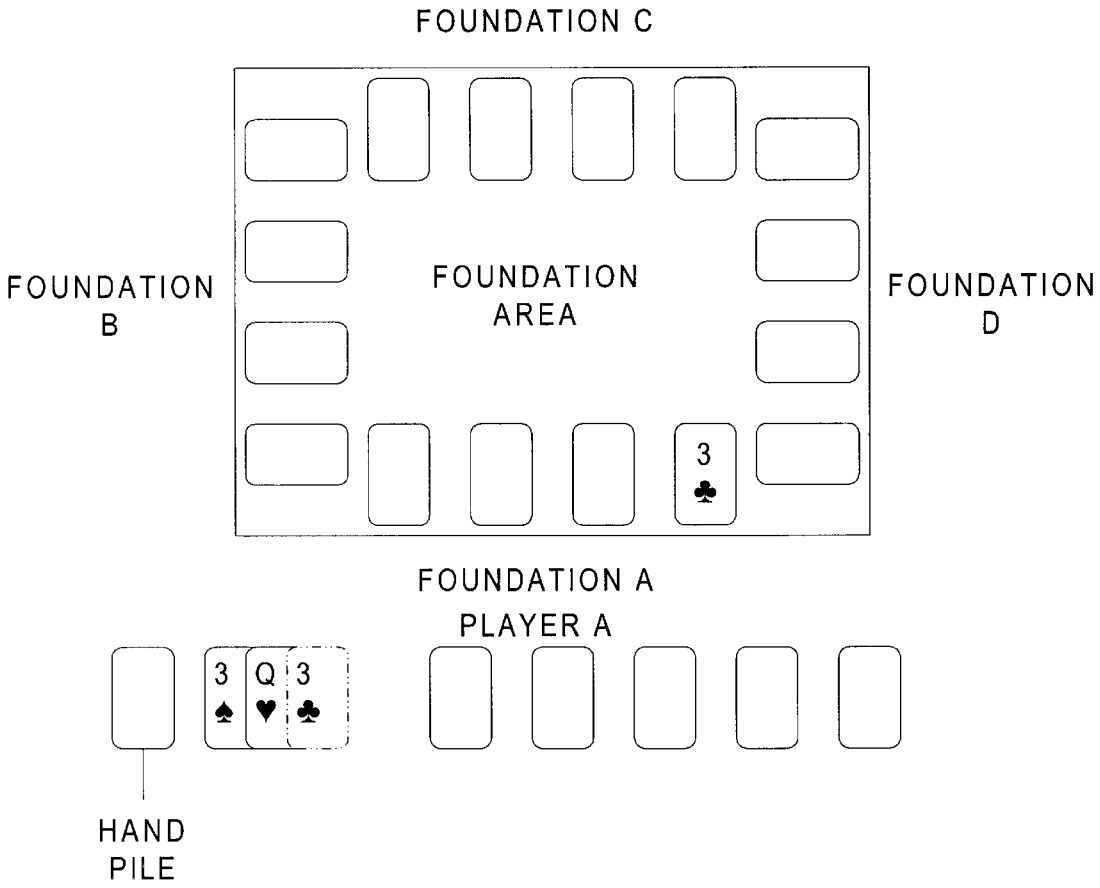
FIG. 12 illustrates the result of a waste card play to a foundation. When a card is played to a foundation the originating card position is ghosted (blocked) until a confirmation of a valid card play or a card play rejection is received from the server. The card play may be either accepted (as depicted in FIG. 13) or rejected (as depicted in FIGS. 14, 15 and 16)

To play a card to an eligible foundation, the player drags the card to the foundation area and releases it. The player's client animates the card sliding into position onto the appropriate foundation. A typical example of this is shown in FIG. 11, where player A plays the three of clubs to a foundation. The temporary result is shown in FIG. 12, where player A's client (hereafter referred to as "client A")218*a* displays the card that was played in "ghosted" form on the waste pile, and displays the card on the foundation in normal form. This is because the "ghosted" card may return if the play was rejected, but the only way the three of clubs would be rejected and leave the foundation is if another player's three of clubs were played there first. While the ghosted card remains on the waste pile, the player may not make any moves involving that card or any card below it. The player's other possible moves are otherwise unimpeded. For example, the player may turn over more sets of three cards, or may turn over the entire waste pile back onto the hand pile, so long as the original ghosted card is not directly involved.

Figure 13:
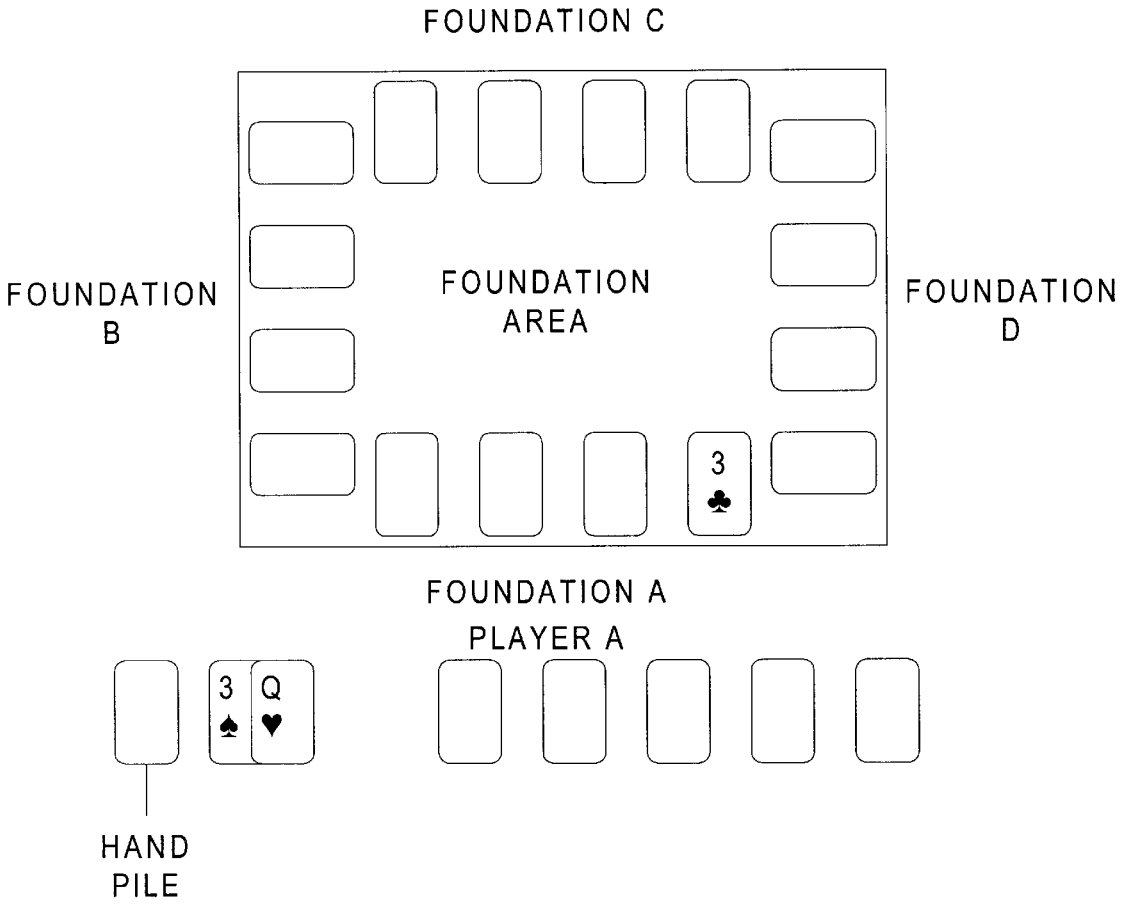
FIG. 13 illustrates the acceptance by the server of the waste card play illustrated in FIGS. 11 and 12. The ghosting (blocking) disappears, allowing the player to use the waste card that was beneath the ghosted card.
Figure 16:
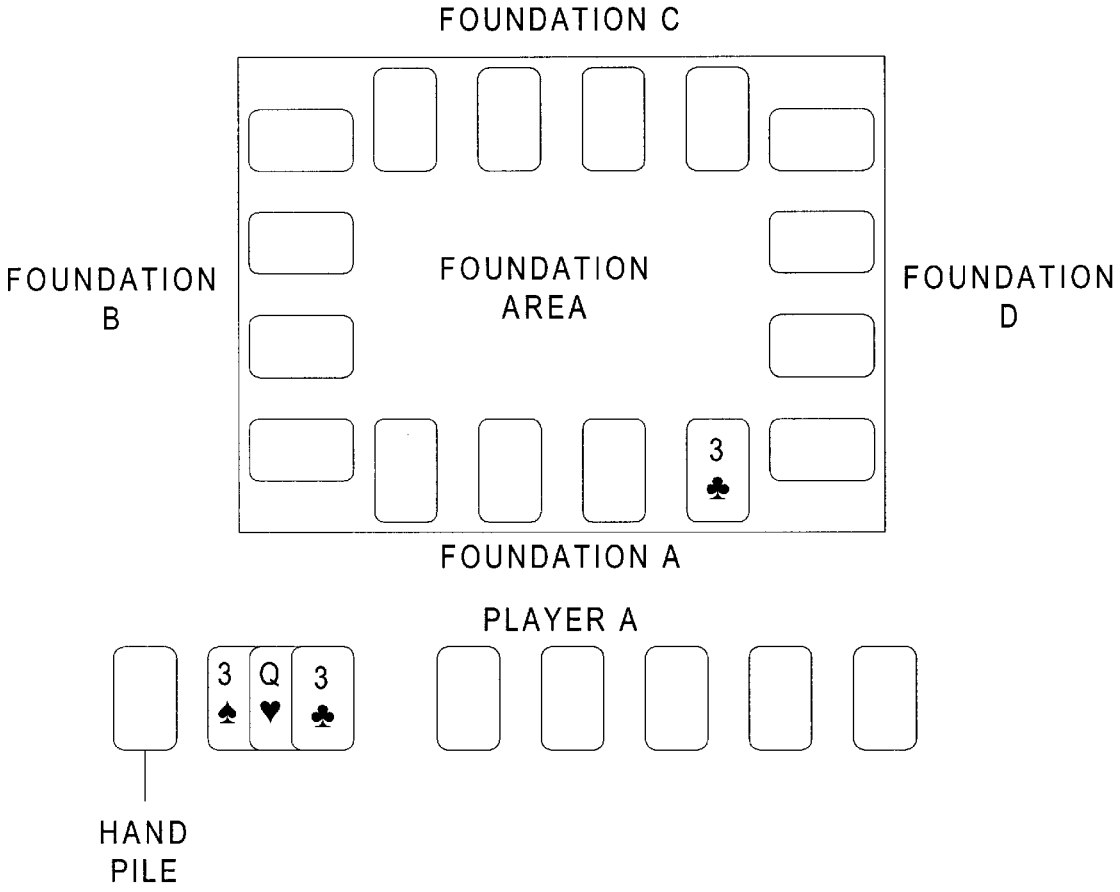
FIG. 16 illustrates the result of the sequence of plays depicted in FIGS. 11, 12, 14 and 15, in which player A made a foundation card play from the waste, however, the server received another player's card play to the identical foundation pile before player A's. The other player's card play was accepted and remains on the foundation pile, player A's card play was rejected and returned to its origination point, removing the ghosting.

The two possible outcomes to the play of FIG. 11 are shown in FIG. 13 (confirmation) and FIG. 16 (rejection, explained in the following paragraph). If the game server 214 confirms the foundation card play, the ghosted card disappears, and the player is free to play the card that had been underneath the ghosted. In this example, FIG. 13 shows that player A is now free to move the queen of hearts if possible.

Figure 14:
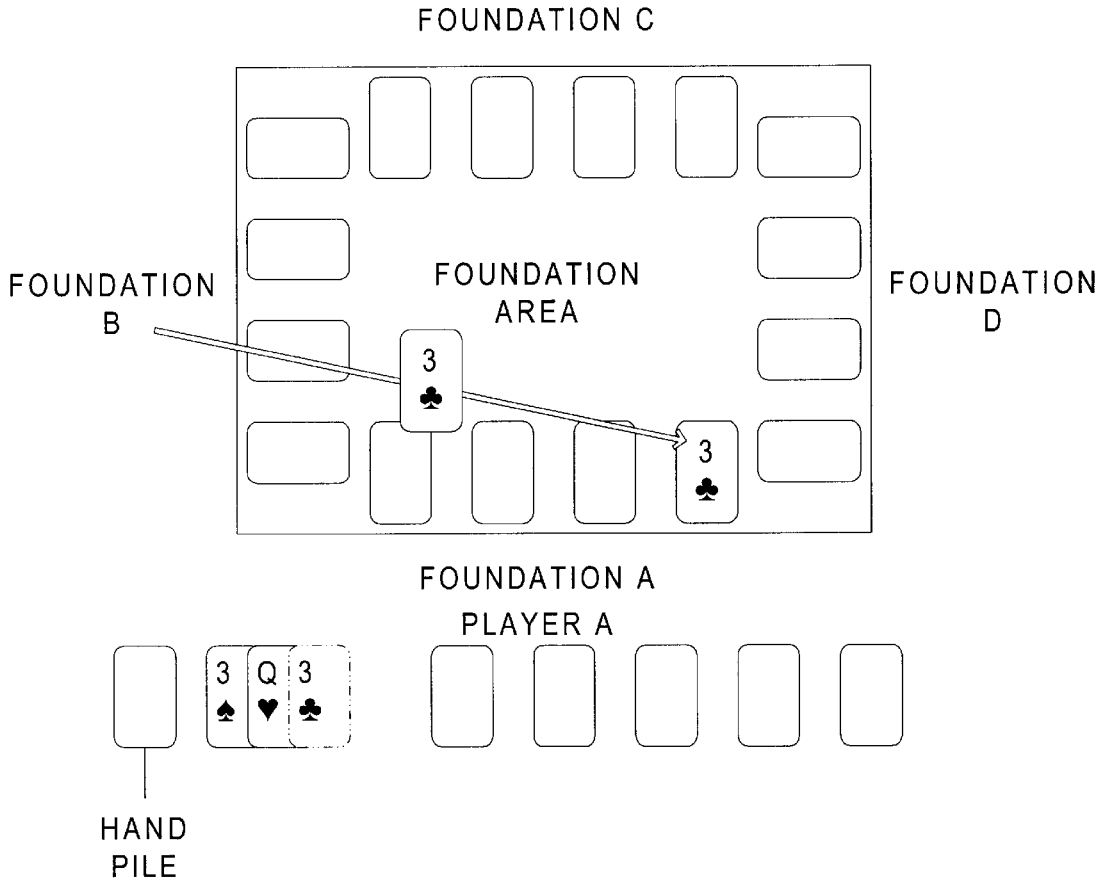
FIG. 14 illustrates acceptance by the server of another player's foundation card play to a foundation pile that player A just attempted to play to, as illustrated in FIGS. 11 and 12. Upon receiving such notice from the server, the client software will animate that card play from the respective player's position to the foundation pile upon which it was accepted.
Figure 15:
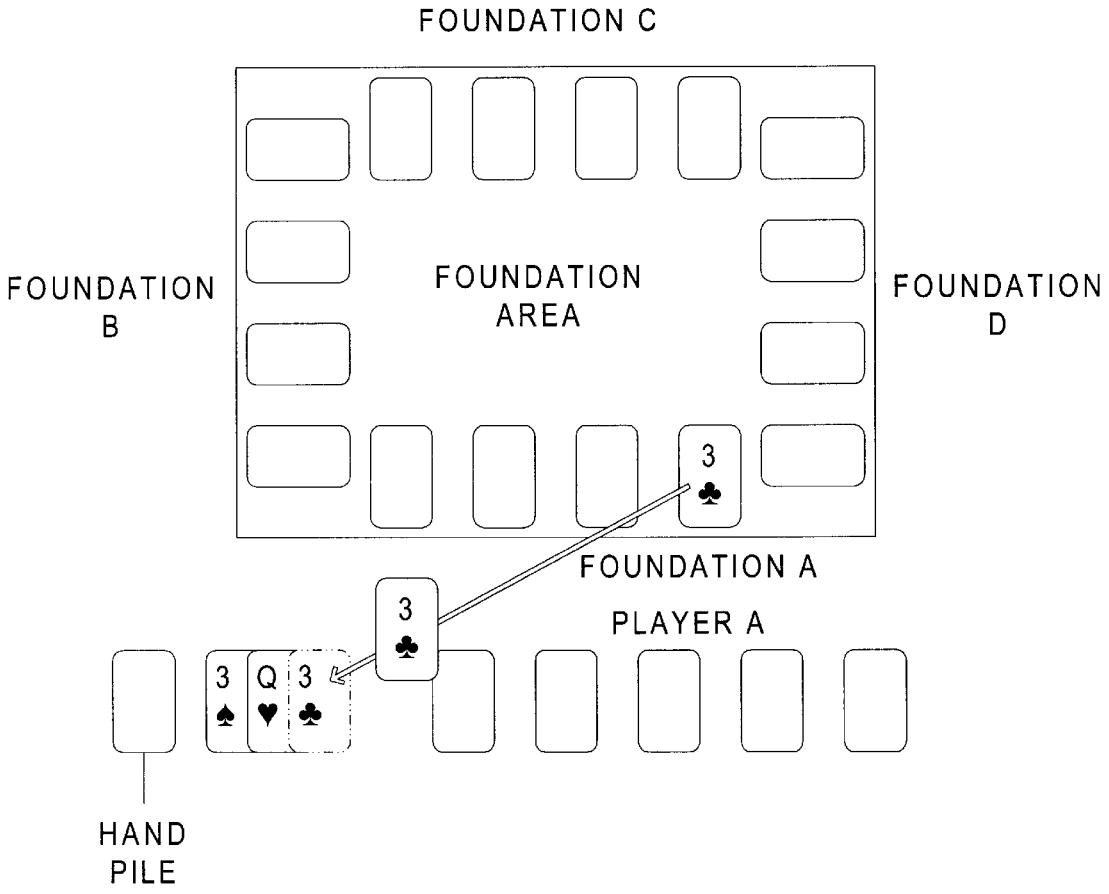
FIG. 15 illustrates rejection by the server of player A's foundation card play, that was illustrated in FIGS. 11 and 12. The server determined that player noted in FIG. 14 was first to play. Player A's card is returned to its origination point and ghosting will be removed.

The only reason for the game server 214 to reject the foundation card play of FIG. 11 is if another player had made an earlier play to that same foundation. In this case, the game server first notifies all clients 218(including client A 218*a*) that a particular player has made a successful foundation card play to a particular foundation. When client A 218*a* receives this notification, it animates the arrival of a card from the particular player to the foundation, as shown in FIG. 14. In this example, when the server receives notification of player A's attempted foundation card play, it determines that there is no longer any legal foundation upon which the card may be played and rejects it. The game server 214 sends notification only to client A 218*a* that the foundation card play was rejected. When client A 218*a* receives this notification, it animates the return of the card from the foundation and puts it into the position of the ghosted card, as shown in FIG. 15. This leaves the player in essentially the same position as he was in before attempting his foundation card play, as shown in FIG. 16, except that player A has no legal foundation on which to play his card.

Figure 17:
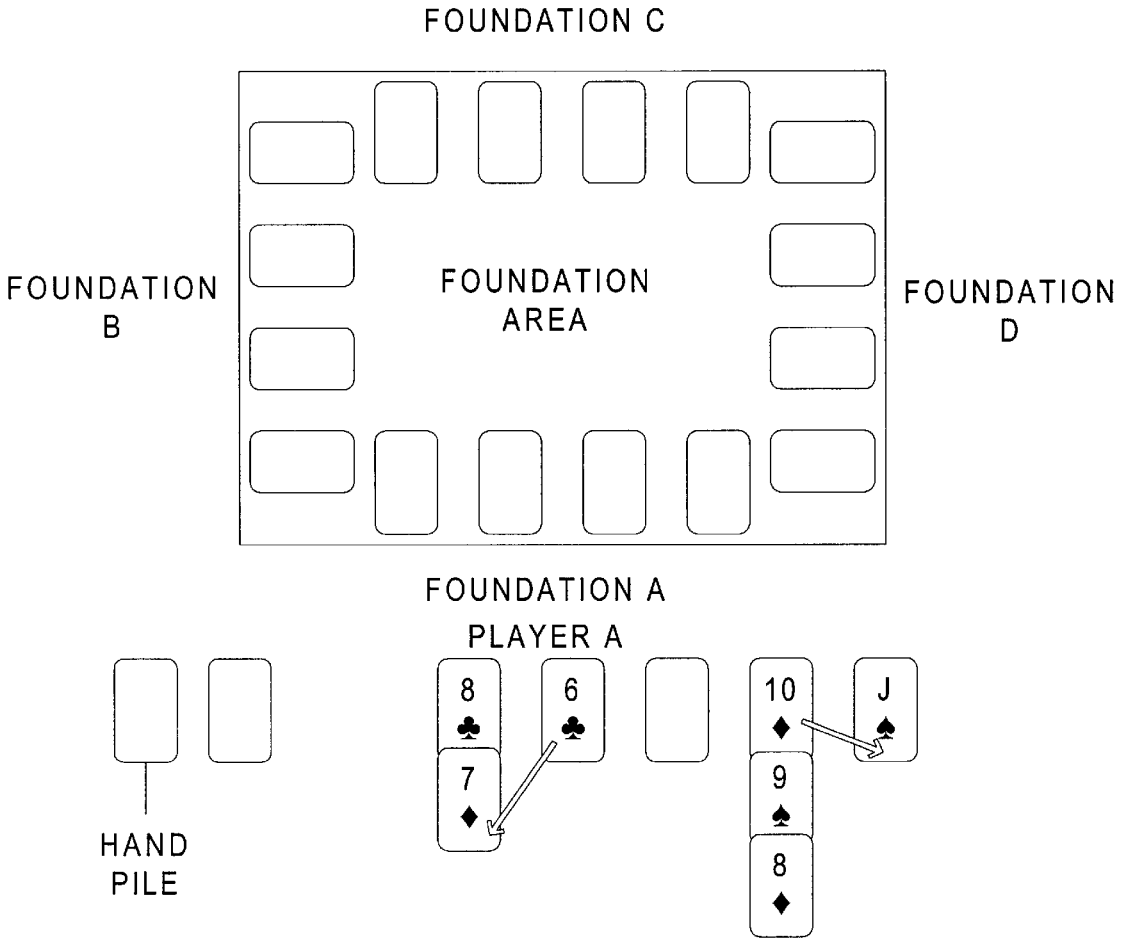
FIG. 17 illustrates typical tableau card plays to other tableau piles.
Figure 18:
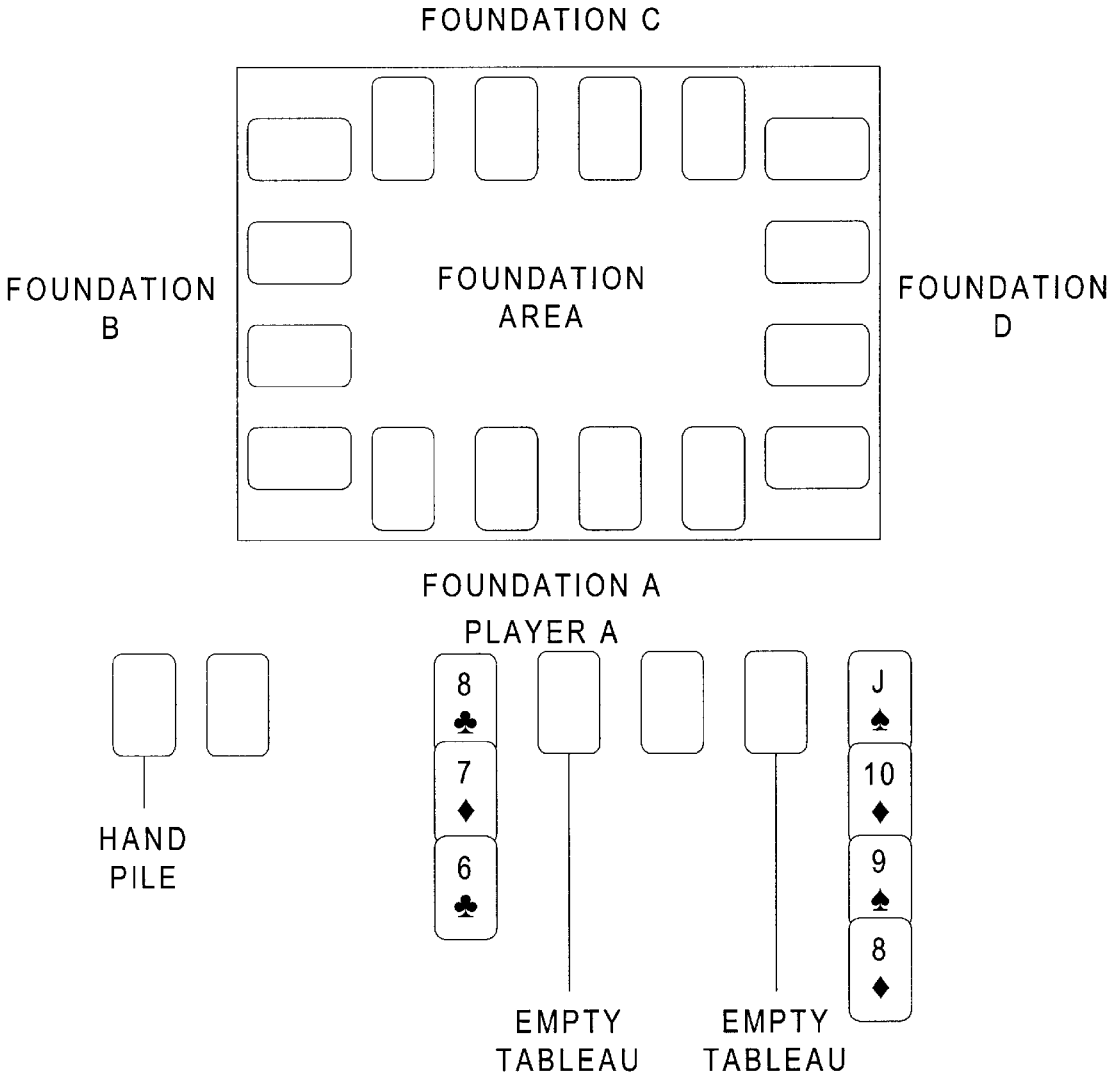
FIG. 18 illustrates the result of the two tableau plays depicted in FIG. 17.

Another important resource for manipulating cards is the set of tableaus. Players may move tableau cards to other tableaus or to the foundations. FIG. 17 illustrates the two ways a player may move a tableau card to another tableau. This is similar to well-known versions of solitaire. A player may move a single tableau card to a suitable tableau, with the figure example of the six of clubs moving to the first tableau over the seven of diamonds. A player may also move an entire stack to another tableau. FIG. 17 also shows how the stack with the ten (10) of diamonds at its base may be moved over the jack of spades in the fourth tableau. The results after these two example moves are shown in FIG. 18, which shows the empty tableaus left behind by these moves.

Figure 19:
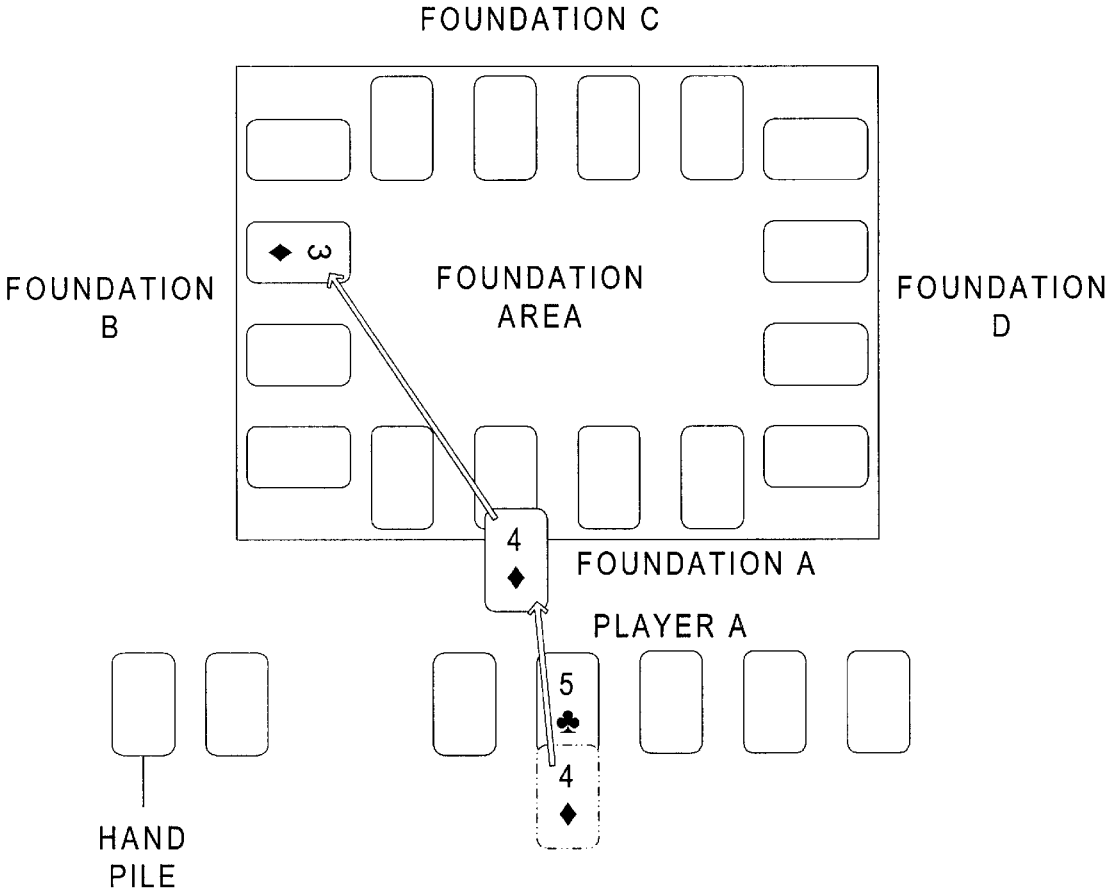
FIG. 19 illustrates a tableau card play to a foundation pile. The player drags the card to the foundation area, releases the mouse button, the client software animates the movement to the closest foundation pile.
Figure 20:
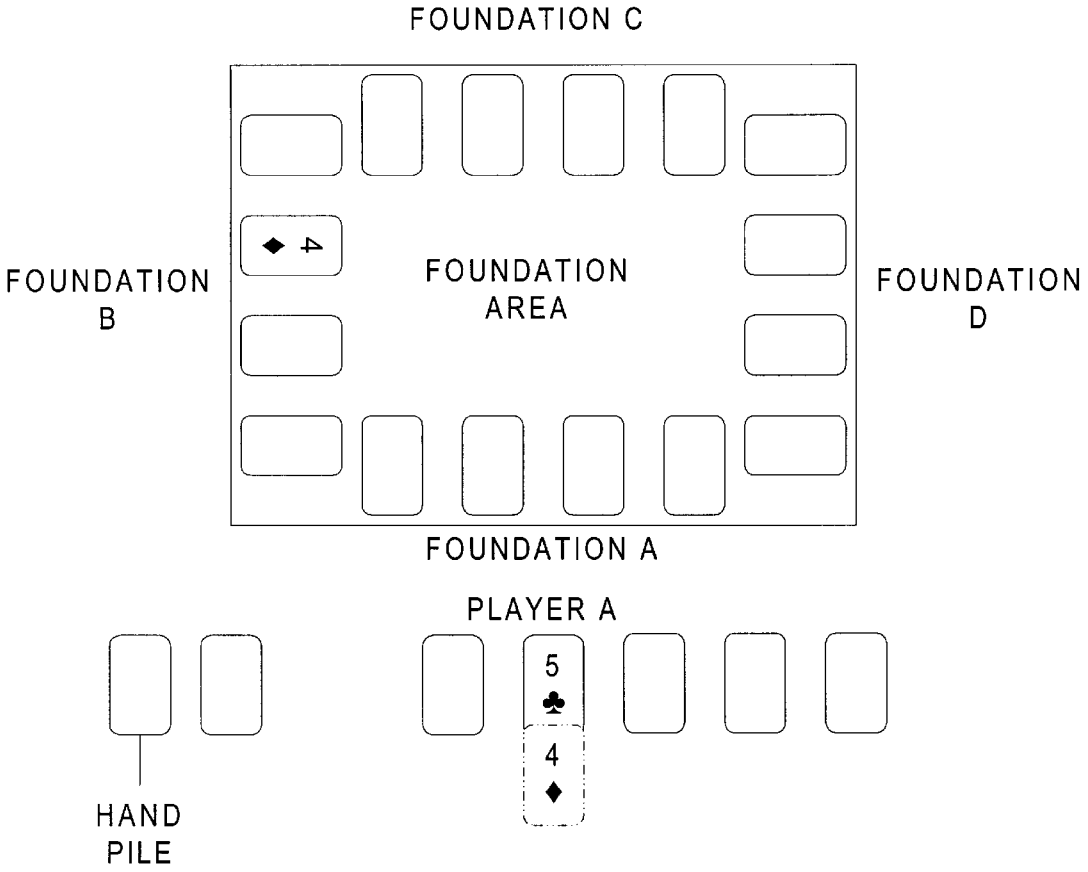
FIG. 20 illustrates the result of a tableau card play to a foundation, the card is played and the tableau card position from whence the card came is ghosted (blocked) until a confirmation of a valid card play, or a card play rejection is received from the server. The card play may be either accepted (as depicted in FIG. 21) or rejected (as depicted in FIGS. 22, 23 and 24)
Figure 21:
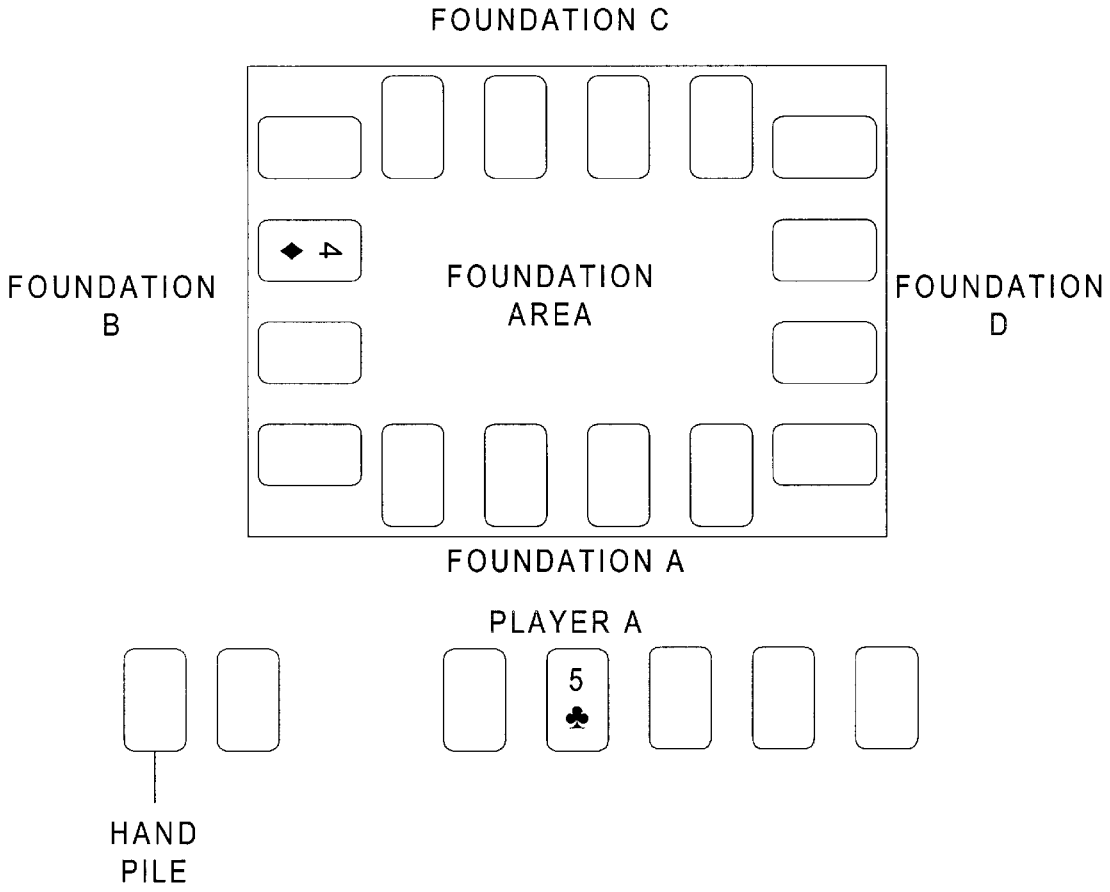
FIG. 21 illustrates the acceptance of the tableau card play, of FIGS. 19 and 20, by the server. The ghosting disappears and that tableau card position is no longer blocked.

A player may also move a topmost tableau card to a foundation. An example of this move is shown in FIG. 19. Player A drags the four of diamonds over the edge of the foundation area and releases the card. Client A 218*a* animates the movement of the card to the closest eligible foundation, in this case, foundation B. While awaiting confirmation or rejection from the game server 214, client A 218*a* displays the card in "ghosted" form at its origination point on the tableau, and also displays the card in normal form on the foundation, as shown in FIG. 20. This is because the "ghosted" card may return if the play was rejected, but the only way player A's four of diamonds would leave the foundation is if another player's four of diamonds were played there first. With the ghosted card on the tableau, in FIG. 20, the player is restricted in possible moves involving that tableau. In this case, player A may move the entire tableau stack (with the base of the five of clubs) to another eligible tableau. But while the ghosted card is present, player A may not play a red four on top of the five of clubs, may not play a black three on top of the ghosted card, and may not move the five of clubs to the foundations. The two possible outcomes to the play of FIG. 19 are shown in FIG. 21 (confirmation) and FIG. 24 (rejection, explained in the following paragraph). If the game server 214 confirms the foundation card play, the ghosted card disappears, and the player is free to play the card that had been underneath the ghosted card to a foundation or tableau, or play a card onto the card been underneath the ghosted card. In this example, FIG. 21 shows that player A is now free from any restrictions on the second tableau.

Figure 22:
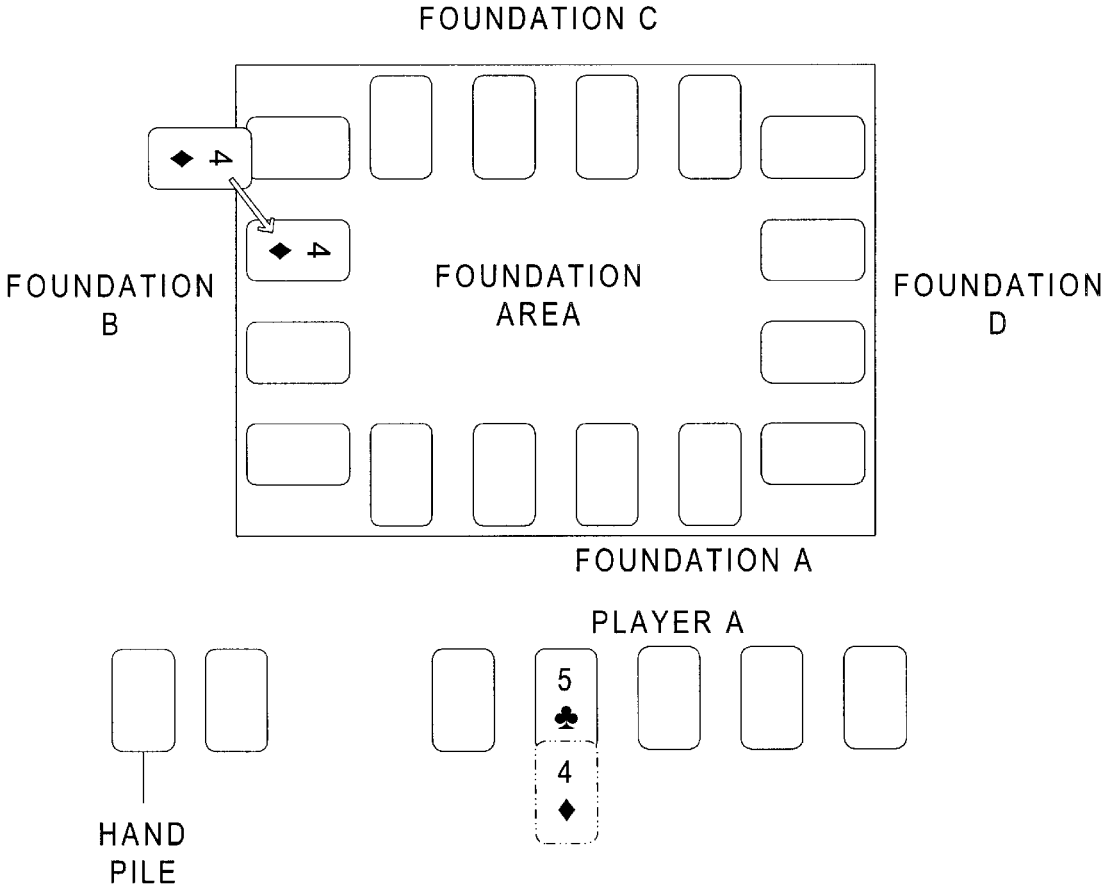
FIG. 22 illustrates acceptance by the server of another player's foundation card play to a foundation pile that player A just attempted to play to (player A's card play was illustrated in FIGS. 19 and 20)
Figure 23:
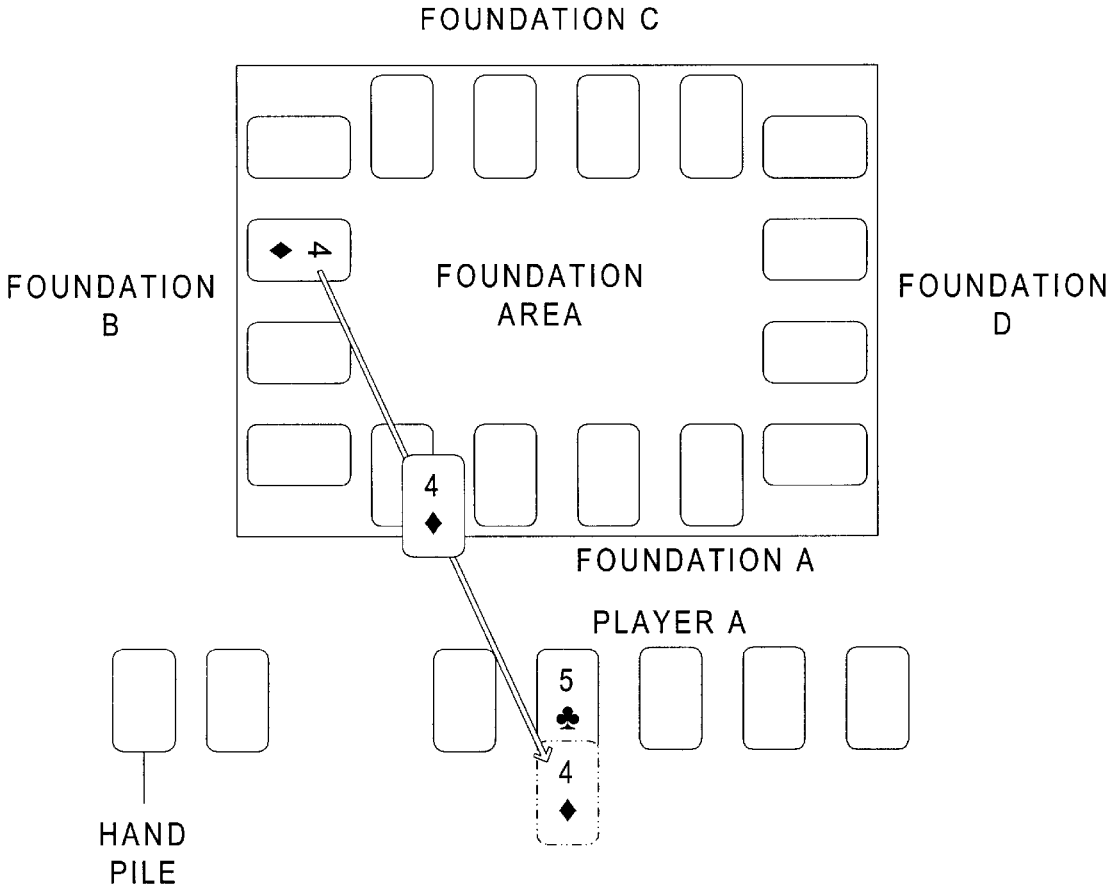
FIG. 23 illustrates rejection by the server of player A's foundation card play that was illustrated in FIGS. 19 and 20. The server determined that player noted in FIG. 22 was first to play. Player A's card is returned to its origination point and ghosting will be removed.
Figure 24:
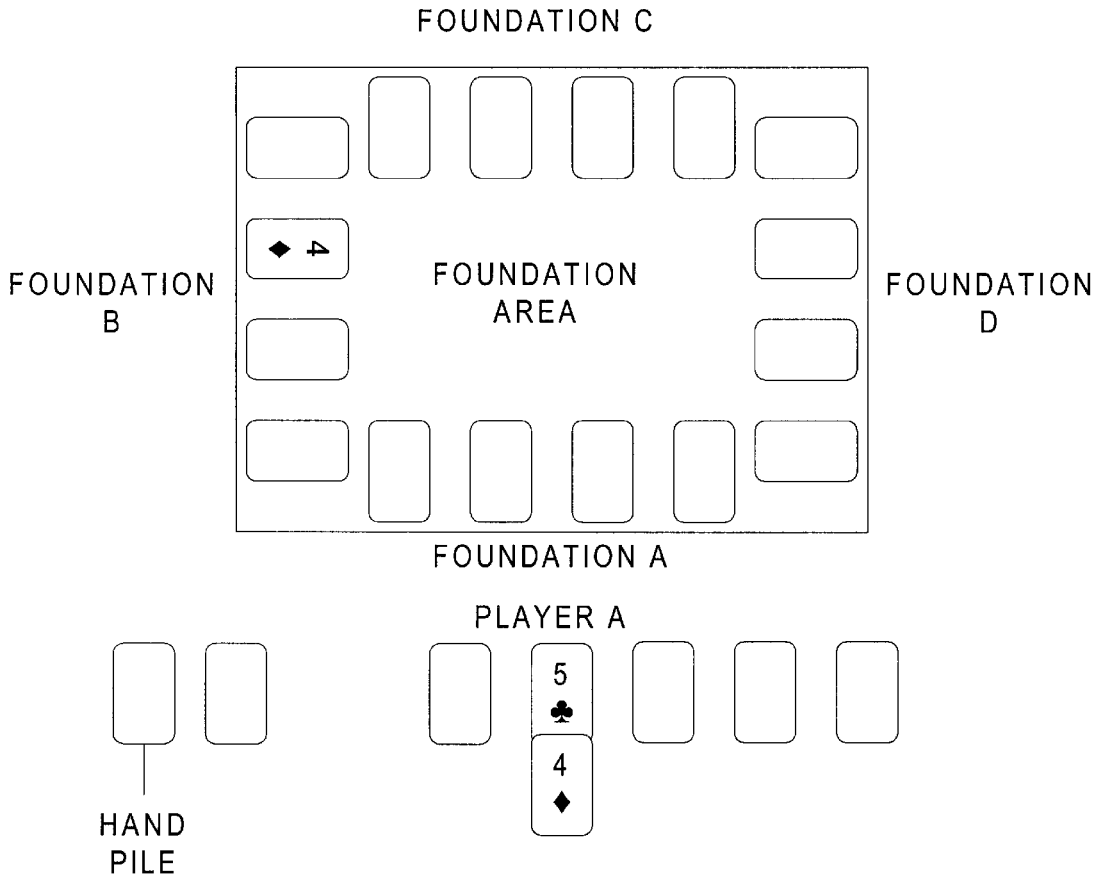
FIG. 24 illustrates the result of the sequence of plays depicted in FIGS. 19, 20, 22 and 23, in which player A made a foundation card play from a tableau, however, the server determined another player's card play was first. The other player's card play was accepted and remains on the foundation pile, player A's card play was rejected and returned to its origination point, removing the ghosting.

The only reason for the game server 214 to reject this foundation card play of FIG. 19 is if another player had made an earlier play to that same foundation. In this case, the game server 214 first notifies all clients 218(including client A 218*a*) that a particular player has made a successful foundation card play to a particular foundation. When client A 218*a* receives this notification, it animates the arrival of a card from the particular player to the foundation, as shown in FIG. 22. In this example, when the server receives notification of player A's attempted foundation card play, it determines that there is no longer any legal foundation upon which the card may be played and rejects it. The server sends notification only to client A 218*a* that the foundation card play was rejected. When client A receives the rejection notification, this client A 218*a* animates the return of the card from the foundation and puts it into the position of the ghosted card, as shown in FIG. 23. This leaves the player in essentially the same position as he was in before attempting his foundation card play, as shown in FIG. 24, except that player A has no legal foundation on which to play his card.

Figure 25:
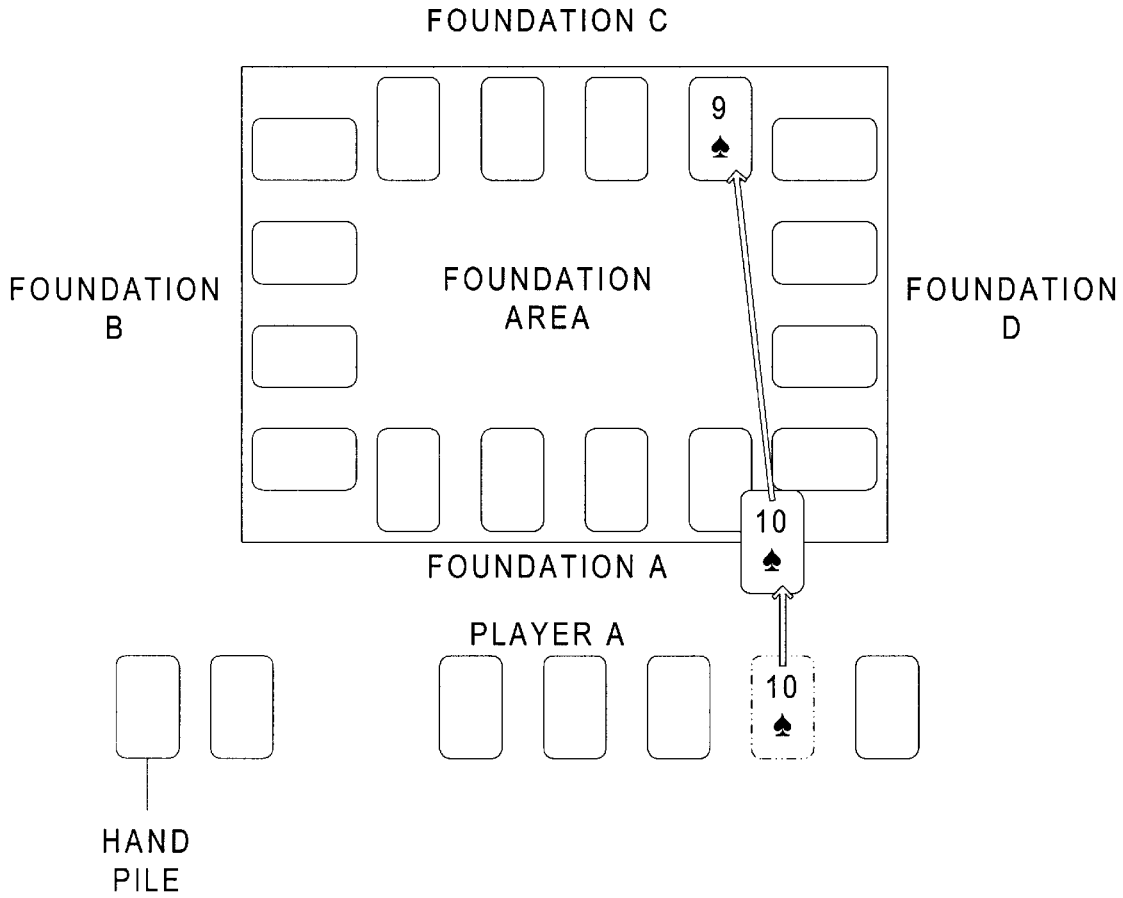
FIG. 25 illustrates a tableau card play to a foundation pile. The player drags the card to the foundation area, releases the mouse button, the client software animates the movement to the closest foundation pile.
Figure 26:
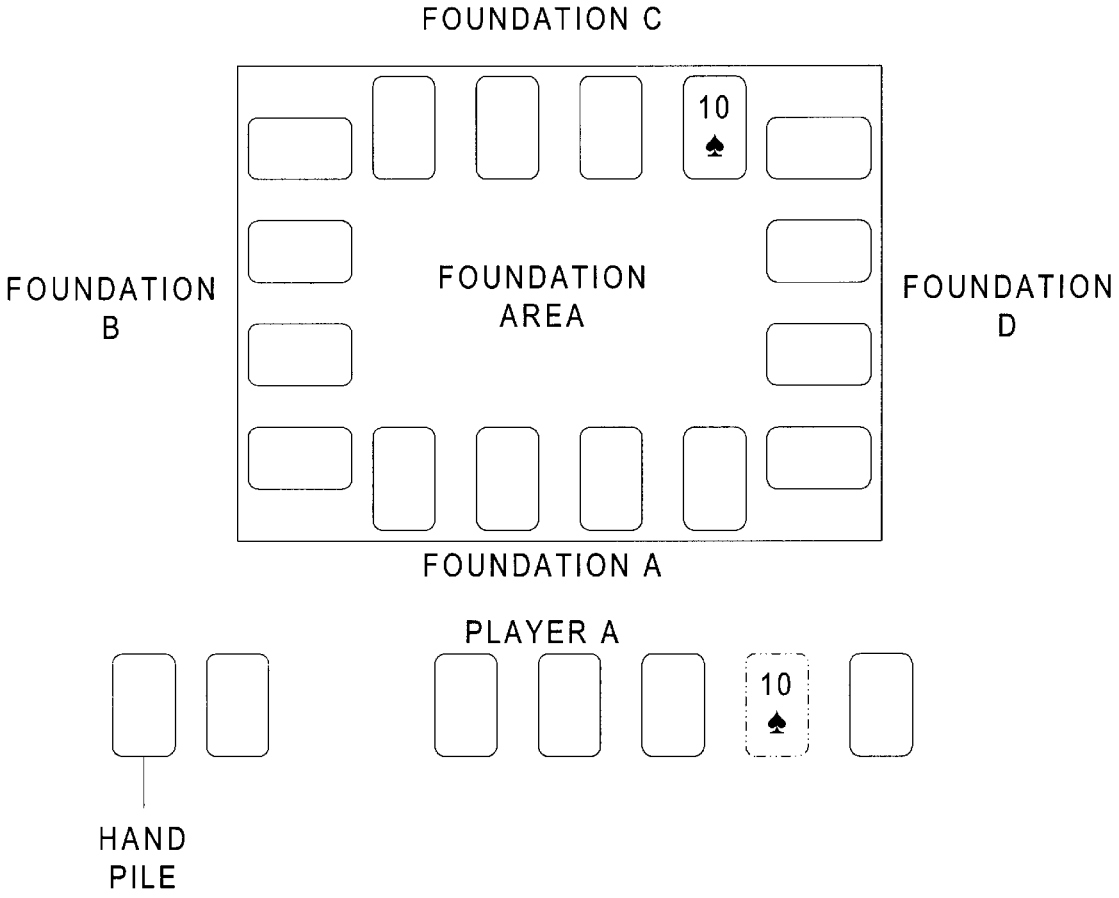
FIG. 26 illustrates the result of a tableau card play to a foundation, the card is played and the originating tableau card position is ghosted (blocked) until a confirmation of a valid card play or a card play rejection is received from the server. Player A's card play may be either accepted (as depicted in FIG. 27) or rejected (as depicted in FIGS. 28, 29 and 30)

A player may also play from tableaus that have only one card each. In FIG. 25, Player A drags the ten (10) of spades to the beginning of the foundation area and releases the card. Client A 218*a* animates the movement of the card to the closest eligible foundation, in this case, foundation C. While awaiting confirmation or rejection from the game server 214, client A 218*a* displays the card in "ghosted" form at its origination point on the tableau, and also displays the card in normal form on the foundation, as shown in FIG. 26. This is because the "ghosted" card may return if the play was rejected, but the only way the ten (10) of spades would be rejected and leave the foundation is if another player's ten (10) of spades were played there first.

With the ghosted card on the tableau, the player is restricted in possible moves involving that tableau. In this case, while the ghosted card is present, player A may not play a red nine on top of the ghosted card, may not move the ten (10) of spades to another tableau, and may not move other cards to what would be an empty tableau without the ghosted card.

Figure 27:
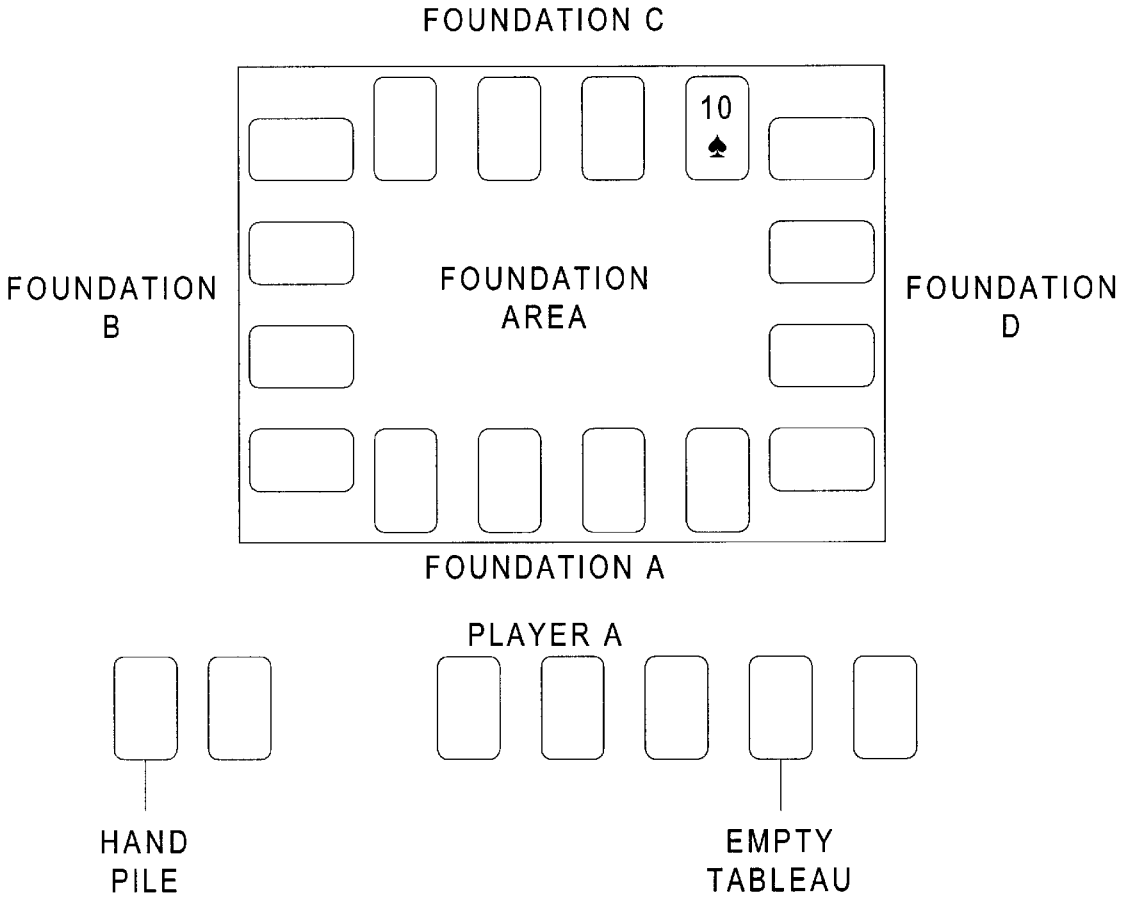
FIG. 27 illustrates the acceptance of the tableau card play of FIGS. 25 and 26 by the server. The ghosting disappears and that tableau card position is no longer blocked.
Figure 30:
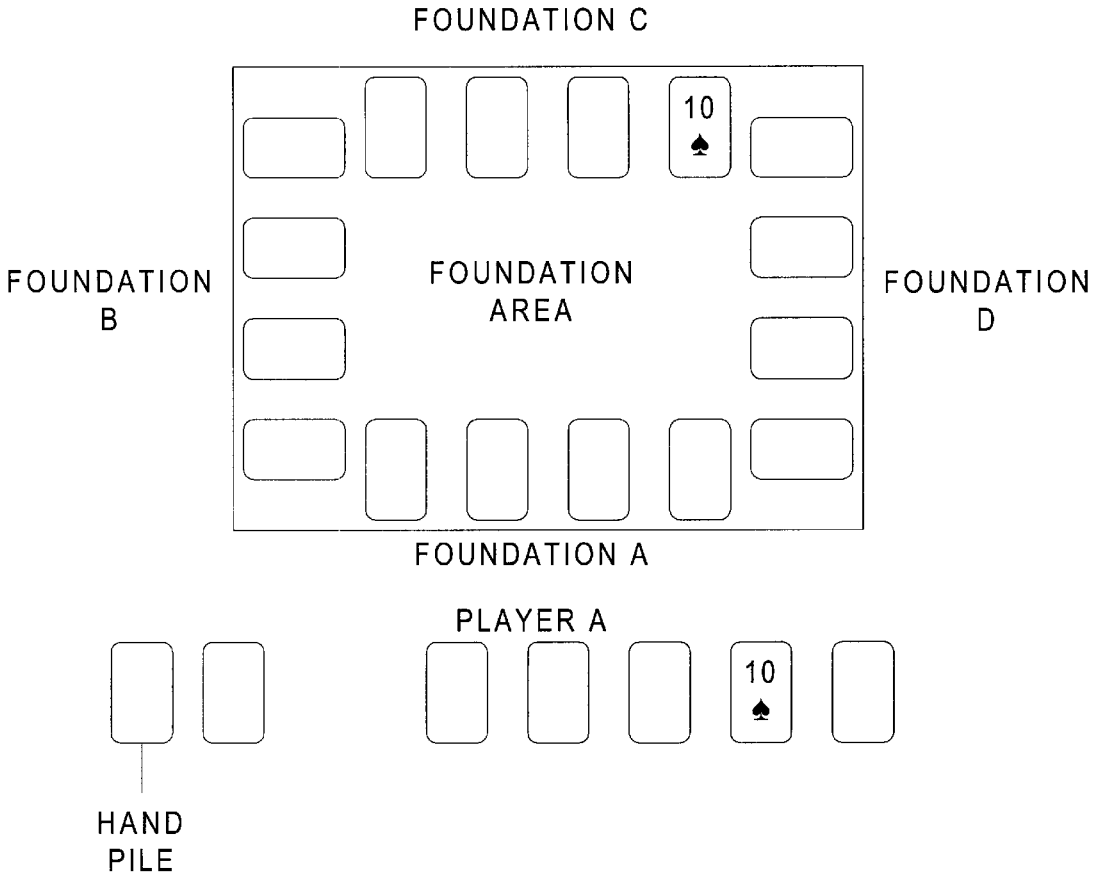
FIG. 30 illustrates the result of the sequence of plays depicted in FIGS. 25, 26, 28 and 29, in which player A made a foundation card play from a tableau, however, the server determined another player's card play was played first. The other player's card play was accepted and remains on the foundation pile, player A's card play was rejected and returned to its origination point, removing the ghosting.

The two possible outcomes to the play of FIG. 25 are shown in FIG. 27 (confirmation) and FIG. 30 (rejection, explained in the following paragraph). If the game server 214 confirms the foundation card play, the ghosted card disappears, and the player is free to play or move other cards to the newly empty tableau. In this example, FIG. 27 shows that player A is now free from any restrictions on the third tableau.

Figure 28:
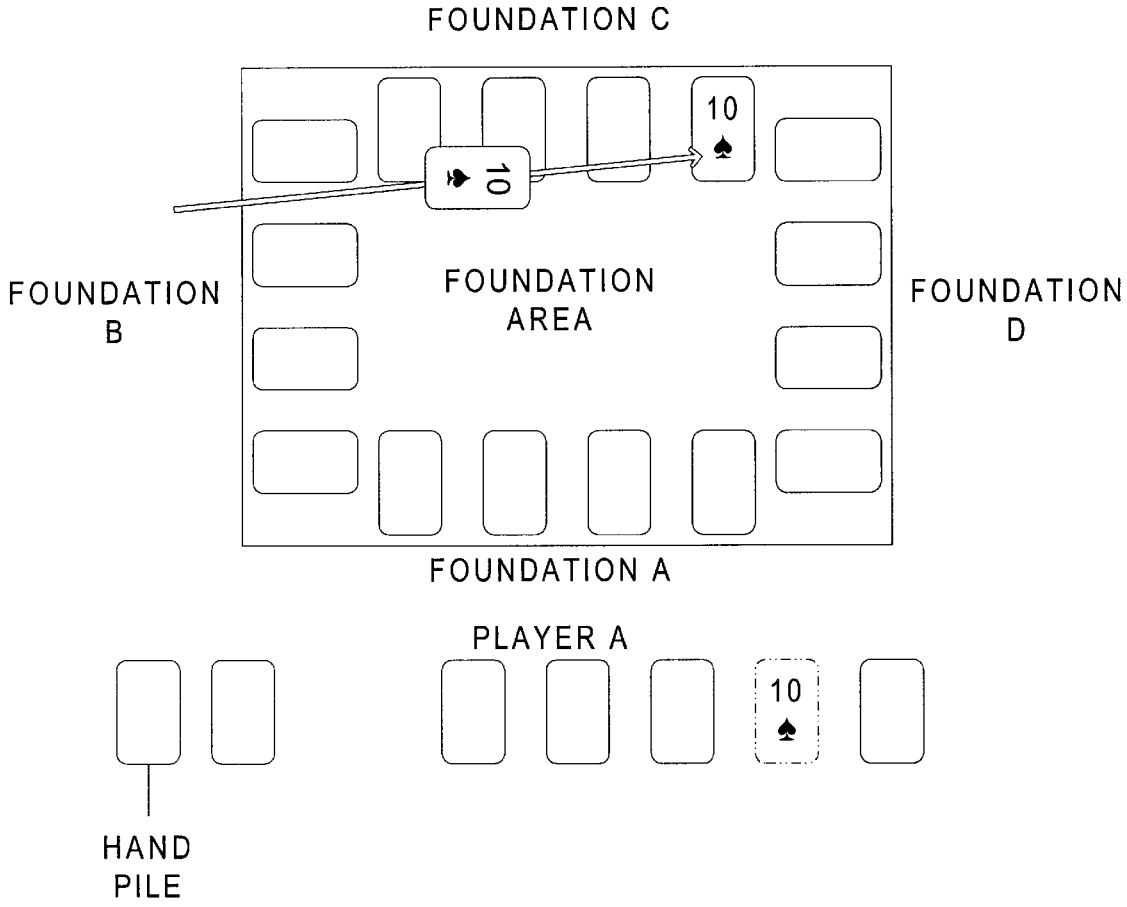
FIG. 28 illustrates acceptance by the server of another player's foundation card play to a foundation pile that player A just attempted to play to (player A's card play was illustrated in FIGS. 25 and 26)
Figure 29:
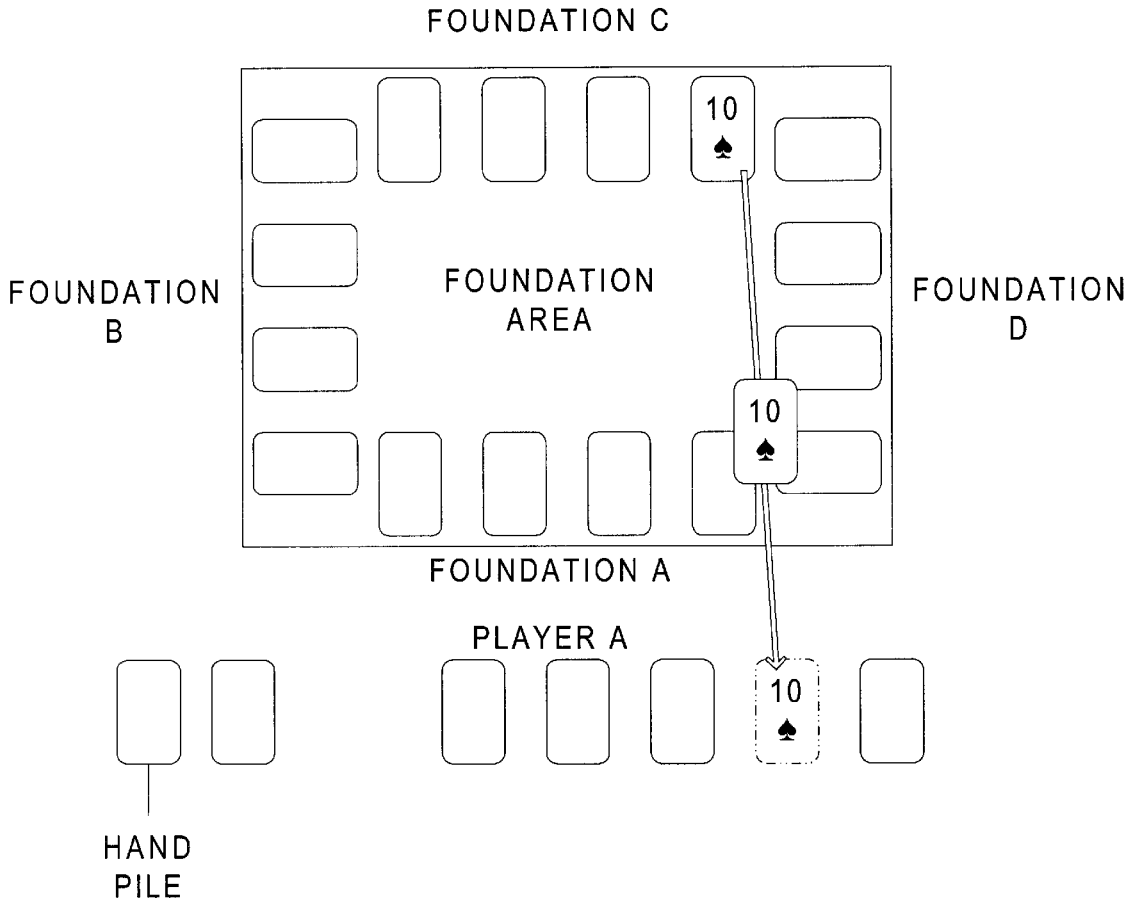
FIG. 29 illustrates rejection by the server of player A's foundation card play that was illustrated in FIGS. 25 and 26. The server determined that player noted in FIG. 28 was first to play. Player A's card is returned to its origination point and ghosting will be removed.

The only reason for the game server 214 to reject this foundation card play is if another player had made an earlier play to that same foundation. In this case, the game server 214 first notifies all clients 218 (including client A 218*a*) that a particular player has made a successful foundation card play to a particular foundation. When client A 218*a* receives this notification, it animates the arrival of a card from the particular player to the foundation, as shown in FIG. 28. In this example, when the game server 214 receives notification of player A's attempted foundation card play, it determines that there is no longer any legal foundation for the play and rejects it. The game server 214 sends notification only to client A 218*a* that the foundation card play was rejected. When client A 218*a* receives the rejection notification from the game server 214 the client 218*a* animates the return of the card from the foundation and puts it into the position of the ghosted card, as shown in FIG. 29. This leaves the player in essentially the same position as he was in before attempting his foundation card play, as shown in FIG. 30, except that player A has no legal foundation on which to play his card.

Figure 31:
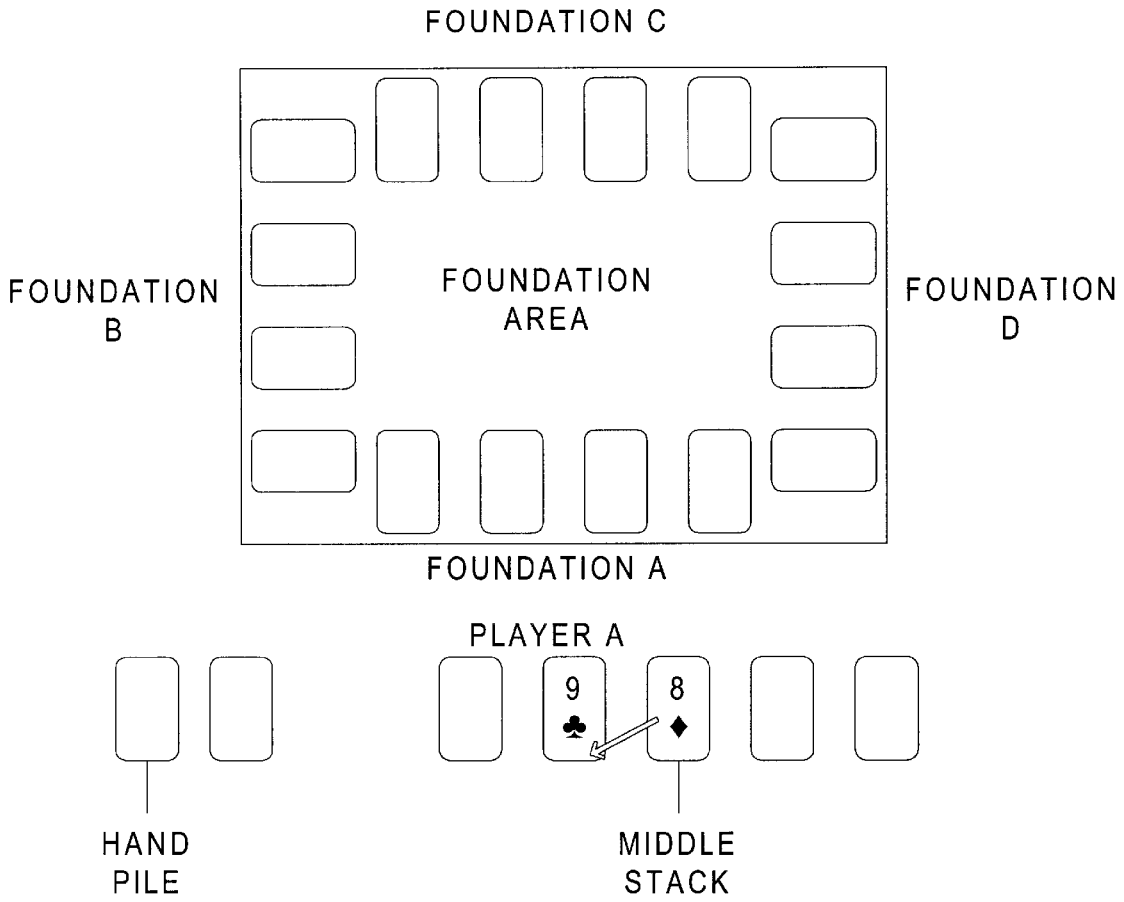
FIG. 31 illustrates a middle stack card play to a tableau pile.
Figure 32:
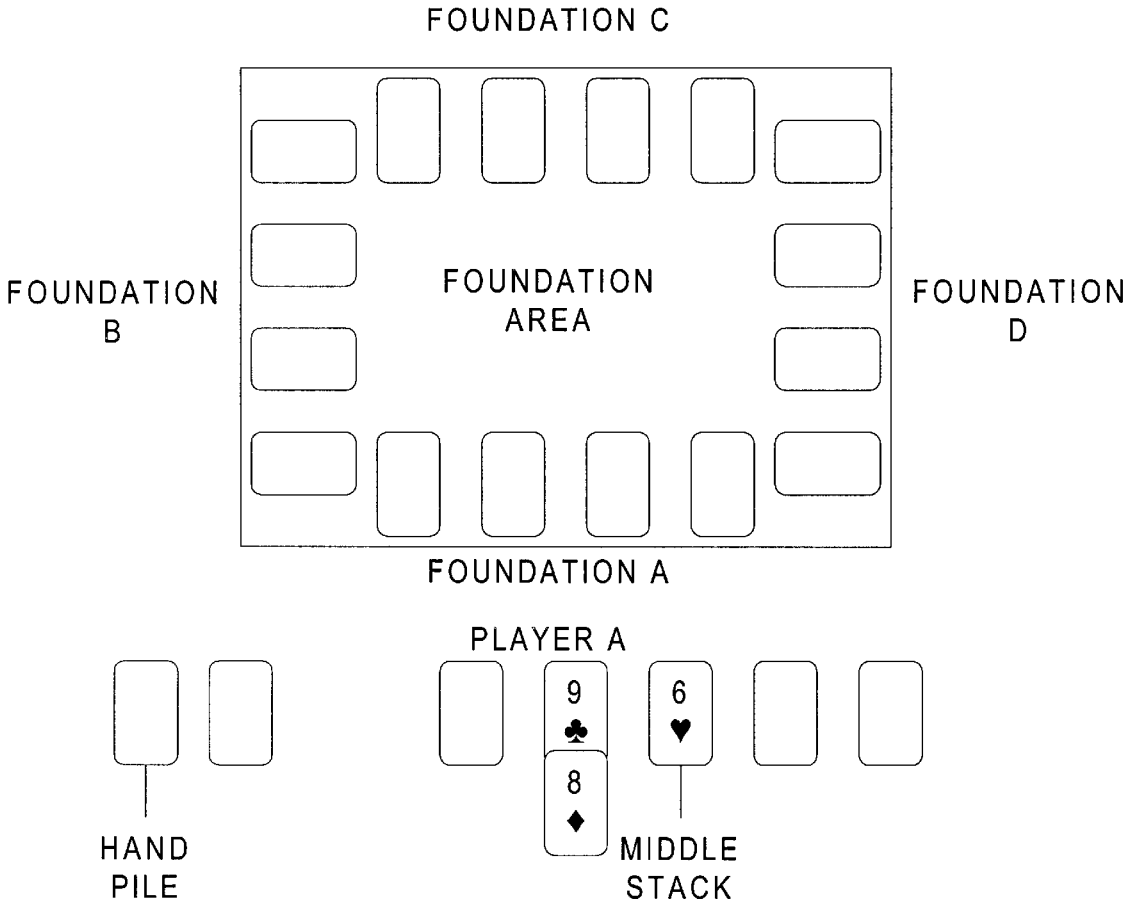
FIG. 32 illustrates the result of the middle stack to tableau pile play depicted in FIG. 31, the next card on the middle stack is flipped over.

The most important source of cards for each player is the middle stack. When any player exhausts his middle stack, the game is over, and each other player is penalized for the number of cards remaining in his middle stack. A player may move middle stack cards to a tableau or to the foundations. A player may move a middle stack card to an occupied tableau if the middle stack card is the next consecutive card of an opposite color compared with the topmost card in the tableau. An example of this is shown in FIG. 31, where player A moves the eight of diamonds from the middle stack to the second tableau on top of the nine of clubs. The resulting position is shown in FIG. 32, including the next middle stack card, which is uncovered by moving the eight of diamonds from the middle stack.

Figure 33:
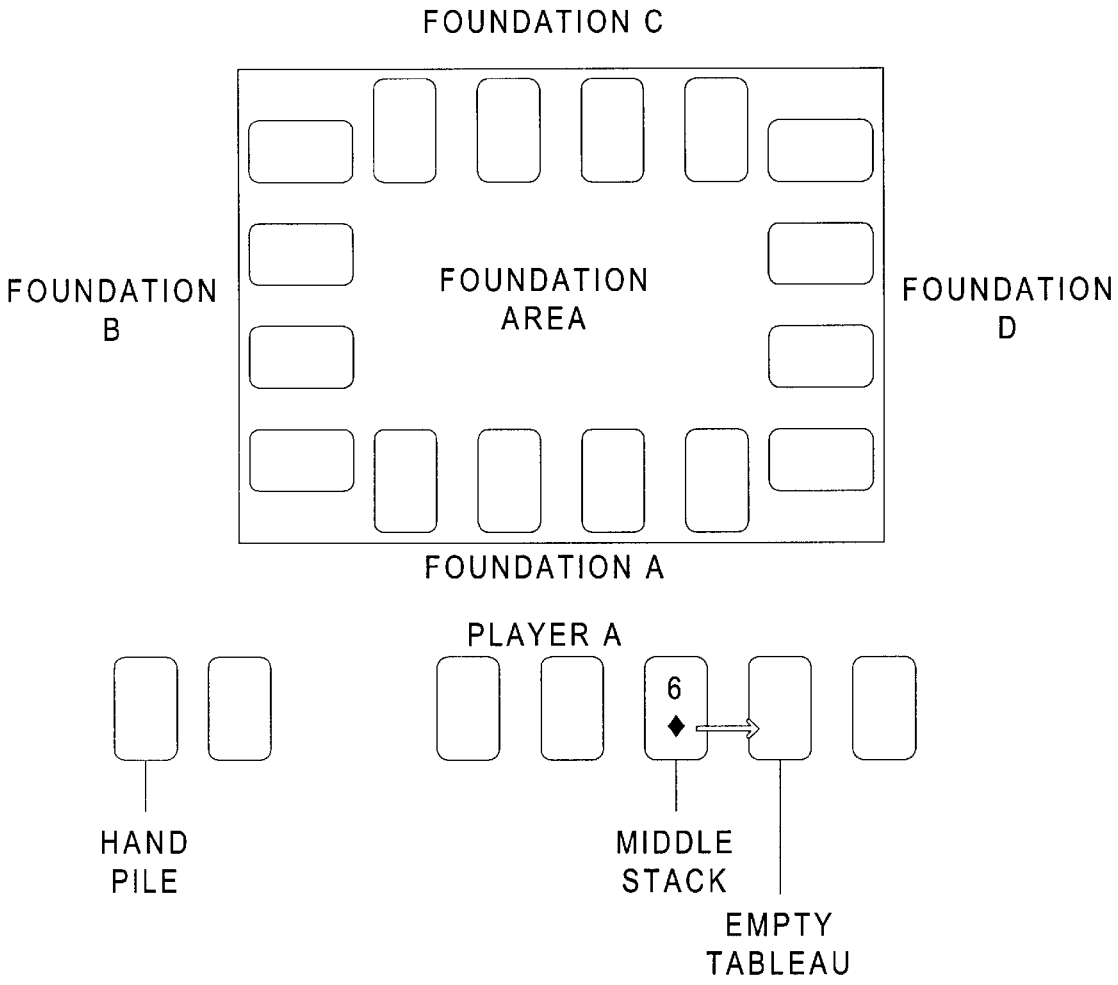
FIG. 33 illustrates a middle stack card play to an empty tableau pile.
Figure 34:
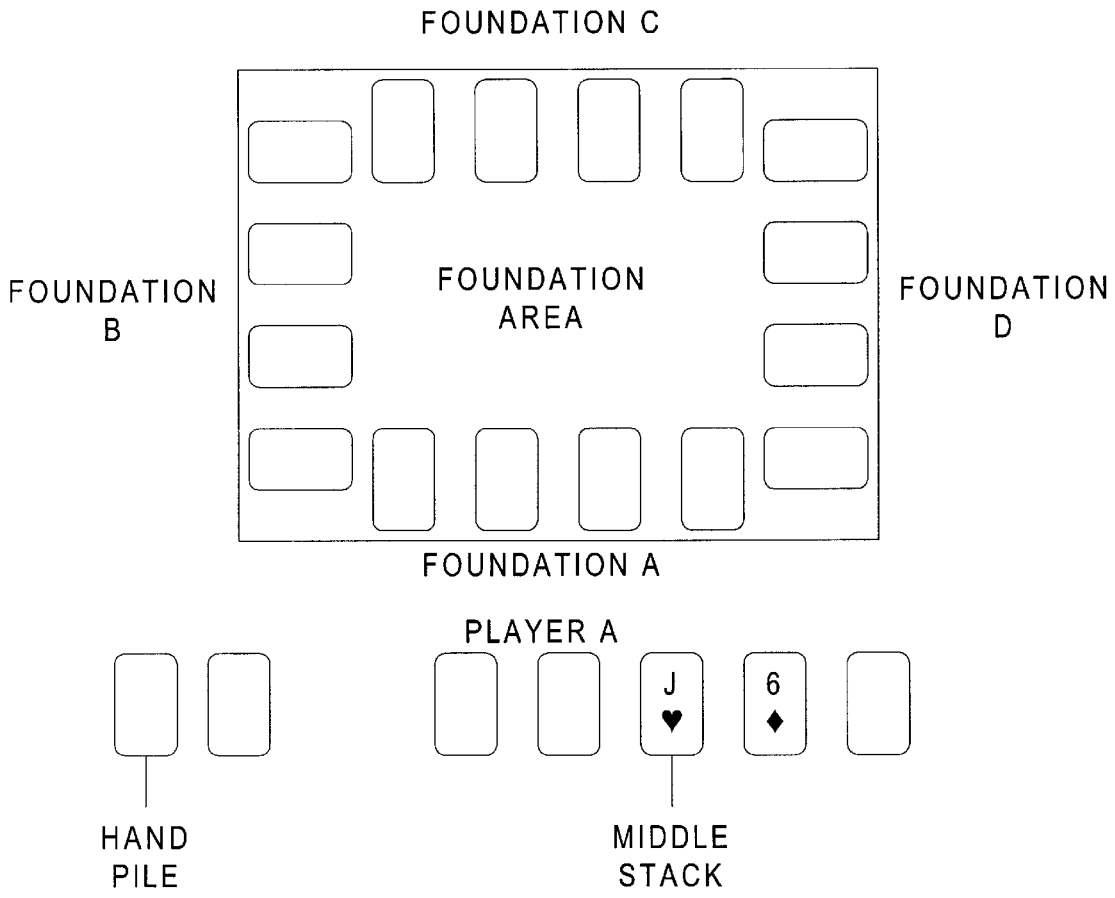
FIG. 34 illustrates the result of the middle stack to the empty tableau pile play depicted in FIG. 33, the next card on the middle stack is flipped over.
Figure 35:
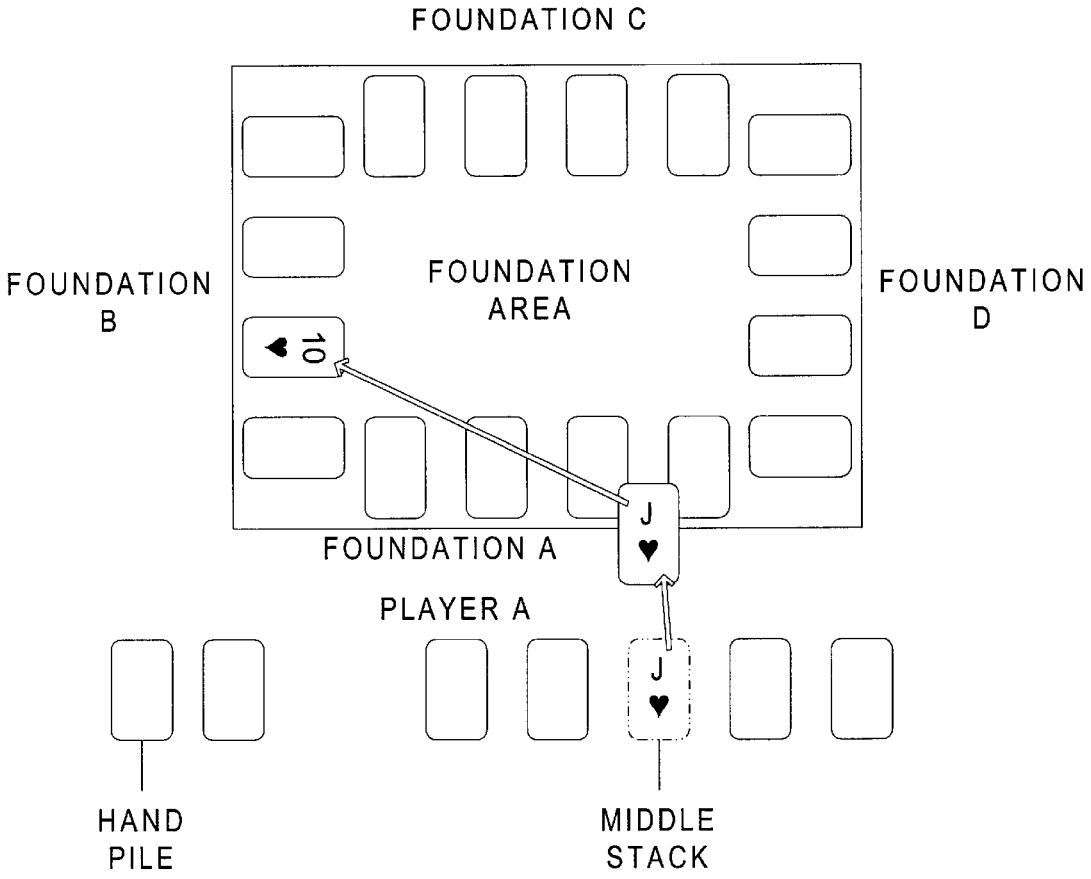
FIG. 35 illustrates a middle stack card play to a foundation pile. The player drags the card to the foundation area, releases the mouse button, the client software animates the movement to the closest foundation pile.
Figure 36:
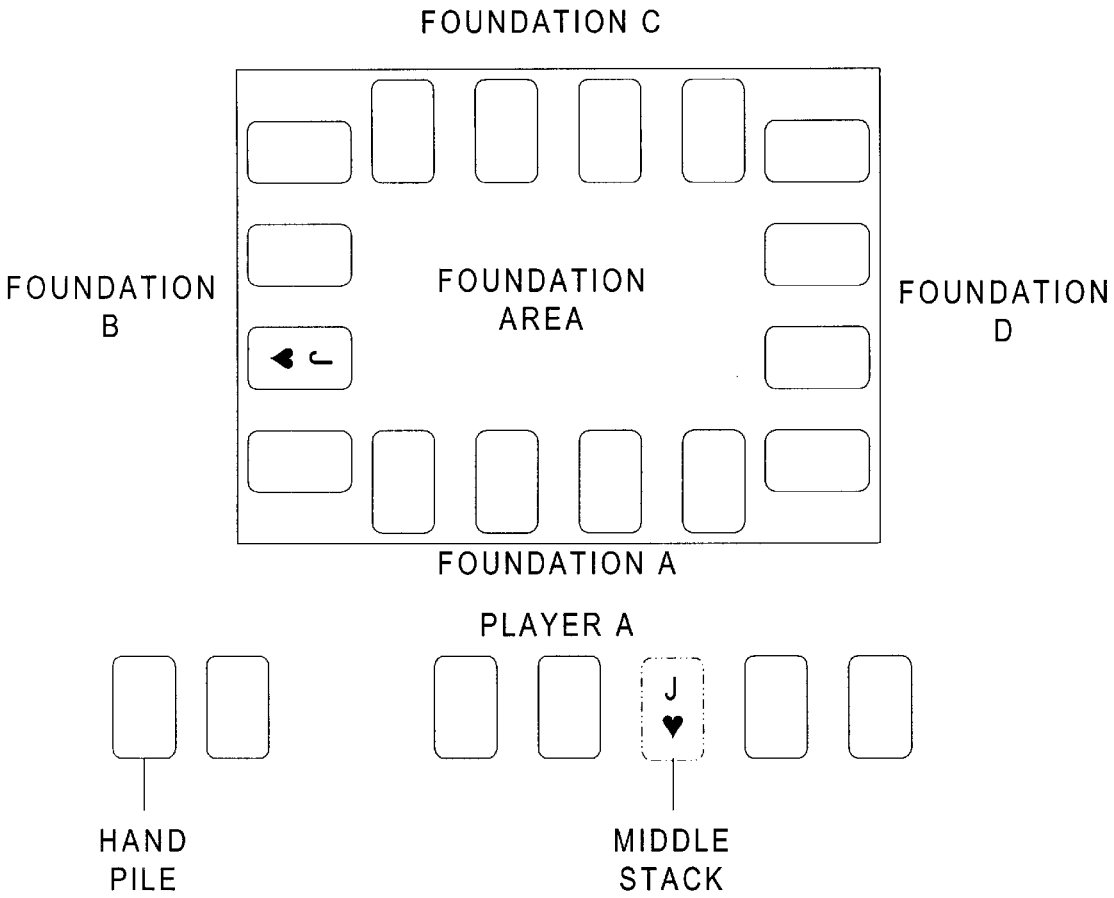
FIG. 36 illustrates the result of a middle stack card play to a foundation, the card is played and that middle stack card position is ghosted (blocked) until a confirmation of a valid card play or a card play rejection is received from the server. The card play may be either accepted (as depicted in FIG. 37) or rejected (as depicted in FIGS. 38, 39 and 40)

A player may also move a middle stack card to any empty tableau. An example of this is shown in FIG. 33, where player A moves the six of diamonds to the empty third tableau. The resulting position is shown in FIG. 34, including the next middle stack card, which is uncovered by moving the six of diamonds from the middle stack. When possible, a player's most immediately productive move is to move the middle stack card directly to the foundation. An example of this move is shown in FIG. 35. Player A drags the jack of hearts to the beginning of the foundation area and releases the card. Client A 218*a* animates the movement of the card to the closest eligible foundation, in this case, foundation B. While awaiting confirmation or rejection from the game server 214, client A 218*a* displays the card in "ghosted" form at its origination point on the tableau, and also displays the card in normal form on the foundation, as shown in FIG. 36. This is because the "ghosted" card may return if the play was rejected, but the only way the jack of hearts would leave the foundation is if another player's jack of hearts were played there first. With the ghosted card on the middle stack, the player is restricted from moving any cards from the middle stack. While the ghosted card is present, player A may not move the jack of hearts from the middle stack to a tableau, and may not play (or even see) the card beneath the jack of hearts on the middle stack.

Figure 37:
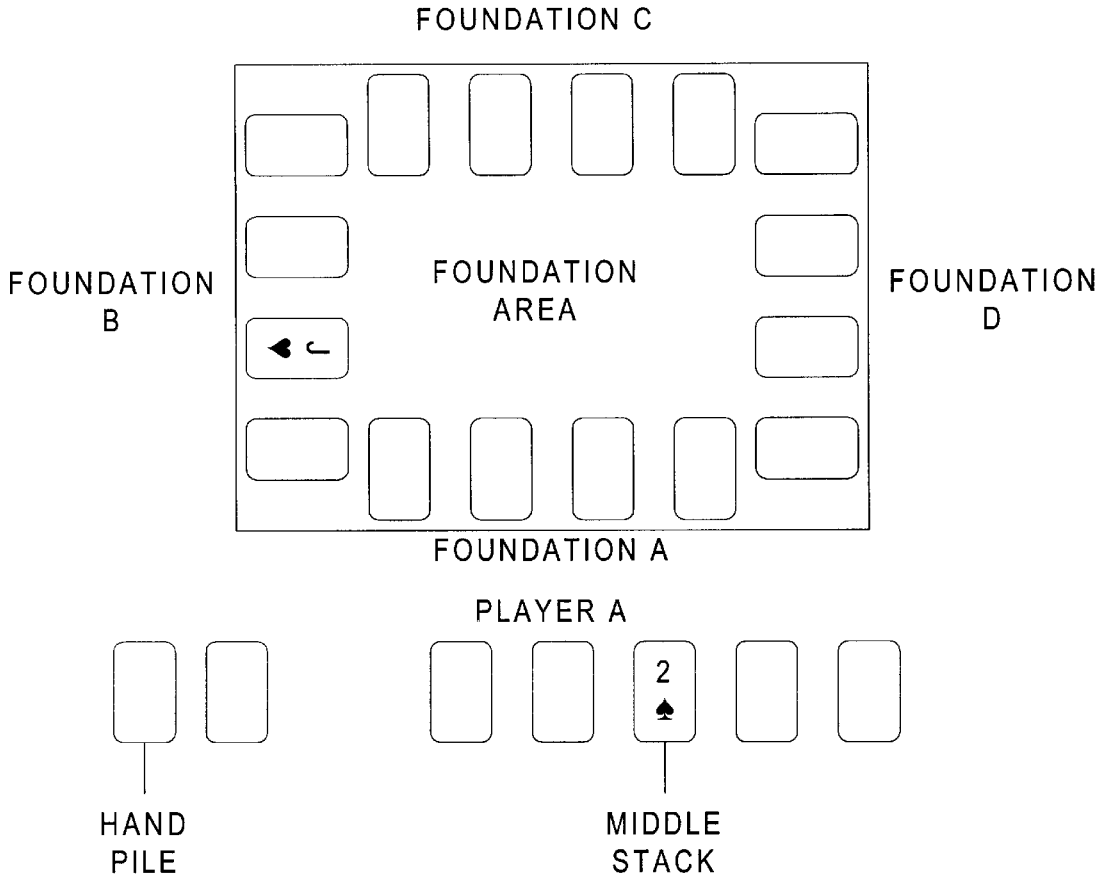
FIG. 37 illustrates the acceptance of the middle stack card play of FIGS. 35 and 36 by the server. The ghosting disappears and that middle stack card position is no longer blocked.
Figure 40:
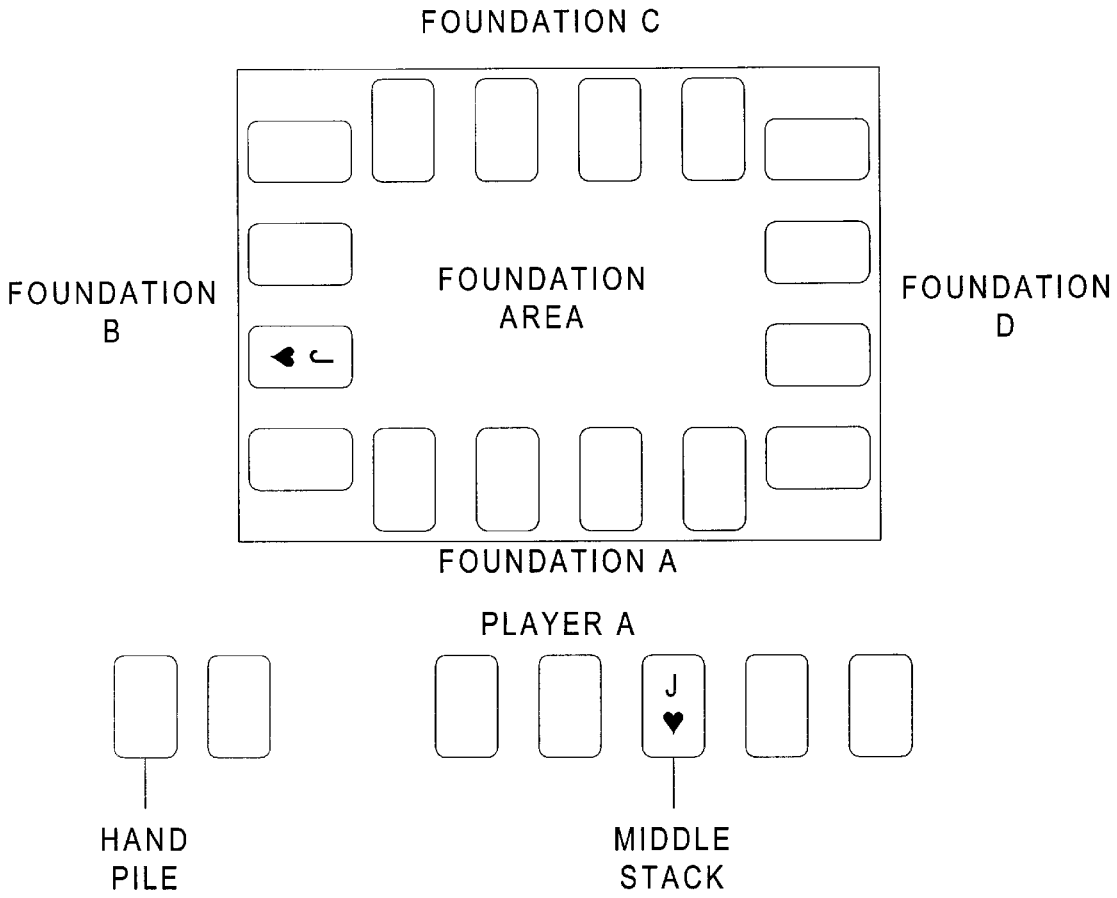
FIG. 40 illustrates the result of the sequence of plays depicted in FIGS. 35, 36, 38 and 39, in which player A made a foundation card play from the middle stack, however, the server determined another player's card play was played first. The other player's card play was accepted and remains on the foundation pile, player A's card play was rejected and returned to its origination point, removing the ghosting.

The two possible outcomes to the play of FIG. 35 are shown in FIG. 37 (confirmation) and FIG. 40 (rejection, explained in the following paragraph). If the game server 214 confirms the foundation card play, the ghosted card disappears, and the player is free to play the middle stack card that had been underneath the ghosted card. In this example, FIG. 37 shows that player A is now free to move the two of spades from the middle stack.

Figure 38:
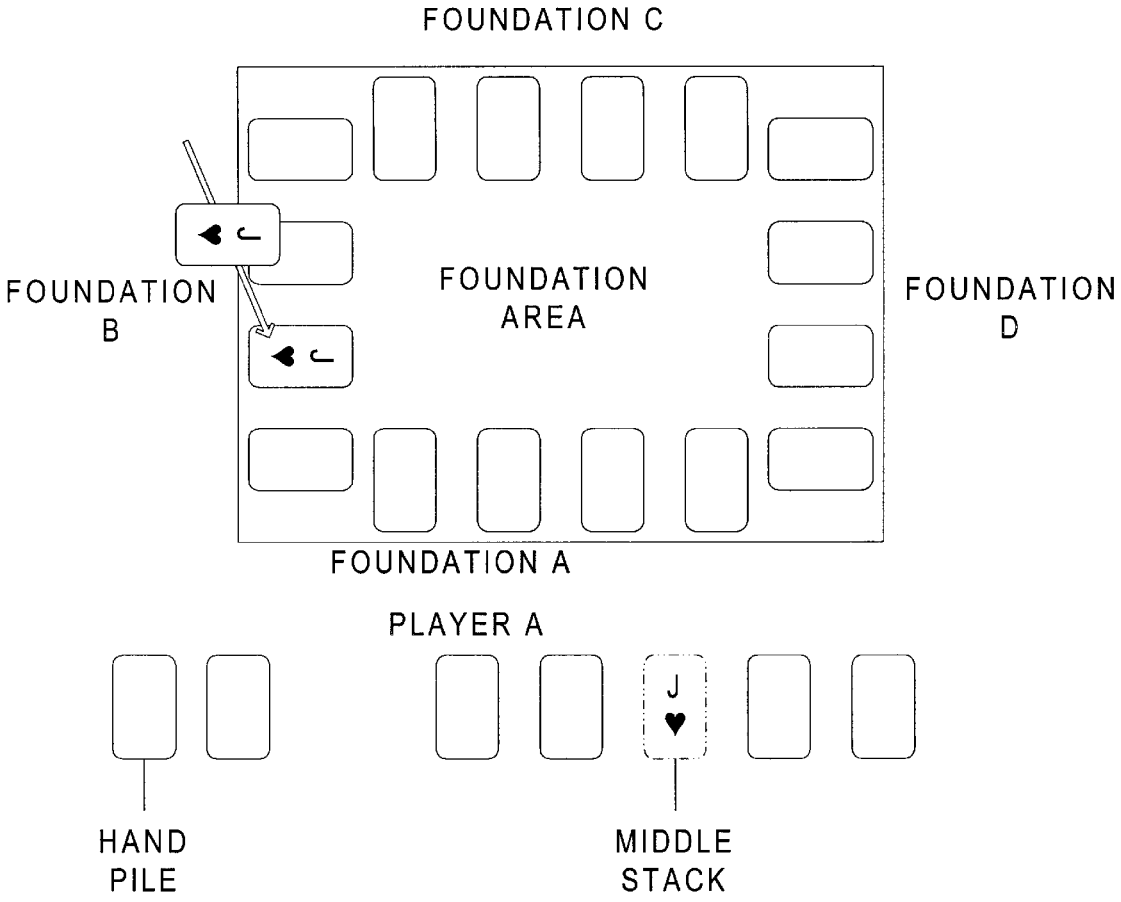
FIG. 38 illustrates acceptance by the server of another player's foundation card play to a foundation pile that player A just attempted to play to (player A's card play was illustrated in FIGS. 35 and 36.
Figure 39:
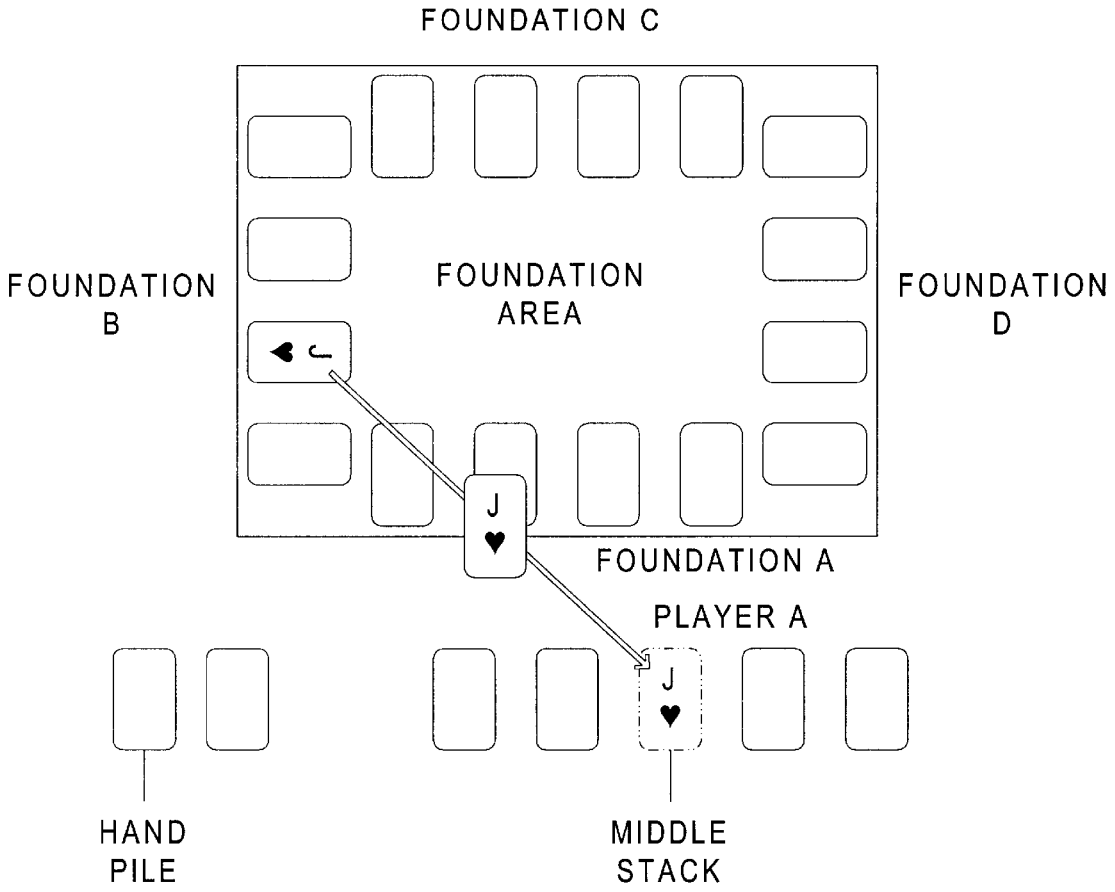
FIG. 39 illustrates rejection by the server of player A's foundation card play depicted in FIGS. 35 and 36. The server determined that the player noted in FIG. 38 was first to play. Player A's card is returned to its origination point and ghosting will be removed.

The only reason for the game server 214 to reject this foundation card play is if another player had made an earlier play to that same foundation. In this case, the game server 214 first notifies all clients 218(including client A 218*a*) that a particular player has made a successful foundation card play to a particular foundation. When client A 218*a* receives this notification, it animates the arrival of a card from the particular player to the foundation, as shown in FIG. 38. In this example, when the game server 214 receives notification of player A's attempted foundation card play, it determines that there is no longer any legal foundation for the play and rejects it. The game server 214 sends notification only to client A 218*a* that the foundation card play was rejected. When client A 218*a* receives the rejection notification, the client 218*a* animates the return of the card from the foundation and puts it into the position of the ghosted card, as shown in FIG. 39. This leaves the player in essentially the same position as he was in before attempting his foundation card play, as shown in FIG. 40, except that player A has no legal foundation on which to play his card.

Figure 41:
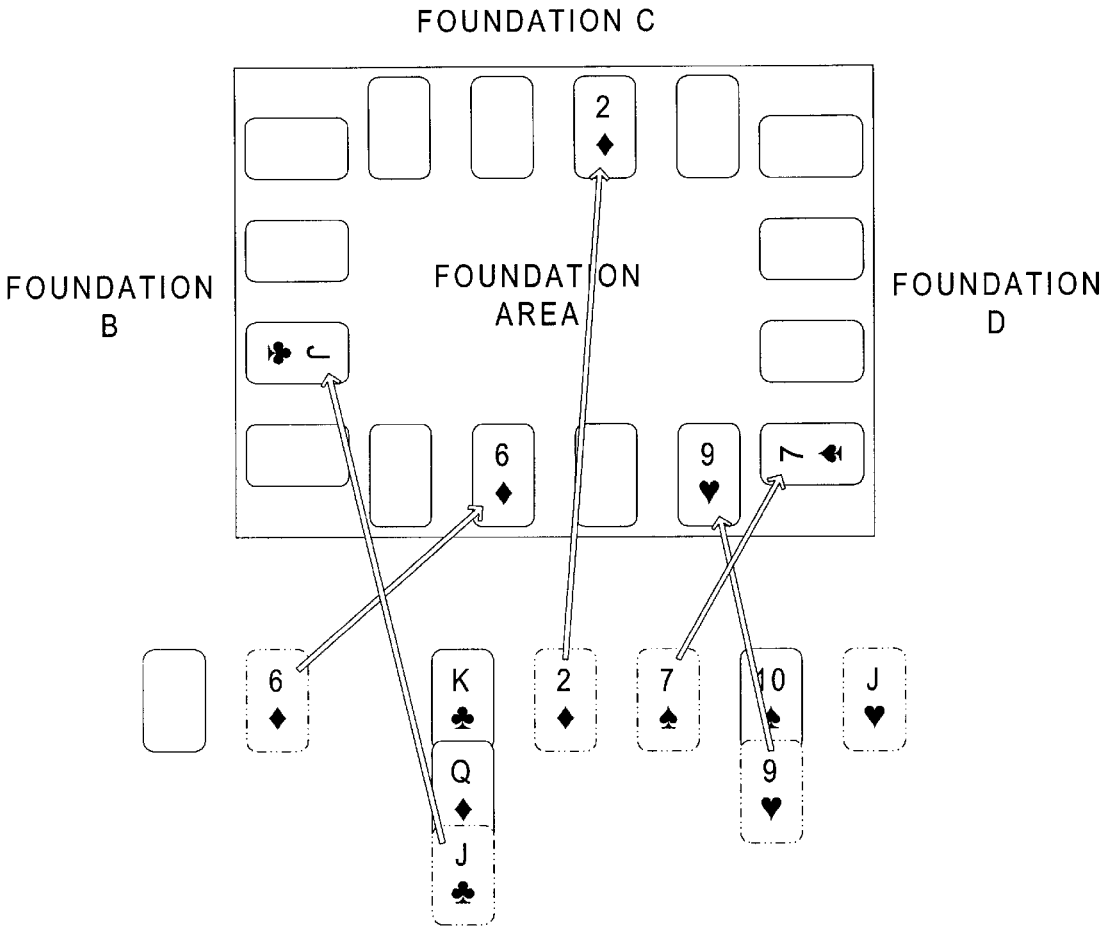
FIG. 41 illustrates multiple card plays to foundation piles. The result can be simultaneous blocks on multiple tableaus, the middle stack or waste pile. Although card plays are blocked, there are still ample move opportunity for the player, for instance, the 10 of spades may be played upon the jack of hearts, other hand pile cards may be turned over and played.

Since each "ghosted" card is independent of other tableaus, the middle stack, and the waste pile, it is possible for a player to have multiple ghosted cards in play at one time. An extreme example of this is shown in FIG. 41. Note that in this example, even with five ghosted cards waiting for confirmation or rejection, player A is free to move the entire third tableau stack on top of the jack of hearts at the fourth tableau stack. In this situation, player A is also free to turn over three more cards from the hand pile to the waste pile, or to turn over the entire waste pile back onto the hand pile.

In the real world (non-computer) game environment of multiple players, where face-to-face play of the game can occur with all players sitting around a central location, any conflict that arises from multiple players attempting to simultaneously play to the same foundation is intuitively and immediately resolved. One player will physically play his card to the foundation before the others, who will immediately see that their attempt will not be successful. To illustrate this, consider FIG. 42, which shows two players simultaneously attempting to play a 7 of spades to the same foundation pile containing the 6 of spades. Player B's 7 of spades happens to arrive first and is successfully played to the foundation pile. All players can see this. Player A, who is also attempting to make a card play to the same foundation pile, will immediately realize that there no longer is a foundation pile upon which to play his 7 of spades and return his 7 of spades to its origination point.

In the client-server-based model of this game, due to the graphical limitations of the computer screens, players can not see what cards others have available for play to the foundations. More importantly, because of inevitable delays in communication, each client 218 is not immediately aware of other players' foundation card plays. This introduces conflicts and problems in multiplayer solitaire game play that are caused by and specific to inherent network communication delays. Several players could attempt to play the same card to a limited number of foundation piles. According to the latest information available on each of the client machines at the time of such card plays, each of these card plays are acceptable. However, other players may have already made card plays to identical foundation piles and sent notification to the server. The game server 214 could have already received a card play to an identical foundation pile and notification of such acceptance by the game server 214 to all clients 218 may simply not have reached the client's 218 machines. The game server 214 must assimilate all foundation card plays and notify the clients 218 of the results. The clients 218 must illustrate and resolve these potential conflicts to the players until they receive confirmation of successful card play or rejection of the foundation card play from the server.

A simple example of server-based conflict resolution is in the case when two or more players attempt to play the same card to a single foundation.

To illustrate this, consider the beginning position shown in FIG. 43, which shows player A's perspective. Determining that he can make a foundation play, player A drags the seven of spades from the fourth tableau pile to the edge of the foundation area and releases it, as shown in FIG. 44. Client A 218*a* will animate movement of this card play to the nearest foundation pile and send a signal to the game server 214 indicating that player A has made this foundation play. While awaiting confirmation or rejection from the server, client A displays the card in "ghosted" form at its origination point on the tableau, and also displays the card in normal form on the foundation, as shown in FIG. 45. This is because the "ghosted" card may return if the play was rejected, but the only way that player A's seven of spades would leave the foundation would be if another player's seven of spades were played there first.

At about the same time, player B also sees that foundation A is ready for his seven of spades. As FIG. 46 illustrates, foundation A is in front of player A, and is to player B's right. Player B plays from a different tableau than player A; the origination point is irrelevant in server-based conflict resolution. Consequently, player B drags his seven of spades to the edge of the foundation area and releases it, as shown in FIG. 47. Client B 218*b* animates the movement of the card from the release point to the foundation and notifies the game server 214 of the move. While awaiting confirmation or rejection from the server, client B 218*b* displays the card in "ghosted" form at its origination point on the tableau, and also displays the card in normal form on the foundation, as shown in FIG. 48.

The game server 214 receives notification first from client B 218*b*, and thereby determines that player B made his move first, as shown in FIG. 49. Then the game server 214 sends out notification to all clients that player B successfully played the seven of spades to foundation A. When the server later receives notification from client A 218*a*, as shown in FIG. 50, the game server 214 notifies only client A that player A's attempted foundation play has been rejected. After receiving the first notification from the game server 214, client A 218*a* illustrates these events as shown in FIG. 51. Client A 218*a* animates the seven of spades moving in from player B and landing on foundation A. After receiving the rejection from the game server 214, client A 218*a* animates Player A's seven of spades returning from foundation A and taking its position as the formerly ghosted card, shown in FIG. 52. This leaves player A in essentially the same position as he was in before attempting his foundation card play, except player B's seven of spades is on the foundation pile, as shown in FIG. 53.

Client B 218*b* illustrates the confirmation of player B's foundation play by simply removing the ghosted card, as shown in FIG. 54. Since client B 218*b* already animated the movement of the card to foundation A, no other animations are necessary. No other players except player A are aware that player A had a failed attempt to play to foundation A.

Conflicts which involve more than one foundation are straightforward in the real world, but complicated in the client-server-based model. The real world model resolves this conflict immediately and intuitively. Consider for example the following real world events depicted in FIG. 55. First, Player B picks up his six of diamonds from one of his tableaus and starts moving it (shown as step RW1) to the closest foundation that shows the five of diamonds. As it turns out, the closest eligible foundation is foundation A. Second, player A picks up his six of diamonds from one of his tableaus and starts moving it (shown as step RW2) to foundation A. Player B plays his six of diamonds on foundation A just before player A can get his card there. Player A immediately knows that the former position of foundation A is taken. Player A notices that foundation C is also eligible and available, so he immediately starts moving his card there (shown as step RW3).

Before player A can complete his foundation card play, player D uncovers a six of diamonds at the top of his middle stack, picks up the card and starts moving it to foundation C. However, player A plays his card on foundation C before player D can move his card there. Player D, seeing no other place to play his six of diamonds, intuitively brings it right back to its origination point.

There are several problems in translating this process into a client-server-based game:

(1) Players cannot see each others' layouts. Players cannot instantaneously see each others' foundation moves.

(2) When several players make nearly simultaneous moves to the same foundation(s), each client 218 sees that the move is legal at the time it is made. Yet some of these moves must be rejected because the foundation(s) cannot hold them all.

(3) Each client automatically places foundation card plays to the closest eligible foundation. Yet there are situations when a foundation card play is best made to another, further foundation. In the example above, if player A had been required to wait for the first rejection before attempting to make another foundation play, his second attempt may have followed player D's move, and player A would have been rejected again despite having acted (originally) before player D.

To illustrate how these conflicts are resolved in client-server-based card games, those same events are examined from a client-server version. A sequence of nine (9) chronologically occurring events (T1 . . . T9) are considered from several perspectives.

T1—Player B plays the six of diamonds to the foundation area. Client B 218*b* signals the game server 214 that this play has taken place.

T2—Player A plays the six of diamonds to the foundation area. Client A 218*a* signals the game server 214 that this play has taken place.

T3—Player D plays the six of diamonds to the foundation area. Client D 218*d* signals the game server 214 that this play has taken place.

T4—Game server 214 accepts player B's play and signals all clients 218 that player B has successfully moved to foundation A.

T5—Game server 214 accepts Player A's play and signals all clients that player A has successfully moved to foundation C.

T6—Game server 214 rejects player D's attempted play and signals only client D that player D's attempted play was rejected.

T7—All clients 218 receive the game server 214 notification from T4.

T8—All clients 218 receive the game server 214 notification from T5.

T9—Client D 218*d* receives the game server 214 notification from T6.

These events are next described from the server's perspective, then player A's perspective, player B's perspective and finally from player D's perspective.

FIG. 56 illustrates the game server's view of T4. The game server 214 receives notification that client B 218*b* is attempting to play the six of diamonds to foundation A. The game server 214 responds by notifying all clients of acceptance of player B's card play to foundation A.

FIG. 57 illustrates the game server's view of T5. The game server 214 receives notification that client A 218*a* is attempting to play the six of diamonds to foundation A. The game server sees that this foundation card play cannot be accepted on foundation A, yet another eligible foundation is available, so the game server 214 sends notification to all clients 218 of acceptance of player A foundation card play to foundation C.

FIG. 58 illustrates the game server's view of T6. The game server 214 receives notification that client D 218*d* is attempting to play the six of diamonds to foundation C. Since that foundation is no longer available for the six of diamonds, and since there are no other eligible foundations available, the game server 214 sends notification only to client D 218*d* that the game server 214 has rejected player D's attempt to place the six of diamonds on the foundation.

As summarized in FIG. 59, from the game server's perspective, the game server 214 first receives notification of a six of diamonds card play from player B to foundation A (T4). The game server accepts this card play from player B and sends notification to all clients 218 that player B made a successful card play of the six of diamonds to foundation A (shown as step S1). The game server 214 then receives notification of a six of diamonds card play from player A to foundation A (T5) (shown as step S2). The game server 214 has already accepted a six of diamonds foundation card play to foundation A from player B. The game server 214 accepts this card play from Player A, however, the server's acceptance of this card play is to another available foundation, foundation C. The server 214 then sends notification to all clients 218 that player A made a successful foundation card play of the six of diamonds to foundation C (shown as step S3).

The game server 214 then receives notification of a six of diamonds card play from player D to foundation C (T6). The game server 214 has already accepted a six of diamonds foundation card play to foundation C from player A. The server rejects this card play from player D and sends notification only to client D that player D's card play was rejected. The end result is shown in FIG. 60, with player B's six of diamonds played on foundation A, and player A's six of diamonds played on foundation C.

Player A's perspective of the preceding events is different from the game server's perspective and different from the perspective of any other player. The following discussion will explain how player A sees these events.

FIG. 61 illustrates T2. Player A makes his foundation card play with the six of diamonds. Player A does this by dragging his six of diamonds from the third tableau to the foundation area and releasing his mouse button. Client A 218*a* will automatically animate the movement of Player A's card play to the nearest eligible foundation, which happens to be foundation A. Client A 218*a* then sends a signal to the game server 214 with the information that player A has made the card play to a particular foundation. Client A 218*a* causes the six of diamonds to be "ghosted" on Player A's third tableau, indicating that the card play is subject to rejection by the game server 214. Client A 218*a* also displays the six of diamonds on foundation A. Either player A's six of diamonds will remain there, or it will be replaced by another player's six of diamonds that was played first.

At T7, Client A 218*a* receives notification from the game server 214 that player B has made a successful foundation card play to foundation A. FIG. 62 illustrates the next step displayed by client A. Client A 218*a* shows that player B's six of diamonds was accepted on foundation A. Client A 218*a* animates the card movement from player B's position to Foundation A.

At T8, Client A 218*a* receives notification from the game server 214 that player A's foundation card play has been accepted on foundation C. Client A 218*a* responds with the movement illustrated in FIG. 63. Since client A 218*a* had previously animated player A's six of diamonds to foundation A, client A's next step is to animate the card movement of the six of diamonds from foundation A to foundation C. Because the game server 214 confirmed a successful foundation card play of player A's six of diamonds, client A 218*a* removes the ghosted six of diamonds from its originating point, the third tableau. This indicates that player A may now make legal moves from the third tableau or to the third tableau.

The preceding steps are summarized in FIG. 64. Player A makes his foundation card play with the six of diamonds. To do so, player A drags his card to the foundation area, then releases his mouse button (T2). Client A 218*a* will then animate the movement of his card to the nearest legal foundation, which happens to be foundation A (shown as step A1), then sends a signal to the game server 214 that player A made a card play to an identified foundation. Client A 218*a* will cause the six of diamonds to be "ghosted" at its origination point (the third tableau) because the card play is subject to rejection by the game server 214. Client A 218*a* will also display the six of diamonds on foundation A, because either player A's six of diamonds will remain there, or it will be rejected because another player's six of diamonds was played there first. In either case a six of diamonds will have been successfully played to that foundation pile.

The game server 214 later sends a message (at T4) to client A 218*a* that the game server 214 has accepted a six of diamonds foundation card play from player B to foundation A. After client A 218*a* receives the message (at T7), client A 218*a* then animates the card movement from player B's position to foundation A (shown as step A2).

At T8, client A 218*a* also receives notice that player A's six of diamonds has been successfully played on foundation C. Client A 218*a* animates the card movement of player A's six of diamonds from foundation A to foundation C (shown as step A3). Because the foundation play was accepted, client A 218*a* also removed the ghosted six of diamonds from its origination point, the third tableau. The final result, from player A's perspective, is shown in FIG. 65. Both six of diamonds are placed on foundations, and player A is again able to make any legal move involving the third tableau.

The next perspective to be considered is player B's. This perspective of the preceding events is different from the game server's perspective and different from the perspective of any other player. The following discussion will explain how player B sees these events.

FIG. 66 illustrates T1. Player B makes his foundation card play with the six of diamonds. Player B does this by dragging his six of diamonds from the first tableau to the foundation area and releasing his mouse button. Client B 218*b* will automatically animate the movement of player B's card play to the nearest eligible foundation, which happens to be foundation A. Client B 218*b* then sends a signal to the game server 214 with the information that player B has made the card play to a particular foundation. Client B 218*b* causes the six of diamonds to be "ghosted" on player B's first tableau, indicating that the card play is subject to rejection by the game server 214. Client B 218*b* also displays the six of diamonds on the foundation because either player B's six of diamonds will remain there, or it will be replaced by another player's six of diamonds.

At T7, Client B 218*b* receives notification from the game server 214 that player B's foundation card play to foundation A was successful. Client B 218*b* indicates this by removing the ghosted six of diamonds from its origination point, the first tableau, as illustrated in FIG. 67.

At T8, client B 218*b* receives notification from the game server 214 that player A's six of diamonds was accepted on foundation C. FIG. 68 shows how client B 218*b* animates the card movement from player A's position to foundation C.

The preceding steps are summarized in FIG. 69. Player B makes his foundation card play with the six of diamonds. To do so, player B drags his card to the foundation area then releases his mouse button. Client B 218*b* will then animate the movement of player B's card to the nearest legal foundation, which happens to be foundation A (shown as step B1). Client B 218*b* immediately sends a signal to the game server that player B made a card play to an identified foundation. The six of diamonds is ghosted by client B at its origination point, the first tableau, preventing player B from making moves to the first tableau or from the first tableau. On foundation A, the card will be displayed normally, since either player B's six of diamonds or another player's six of diamonds will be accepted there. When client B 218*b* receives notification of the game server's acceptance of player B's move, it removes the ghosted card from the first tableau. When client B receives notification of the game server's acceptance of player A's move, it animates the six of diamonds from player A to foundation C (shown as step B2). The final result, from player B's perspective, is shown in FIG. 70. Both six of diamonds are placed on foundations, and player B is again able to make any legal move involving the first tableau.

The third player to try to play the six of diamonds, Player D, has another perspective of the preceding events. The following discussion will explain how Player D sees these events.

FIG. 71 illustrates T3. Player D makes his foundation card play with the six of diamonds. Player D does this by dragging his six of diamonds from the middle stack to the foundation area and releasing his mouse button. Client D 218*d* will automatically animate the movement of player D's card to the nearest eligible foundation, which happens to be foundation C. Client D 218*d* then sends a signal to the game server 214 with the information that player D has made the card play to a particular foundation. Client D 218*d* causes the six of diamonds to be "ghosted" on player D's middle stack, indicating that the card play is subject to rejection by the game server 214. Client D 218*d* also displays the six of diamonds on the foundation because either player D's six of diamonds will remain there, or it will be replaced by another player's six of diamonds.

At T7, client D 218*d* receives notification from the game server 214 that player B's foundation card play has been accepted on foundation A. FIG. 72 illustrates the next step displayed by client D 218*d*. Client D 218*d* animates the card movement from player B's position to foundation A.

At T8, client D 218*d* receives notification from the game server that player A's foundation card play has been accepted on foundation C. Client D 218*d* immediately follows with the movement illustrated in FIG. 73. Client D 218*d* animates the card movement of the six of diamonds from player A to foundation C.

At T9, client D 218*d* receives notification from the game server 214 that player D's attempted foundation card play has been rejected. Client D's next step is illustrated in FIG. 74. Client D 218*d* animates the card movement of player D's six of diamonds from foundation C to its origination point, the middle stack. Client D 218*d* replaces the ghosted card on the middle stack with the actual card which was rejected from the attempted foundation card play. Player A's six of diamonds remains played on foundation C.

The preceding steps are summarized in FIG. 75. Player D makes his foundation card play with the six of diamonds. To do so, player D drags his card to the foundation area then releases his mouse button. Client D 218*d* will then animate the movement of player D's card to the nearest legal foundation, which happens to be foundation C (shown as step Dl). Client D 218*d* immediately (at T3) sends a signal to the game server 214 that player D made a card play to an identified foundation. The six of diamonds is ghosted by client D at its origination point, the middle stack, preventing player D from making moves from the middle stack. On foundation C, the card will be displayed normally, since either player D's six of diamonds or another player's six of diamonds will be accepted there.

At T7, Client D 218*d* receives notification that the game server has accepted a six of diamonds foundation play from player B to foundation A. After client D 218*d* receives the message, client D 218*d* then animates the card movement from player B's position to foundation A (shown as step D2).

At T8, client D 218*d* receives notice from the game server 214 that player A's six of diamonds has been successfully placed on foundation C. Client D 218*d* animates the card movement of player A's six of diamonds from player A to foundation C (shown as step D3).

At T9, Client D 218*d* receives notice from the game server 214 that Player D's attempted foundation card play has been rejected. Client D 218*d* animates the card movement of player D's six of diamonds from foundation C to its origination point, the middle stack (shown as step D4). Client D 218*d* will replace the ghosted card at the middle stack with the actual returning card. The final result, from Player D's perspective, is shown in FIG. 76. Two six of diamonds (from players A and B) are placed on foundations. Player D's six of diamonds was returned to it origination point, the middle stack, again allowing player D to make any legal move from the middle stack.

The game server 214 also has the responsibility of monitoring all players' middle stacks and communicating that information to all clients. Each client 218 indicates the number of cards remaining in each middle stack by displaying a bar graph with that information, as shown in FIG. 79. A full bar represents all cards remaining in the middle stack, an empty bar indicates all cards played from the middle stack. Although players can not see other player's middle stacks, this bar graph information will give each player an indication of how close each player is to ending the game.

When a player makes a move that removes a card from his middle stack, the player's client 218 sends a notification of that information to the game server 214. That player's client 218 also adjusts his bar graph to reflect the new size of that player's middle stack. After the game server 214 receives the notification, the game server 214 then sends a notification to each client 218(except the one moving the middle card) that a middle card has been successfully removed from that player's middle stack. Each client 218 changes its graph display to reflect the new size of that player's middle stack. In the case of a middle stack card play to a foundation, the client 218 will update his own bar graph first upon confirmation of a successful middle stack card play to a foundation.

If two or more players make moves that remove the final card from their middle stacks at about the same time, the game server 214 checks the notifications to see which player cleared his middle stack first, thereby ending the game. The game server 214 then sends notification to any clients whose players were unsuccessful in playing their last middle stack card that their play was rejected.

Finally, at the end of every game, the game server 214 computes the scores and sends that information to all clients 218 to display.

A second multiplayer solitaire-related game is Multiple Klondike. Each player has a unique deck. In a real world (non-computer) environment, a table or floor area is needed as players are seated with identical layouts around a central foundation area, as depicted in FIG. 78.

Piles of cards are played for points on the foundations. Initially, there are no cards played on the foundations. All foundations must begin with aces and be built up in rank and suit to kings. Players may play cards on foundations started or played upon by any player. When two players simultaneously attempt to place a card upon the same foundation, the first card that arrives stays, the other player must return his card to its previous location. Foundation cards may be played from the waste pile or the lowest ranking face up card of any tableau. Once a card is played to a foundation, it may no longer be moved.

The topmost card of each tableau is face up. All underlying cards are face down. There are seven piles of tableau cards. Counting from left to right, tableaus have incrementing numbers of cards starting from one (1) and ending with seven (7) cards in the 7th pile. Cards or stacks of cards may be played on the face up tableaus, from the waste pile, or other tableaus, in decrementing rank and alternating color order only. If cards are moved from another tableau, all face up cards from the tableau must be moved and the decrementing rank and alternating color ordering must be maintained. Only kings or tableaus starting with a king may be moved to empty tableaus.

The card layout also includes a pile of face down cards that has not been dealt to the remaining card layout identified as the hand pile.

The waste pile is a pile of face up cards that came from the hand pile. Cards may be moved from the waste pile to any legal tableau or foundation pile.

A player wins when all the player's cards are successfully moved to the foundations.

When playing Multiple Klondike in an online or networked environment and viewing the game from an individual player's display screen, as shown in FIG. 79, the player sees only his own hand, waste and tableau cards as well as all foundations. The object of Multiple Klondike is to quickly play all cards to the foundations, the first player to do so wins. Whenever a player makes a play to the common foundations, that player's client 218 leaves a "ghosted" card in place as it waits for confirmation or rejection by the server. If the game server 214 accepts the play, the ghosted card disappears. The view restrictions, contention and timing issue problems that one encounters when playing online Multiple Klondike are the same in all relevant aspects to online multiplayer Zip solitaire. This holds for all foundation card plays and play contentions that can occur in the online environment.

A third multiplayer solitaire-related game is identified as "Spit". Each player has a unique deck. There is one foundation pile per player. In a real world (non-computer) environment, a table or floor area is needed as players are seated with identical layouts around a central foundation area, as depicted in FIG. 80.

Foundations begin with a "spit card" and can be built up or down in rank, alternating color. Aces may be played on kings or deuces and vice versa to allow for continuous play in either ascending or descending order. When two players simultaneously attempt to place a card upon the same foundation, the first card that arrives stays, the other player must return his card to its previous location. Foundation cards may only be played from any tableau.

There are a total of five piles of cards in the tableau area, labeled A through E in FIG. 80. After the initial deal out, only the topmost card of each tableau is face up. All underlying cards are face down. Counting from left to right, tableaus have incrementing numbers of cards starting from 1 and ending with 5 cards in the 5th pile (similar to Klondike, but with 5 tableaus instead of 7).

Pile one is dealt face up with a down card placed in piles 2,3,4,5. Then a card is dealt face up on pile two with another down card on piles 3,4,5. This is repeated until all piles have a card face up. Cards on the tableaus can be arranged by number after the "spit card" is thrown. For example, a four is placed on any other fours that are shown. If a pile runs out of cards any one or group of these up cards may be moved over to fill this empty space and a card can then be turned over. Cards or stacks of cards may be played on the face up tableaus, from other tableaus, in decrementing rank and alternating color order only. If cards are moved from another tableau, all face up cards from the tableau must be moved and the decrementing rank and alternating color ordering must be maintained. Only kings or tableaus starting with a king may be moved to empty tableaus.

The Spit card game also includes a pile of face down cards that has not been dealt to the tableaus. The hand pile contains all of the "spit cards". One card from the hand is simultaneously "spit" by each player onto the foundation to begin the game. When none of the players have a move, one card from the hand is simultaneously "spit" by each player onto the foundation to resume the game.

The object of this card game is for a player to deplete all its cards as quickly as possible. After the "spit" card is thrown players build on any foundation pile using cards from their tableaus. When no further moves are available for all players, another spit card is thrown from the hand pile and play continues. When one player's tableaus are gone each player shuffles a foundation into their remaining hand pile cards. The player to exhaust his tableau first has first choice on which foundation pile to pick up (the one with the least amount of cards). The player with the second least amount of tableau cards picks his foundation next, and so on. Another tableau is then laid out and play continues. When any player does not have enough cards left to build a complete tableau he turns the top card of each remaining incomplete pile face up. In addition, at this point he no longer throws a "spit card" and the players build on one fewer foundation.

With reference to FIG. 80, a representative real world (non-computer) layout of the Spit solitaire game is illustrated in which four players are playing this game.

When playing Spit in an online or networked environment and viewing the game from an individual player's display screen, as shown in FIG. 81, the player sees only his own hand and tableau cards as well as all foundations. The view restrictions, contention and timing issue problems that one encounters when playing online multiplayer Spit are the same in all relevant aspects to multiplayer Zip solitaire. This holds for all foundation card plays and play contentions that can occur in the online environment.

Referring to FIG. 82, a two-player spit card game is depicted, where two players simultaneously spit a card to a foundation. These foundations are common to all players. Players may then play to either foundation as seen in FIG. 83. As in Zip and Multiple Klondike, when a foundation card play is made, the card just played is "ghosted" until confirmation is received from the game server that the card play was accepted. After the foundation card play is accepted, the ghosting disappears. If all face-up cards of a given tableau are played, the underlying face-down card will be turned face-up. FIG. 84 shows the result of an accepted foundation card play, the ghosting disappears and the underlying card is turned over. Note also in FIG. 84, the player has two ten cards showing, one of these may be played upon the other, as seen in FIG. 85.

Referring to FIG. 86, a foundation card play from a tableau is illustrated. When this card play is accepted, as seen in FIG. 87, the ghosting disappears and the player may move cards from any other tableau to the empty tableau, which allows that player to turn up a previously underlying facedown card.

The foregoing discussion of the invention has been present for purposes of illustration and description. Further, the description is not intended to limit the invention to the form disclosed herein. Consequently, variation and modification commensurate with the above teachings, within the skill and knowledge of the relevant art, are within the scope of the present invention including, but no limited to, using the disclosed features for other multiplayer solitaire games. The embodiments described hereinabove are further intended to explain the best modes presently known of practicing the invention and to enable other skilled in the art to utilize the invention as such with other embodiments, and with the various modifications required by their particular applications or uses of the invention. It is intended that the appended claims be construed to include alternative embodiments to the extent permitted by the prior art.

What is claimed is:

1. A method for playing a card game by a number of players including at least a first player and a second player using a plurality of client-computers including at least a first client-computer and a second client-computer and at least one server, comprising:

displaying a number of hand sets, a number of tableau sets and a number of foundations;

playing by the first player a first card to a first suit of a first foundation;

determining whether said first card played by the first player is acceptable using one of said server and said first client-computer; and confirming that said first card played by the first player using said one of said server and said first client-computer.

2. A method, as claimed in claim 1, further including:

playing by a second player a first card to said first suit of said first foundation, wherein said step of playing by the second player is conducted close in time to said step of playing by the first player and in which said first card played by the second player is the same as said first card played by the first player and in which said step of determining includes determining whether said first card played by the first player is first in time to said first card played by the second player using one of said server and said first client-computer.

3. A method, as claimed in claim 1, wherein:

said step of displaying includes displaying at least one middle stack and said first card played by the first player includes moving said first card from said middle stack and said method further comprising disallowing the first player from playing a second card from said middle stack for a time period.

4. A method, as claimed in claim 3, further including:

indicating to the first player that the first player is disallowed from playing said second card from said middle stack.

5. A method, as claimed in claim 3, further including:

allowing the first player to play said second card from said tableau sets during said time period.

6. A method, as claimed in claim 1, wherein:

said step of displaying includes displaying a waste set and in which said first card played by the first player is from said waste set and said method further comprising disallowing the first player from playing a second card from said waste set when said second card is associated with a card position in said waste set associated with said first card.

7. A method, as claimed in claim 2, wherein:

said step of determining includes taking into account by said server a time when said first card was played and taking into account a time when said first card was played by the second player using said server.

8. A method, as claimed in claim 2, wherein:

said step of confirming includes notifying each of the first and second players related to said first card played by each of the first and second players using a display means of said first client-computer and a display means of said second client-computer.

9. A method, as claimed in claim 1, wherein:

said step of playing by the first player includes generating by said first client-computer a time stamp associated with when said step of playing started and sending said time stamp to said server.

10. A method, as claimed in claim 1, wherein:

said step of playing said first card by the first player includes playing from a first tableau of said tableau sets and said method further comprising the step of disallowing the first player from playing a second card from said first tableau when said second card is the only card being played from said first tableau.

11. A method, as claimed in claim 1, wherein:

said step of playing said first card by the first player includes playing from a first tableau of said tableau sets and said method further comprising allowing the first player to play a second card from said first tableau when said first card is not the only card being played from said first tableau.

12. A method, as claimed in claim 1, wherein:

said step of displaying includes displaying four foundations for each of the number of players including four foundations for each of the first and second players.

13. A method, as claimed in claim 12, wherein:

said step of displaying includes displaying only a first hand set using display means of said first client-computer and displaying only a second hand.

14. A method, as claimed in claim 1, wherein:

said step of displaying includes displaying four first foundations substantially horizontally associated with the first player and displaying four second foundations vertically associated with the second player.

15. A method, as claimed in claim 2, wherein:

said step of playing said first card by the second player includes causing, using said server, said first card to move to said first suit of a second foundation.

16. A method, as claimed in claim 15, further including:

playing a first card by a third player to said first suit of said second foundation and said step of determining includes determining whether said first card played by the third player is first in time to said first card played by the second player.

17. A method, as claimed in claim 15, wherein:

said step of causing is conducted when said server determines that said first card played by the first player is first in time to said first card played by the second player.

18. An apparatus for computerized playing of a multiplayer card game, comprising:

a plurality of client-computers including a first client-computer and second client-computer, each of said plurality of client-computers having display means, said display means of each of said client-computers for displaying a layout associated with the multiplayer card game that includes at least one hand set, a number of tableaus that constitute a tableau set and a number of foundations;

network means connected to said plurality of client-computers;

a server communicating with each of said plurality of client-computers using said network means for controlling operations related to the playing of the multiplayer card game, wherein said server determines whether a first card played by a first player to a first suit of a first foundation is an acceptable play.

19. An apparatus, as claimed in claim 18, wherein:

said server obtains information related to an identity of the first player who was first in playing said first card to said first suit of said first foundation.

20. An apparatus, as claimed in claim 18, wherein:

said server includes queue means for use in ascertaining whether the first player is the first to play said first card to said first suit of said first foundation.

21. An apparatus, as claimed in claim 18, wherein:

said server means is responsive to time information received from said first client-computer in determining whether said first card played by the first player to said first suit of said first foundation is an acceptable play.

22. An apparatus, as claimed in claim 18, wherein:

said server controls said first client-computer related to positioning said first card when said server determines that said first card played to said first suit of said first foundation is not an acceptable play.

23. An apparatus, as claimed in claim 18, wherein:

said first client-computer controls moving said first card on said display means of said first client-computer before said server determines whether said first card played by the first player to said first suit of said first foundation is an acceptable play.

24. An apparatus, as claimed in claim 18, wherein:

said first client-computer is used in controlling movement of said first card played by the first player when said server determines that said first card played is not an acceptable play.

25. An apparatus, as claimed in claim 18, wherein:

said first client-computer controls movement of a second card on said display means of said first client-computer when said second card is free to be moved while said server determines whether said first card played is an acceptable play.

26. An apparatus, as claimed in claim 18, wherein:

said display means of said first client-computer displays a first foundation horizontally and a second foundation vertically.

27. An apparatus, as claimed in claim 18, wherein:

said display means of said first client-computer displays only one hand set, only one waste set, only one middle stack and only one set of tableaus for a first player playing the multiplayer card game and said display means of said second client-computer displays only one hand set, only one waste set, only one middle stack and only one set of tableaus for a second player playing the multiplayer card game and in which each thereof on said display means of said second client-computer is different from each of said one hand set, said one waste set, said one middle stack and said one set of tableaus displayed by said display means of said first client-computer.

28. An apparatus, as claimed in claim 18, wherein:

said display means of said first client-computer displays card movements that are different from said display means of said second client-computer when said server determines that said first card played is not an acceptable play.

29. An apparatus, as claimed in claim 18, wherein:

said server is used in determining whether a first card played by a second player to said first suit of said first foundation close in time to said first card played by the first player to said first suit of said first foundation is an acceptable play and said display means of said second client-computer displays a movement of said first card by the second player to said first suit of said first foundation and then a movement of said first card away from said first suit of said first foundation when said first card of the second player is not an acceptable play.

30. An apparatus, as claimed in claim 18, wherein:

said display means of said first client-computer displays movement of said first card to said first suit of said first foundation, said display means of said second client-computer displays a first card played by the second player to a first suit of a second foundation and a display means of a third client-computer displays movement of a first card played by a third player to said first suit of said first foundation and then a movement away from said first suit of said first foundation when said server determines that said first card played by the third player is not an acceptable play.

* * * * *